US006937830B2

(12) United States Patent
Satoh

(10) Patent No.: US 6,937,830 B2
(45) Date of Patent: Aug. 30, 2005

(54) IMAGE FORMING APPARATUS

(75) Inventor: Osamu Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 161 days.

(21) Appl. No.: 10/617,399

(22) Filed: Jul. 11, 2003

(65) Prior Publication Data

US 2004/0052545 A1 Mar. 18, 2004

(30) Foreign Application Priority Data

| | | |
|---|---|---|
| Jul. 11, 2002 | (JP) | 2002-203056 |
| Jul. 29, 2002 | (JP) | 2002-220166 |
| Sep. 10, 2002 | (JP) | 2002-264458 |
| Feb. 5, 2003 | (JP) | 2003-028492 |

(51) Int. Cl.[7] ..... G03G 15/20
(52) U.S. Cl. ..... 399/92
(58) Field of Search ..... 399/92

(56) References Cited

U.S. PATENT DOCUMENTS

| | | | | |
|---|---|---|---|---|
| 6,266,498 | B1 * | 7/2001 | Oda et al. | 399/92 |
| 6,327,447 | B1 * | 12/2001 | Nakano et al. | 399/92 |
| 6,505,018 | B2 * | 1/2003 | Fukutome | 399/92 |
| 6,515,747 | B1 | 2/2003 | Satoh et al. | 399/258 |
| 6,560,438 | B2 | 5/2003 | Kosuge | 399/350 |
| 6,628,908 | B2 | 9/2003 | Matsumoto et al. | 399/106 |
| 6,628,915 | B2 | 9/2003 | Muramatsu et al. | 399/64 |
| 6,643,485 | B2 * | 11/2003 | Takahara | 399/250 |
| 6,813,457 | B2 * | 11/2004 | Yoshiki | 399/92 |
| 2002/0171861 | A1 | 11/2002 | Katsuragi | |
| 2003/0147665 | A1 * | 8/2003 | Ahn et al. | 399/92 |

FOREIGN PATENT DOCUMENTS

| | | |
|---|---|---|
| JP | 2-253272 | 10/1990 |
| JP | 5-289494 | 11/1993 |
| JP | 6-19293 | 1/1994 |
| JP | 6-83153 | 3/1994 |
| JP | 6-202458 | 7/1994 |
| JP | 7-72770 | 3/1995 |
| JP | 9-54494 | 2/1997 |
| JP | 9-81018 | 3/1997 |
| JP | 10-3220 | 1/1998 |
| JP | 10-186815 | 7/1998 |
| JP | 10-213947 | 8/1998 |
| JP | 11-295986 | 10/1999 |
| JP | 2002-174951 | 6/2002 |

OTHER PUBLICATIONS

U.S. Appl. No. 09/809,075, filed Mar. 16, 2001, Sahashi.
U.S. Appl. No. 09/892,656, filed Jun. 28, 2001, Sasaki et al.
U.S. Appl. No. 10/102,633, filed Mar. 22, 2002, Amey Ama et al.
U.S. Appl. No. 10/158,144, filed May 31, 2002, Tsukamoto et al.

(Continued)

*Primary Examiner*—Christopher W. Fulton
(74) *Attorney, Agent, or Firm*—Oblon, Spivak, McClelland, Maier & Neustadt, P.C.

(57) ABSTRACT

An image forming apparatus of the present invention includes a photoconductive drum and a developing device for developing a latent image formed on the drum with a developer. The developing device includes a developing roller facing the drum via an opening formed in the casing of the developing device. A feeding device feeds a controlled gas to a position upstream, in the direction of rotation of drum, of a developing position where the developing device operates. A first switching device selectively causes a developer layer deposited on the developing roller to contact the developing zone of the drum in an image formation condition or to part from the developing zone in a stand-by condition. A sealing device maintains, in the image forming condition, a gap between the drum and the casing at a position downstream of the developing zone in the direction of rotation of the drum or seals the gap in the stand-by condition.

52 Claims, 38 Drawing Sheets

OTHER PUBLICATIONS

U.S. Appl. No. 10/227,308, filed Aug. 26, 2002, Kawaura.
U.S. Appl. No. 10/227,303, filed Aug. 26, 2002, Kawaura.
U.S. Appl. No. 10/316,156, filed Dec. 11, 2002, Kosuge.
U.S. Appl. No. 10/780,773, filed Feb. 19, 2004, Satoh.
U.S. Appl. No. 10/875,277, filed Jun. 25, 2004, Shoji et al.
U.S. Appl. No. 10/942,899, filed Sep. 17, 2004, Satoh et al.
U.S. Appl. No. 10/986,781, filed Nov. 15, 2004, Matsuura et al.

* cited by examiner

IMAGE FORMING APPARATUS

BACKGROUND OF THE INVENTION

1. Field of the Invention

The present invention relates to a printer, copier, facsimile apparatus or similar electrophotographic image forming apparatus.

2. Description of the Background Art

An electrophotographic image forming apparatus usually includes a charger for uniformly charging the surface of a photoconductive drum or similar image carrier, an exposing unit for exposing the charged surface of the drum imagewise to thereby form a latent image, a developing device for developing the latent image with toner, or developer, to thereby produce a toner image, and an image transferring device for transferring the toner image to a paper sheet, OHP (OverHead Projector) sheet or similar sheet. The charger is, in many cases, implemented as a discharge type of charger.

A problem with the electrophotographic image forming apparatus is that the chargeability of toner is susceptible to the varying environment and directly effects image quality, as known in the art. Particularly, the prerequisite with a color image forming apparatus, which is extensively used today, is that the chargeability of toner be maintained stable from the color reproducibility standpoint, among others. Further, ozone, NOx (nitrogen oxides) and other discharge products derived from the discharge of the charger deteriorate the drum to thereby lower image quality and reduce the durability of the entire apparatus.

In light of the above, a current trend in the image forming art is toward positive control over the environment around the drum, which has heretofore been regarded as an error factor, for stabilizing the charging ability of toner and enhancing durability of the drum. For example, it has been proposed to configure a space around the drum as a passage structurally isolated from the other spaces and cause controlled air, e.g., room temperature, low humidity air to flow through the passage. With this configuration, however, it is difficult to replace air inside the developing device with the controlled air. While this difficulty maybe overcome if a pump, for example, delivers compressed, controlled air into the developing device, compressed air raises pressure inside the developing device to thereby cause an air stream to blow out of the developing device. Such an air stream scatters around toner when the developing device is in operation, and causes the toner to deposit on the drum, lowering image quality. In this connection, Japanese Patent Laid-Open Publication Nos. 63-159887, 5-66663 and 10-3220, for example, teach various arrangements for coping with the scattering of toner.

Various schemes have heretofore been proposed for positively controlling the environment in the developing device in order to stabilize the chargeability of toner. Japanese Patent Laid-Open Publication No. 6-19293, for example, discloses a developing device including a humidity sensor responsive to the humidity of a developer stored in the developing device. When the humidity of the developer is higher than a preselected upper limit, as determined by the sensor, a dry gas source sends nitrogen or similar dry gas into the developing device to thereby dehumidify the inside of the developing device. As the developer is agitated, the dry gas is introduced into the developer for thereby lowering the humidity of the developer.

Further, Japanese Patent Laid-Open Publication No. 7-128967 teaches a developing device configured to remove excess moisture with moisture absorbing means wrapped with a porous, moisture-permeable material. Japanese Patent Laid-Open Publication No. 2001-109263 proposes a developing device configured to remove moisture from a developer, which is collected from the developing device, by heating the developer in a depressurized condition. Japanese Patent Laid-Open Publication No. 07-072722 discloses a developing device configured to feed water to maintain the moisture content of a developer constant.

However, with any one of the conventional schemes stated above, it is difficult replace air inside the developing device, in which toner grains of short charges, for example, are floating, with controlled air for the following reason. In practice, it is impossible to introduce, in a short period of time, controlled air into the developing device without resorting to external forces while preventing toner having a mean grain size as small as several micrometers from leaking to the outside. If a pump, for example, is used to send compressed, controlled air into the developing device, then there arises the toner scattering problem stated earlier.

A problem with the developing devices of Laid-Open Publication Nos. 06-019293 and 2001-109263 mentioned earlier is that the humidity sensor increases the cost of the developing device. Particularly, in the developing device of Laid-Open Publication No. 06-019293, the dry gas fed to the developing device is apt to fling up toner and cause it to deposit on the drum, lowering image quality. The developing device taught in Laid-Open Publication No. 07-128967 has a problem that the ability of the moisture absorbing member disposed in the developing device is limited and must be replaced from time to time, resulting an increase in cost and troublesome work. The developing device taught in Laid-Open Publication No. 07-072722 is not practicable without resorting to a sophisticated structure for feeding water to the developing device.

Technologies relating to the present invention are also disclosed in, e.g., Japanese Patent Laid-Open Publication Nos. 2-253272, 5-289494, 6-19293, 6-83153, 6-202458, 9-54494, 9-81018, 10-186815, 10-213947, 11-295986 and 2002-174951.

SUMMARY OF THE INVENTION

It is an object of the present invention to provide an image forming apparatus capable of surely obviating the degradation of image quality by controlling the inside of a developing device to a desired environment.

An image forming apparatus of the present invention includes a photoconductive drum and a developing device for developing a latent image formed on the drum with a developer. The developing device includes a developing roller facing the drum via an opening formed in the casing of the developing device. A feeding device feeds a controlled gas to a position upstream, in the direction of rotation of drum, of a developing position where the developing device operates. A first switching device selectively causes a developer layer deposited on the developing roller to contact the developing zone of the drum in an image formation condition or to part from the developing zone in a stand-by condition. A sealing device maintains, in the image forming condition, a gap between the drum and the casing at a position downstream of the developing zone in the direction of rotation of the drum or seals the gap in the stand-by condition.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Referring to FIGS. 1 through 9, a first embodiment of the present invention is shown and implemented as an electrophotographic color image forming apparatus by way of example. More specifically, the illustrative embodiment is implemented as a color copier including a scanner although it may, of course, be implemented as a facsimile apparatus or a printer. The color image forming apparatus is operable in both of a color mode and a monochrome mode.

Figure 1:
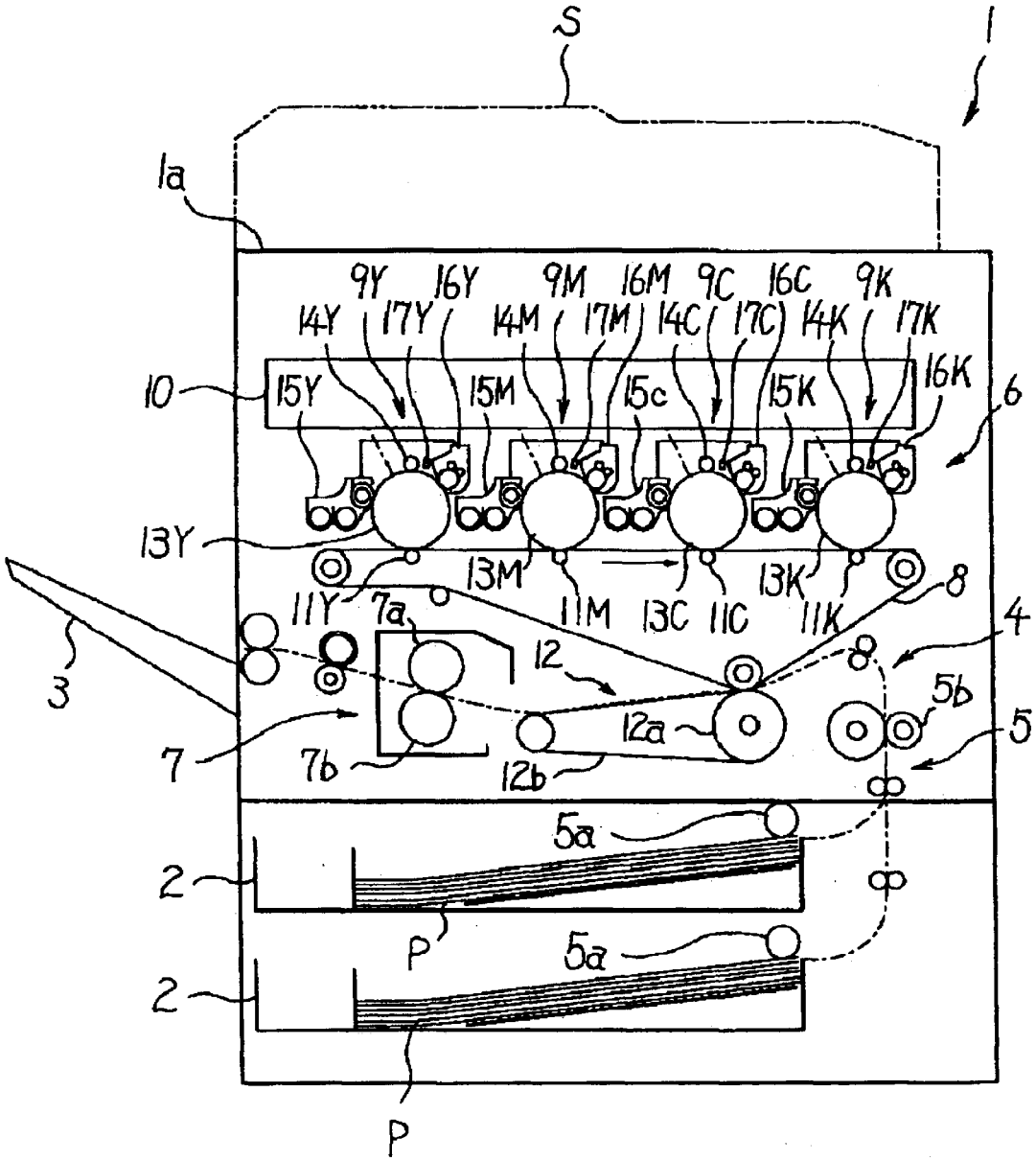
FIG. 1 is a vertical section showing a first embodiment of the image forming apparatus in accordance with the present invention.

The electrophotographic color image forming, apparatus shown in FIG. 1 has a tandem configuration superior in productivity to a revolver type of configuration. Briefly, the image forming apparatus of FIG. 1 includes four image forming units each including a respective photoconductive element for forming an image in one of four different colors, i.e., Y (yellow), M (magenta), C (cyan) and K (black). The resulting Y, M, C and K toner images are transferred to an intermediate image transfer belt one above the other (primary image transfer), completing a full-color image. Subsequently, the full-color image is transferred from the intermediate image transfer belt to a sheet or recording medium (secondary image transfer). The sheet, carrying the full-color image thereon, is routed through a fixing unit to the outside of the apparatus. The toner images are sometimes directly transferred to a sheet without the intermediary of the intermediate image transfer belt.

More specifically, as shown in FIG. 1, the color image forming apparatus, generally 1, includes a casing 1*a* on which a scanner S for reading a document is mounted. A sheet path 4 is arranged inside the casing 1*a* and extends from sheet trays 2 loaded with sheets P to a print tray 3. The sheet trays 2 and print tray 3 constitute a sheet feeding section and a sheet discharging section, respectively. Arranged on the sheet path 4 are a conveying section 5 for conveying the sheet P, an image forming section 6 for forming a color toner image on the sheet P in one or more colors, and a fixing unit 7 for fixing the toner image on the sheet P.

The sheet conveying section 5 includes a plurality of rollers including pickup rollers 5*a* and a roller 5*b*. A motor, not shown, drives such rollers for conveying the sheet P to the image forming section 6 via the sheet path 4.

The image forming section 6 includes an intermediate image transfer belt 8 passed over a plurality of rollers including a drive and a driven roller. Four image forming units 9Y, 9M, 9C and 9K are arranged along the intermediate image transfer belt 8, and each forms a toner image in a particular color on the outer surface of the belt 8. An exposing unit 10 is positioned above the image forming units 9Y through 9K. An image transferring device 12 transfers a toner image thus formed on the belt 8 in one or more colors to the sheet P being conveyed along the sheet path 4.

The fixing unit 7 includes a heat roller 7*a*, accommodating a heater or heat source therein, and a press roller 7*b* pressed against the heat roller 7*a*. The fixing unit 7 fixes the toner image carried on the sheet P with heat and pressure.

The illustrative embodiment uses a forward developing system in which developer carriers, which will be described later, each are rotated in the opposite direction to associated one of photoconductive drums 13Y through 13K, moving a developer in the direction of rotation of the drum 13. It is to be noted that the photoconductive drums 13Y through 13K are a specific form of photoconductive elements or image carriers. Chargers 14Y through 14K uniformly charge the surfaces of the drums 13Y through 13K, respectively. The exposing unit 10 forms a latent image on the charged surface of each of the drums 13Y through 13K in accordance with image data. Developing devices 15Y through 15K each develop the latent image formed on one of the drums 13Y through 13K with toner of a particular color to thereby form a corresponding toner image. Drum cleaners 16Y through 16K remove toners left on the drums 13Y through 13K, respectively, after image transfer effected by intermediate image transferring devices 11Y through 11K. Discharging devices 17Y through 17K respectively remove charges left on the surfaces of the drums 13Y through 13K before the chargers 14Y through 14K charge the drums 13Y through 13K.

The exposing unit 10 includes four LDs (Laser Diodes) assigned to the colors Y through K, respectively, and a polygonal mirror, not shown, for steering laser beams issuing from the LDs toward the drums 13Y through 13K. More specifically, the exposing unit 10 scans the charged surface of each of the drums 13Y through 13K in accordance with image data of a particular color, forming a latent image on the drum.

The intermediate image transferring devices 11Y through 11K are identical in structure with each other, and each includes a respective image transfer roller for transferring a toner image from associated one of the drums 13Y through 13K to the intermediate image transfer belt 8.

The image transferring device 12 includes a belt 12*b* passed over a plurality of rollers including an image transfer roller 12*a*. The toner image formed on the intermediate image transfer belt 8 is transferred to the sheet P, which is conveyed by the image transfer roller 12*a* and belt 12*b*.

Figure 2A:
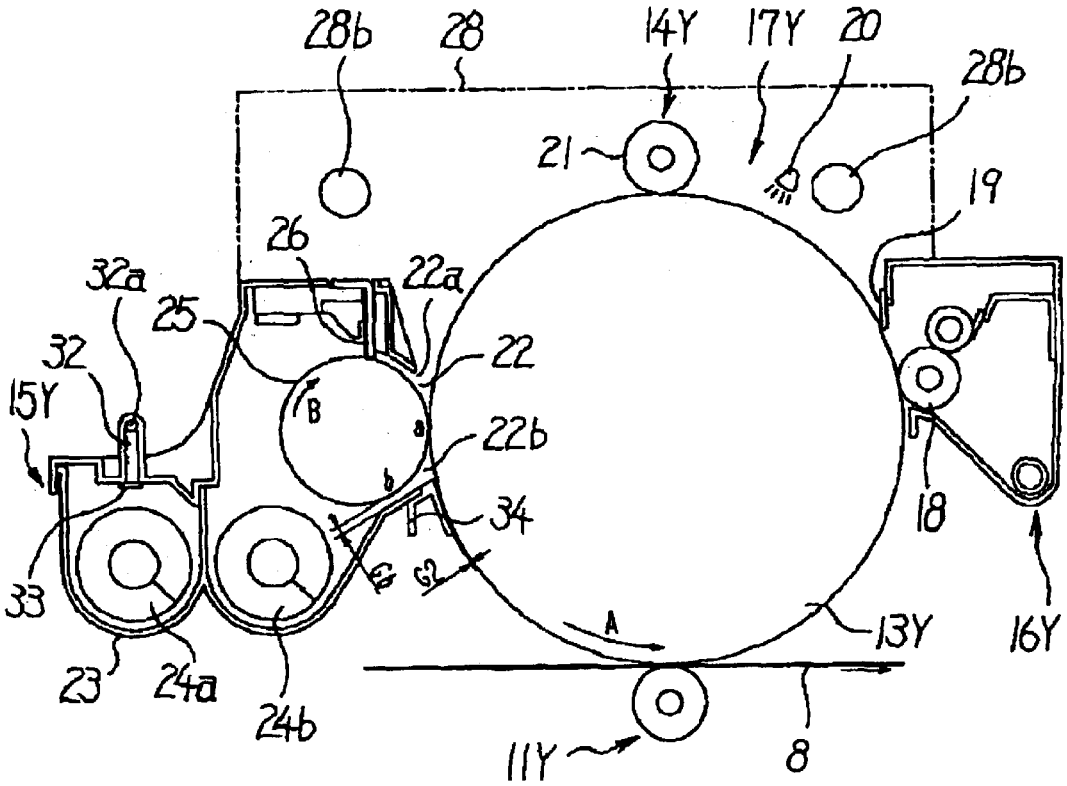
FIG. 2A is a sectional front view showing an image forming unit included in the illustrative embodiment.

Because the image forming units 9Y through 9K are identical in configuration with each other except to the color of toner to use, let the following description concentrate on the developing unit 9Y by way of example. As shown in FIG. 2A, the drum 13Y is supported by bearings, not shown, at opposite ends thereof in such a manner as to be rotatable in a direction indicated by an arrow A. The drum cleaner 16Y, discharging device 17Y, charger 14Y, developing device 15Y and intermediate image transferring device 11Y are sequentially arranged around the drum 13Y in this order, as named from the upstream side in the direction of rotation.

The drum cleaner 16Y includes a cleaning brush 18 for scraping off toner left on the drum 13Y and a cleaning blade 19 held in contact with the drum 13Y for scraping off the toner. The discharging device 17Y includes a quenching lamp 20 for discharging the surface of the drum 13Y. The charger 14Y includes a charge roller 21 for uniformly charging the surface of the drum 13Y.

The developing device 15Y includes a casing 23 formed with an opening 22 facing the drum 13Y. Two screws 24*a* and 24*b* are disposed in the casing 23 for conveying toner to the vicinity of a developing zone while agitating it. A developing roller or developer carrier 25 is disposed in the casing 23 and partly exposed to the outside via the opening 22 so as to feed toner to the latent image formed on the drum 13Y. A doctor blade or metering member 26, implemented by part of the casing 23, regulates the amount of toner to be conveyed by the developing roller 25 to the drum 13Y.

The developing roller 25 is generally made up of a sleeve, not shown, rotatable in a direction indicated by an arrow B in FIG. 2A and a magnet roller, not shown, held stationary inside the sleeve. A plurality of magnetic poles are arranged on the magnet roller in the circumferential direction. A two-ingredient type of developer, i.e., a toner and carrier mixture is deposited on the sleeve and caused to form a magnet brush by the magnet roller. The toner of the developer is transferred from the sleeve to the latent image formed on the drum 13Y, thereby producing a corresponding toner image. The opening 22 has an upstream edge 22*a* and a downstream edge 22*b* in the direction of rotation of the developing roller 25.

Part of the surface of the drum 13Y and charger 14Y, lying in a range from the position where the cleaning blade 19 contacts the drum 13Y to the opening 22 in the direction of rotation of the drum 13Y, are enclosed by an air conditioning box 28. The air conditioning box 28 is fluidity communicated to the opening 22 as well so as to form a path along which a controlled gas flows.

The air conditioning box 28 is formed with two inlet ports 28*a* (see FIG. 3) and two outlet ports 28*b*. A controlled gas, which is a gas whose temperature and humidity are confined in preselected ranges by an air conditioner 29 in the illustrative embodiment, is fed to the inlet ports 28*a* via a tube 30. A tube 31 is connected to the outlet ports 28*b* and extends to the outside of the casing 1*a* of the apparatus 1. The air conditioner 29 plays the role of feeding means for feeding the controlled gas to part of the surface of the drum 13 positioned upstream side with respect to the direction of rotation of the developing roller 25 (air conditioning box 28).

A slit-like window 27 (see FIG. 3) is formed in the air conditioning box 28, so that a laser beam issuing from the exposing unit 10 can be incident to the surface of the drum 13Y. The window 27 is implemented by a transparent plate formed of, e.g., glass or resin. An exhaust passage or duct 32, extending upward, is connected to the casing 23 of the developing device 15Y while an opening 32*a* is formed in the top of the exhaust passage 32. A filter 33 is fitted on the casing 23 to cover the exhaust passage 32. The opening 32*a* is open in the direction in which the controlled gas fed from the air conditioner 29 flows.

Assume that the center of the opening 22 closest to the developing zone of the drum 13Y is located at a position a, and that the gap between the inner surface of the casing 23 and the developing roller 25 in a developer collecting zone is minimum at a position b. Magnetic forces, exerted by the magnetic poles of the stationary magnet roller in the normal direction, are distributed as indicated by solid lines in FIG. 2B. The magnetic pole, corresponding to the position a, is generally referred to as a pole P1 and relates to the formation of a magnet brush. The magnetic pole, corresponding to the position b, is generally referred to as a pole P2 and serves to collect the developer into the casing 23. The poles P1 and P2 each are formed such that the magnet brush fills a gap along the magnetic lines of force; the magnet brush formed by the pole P2 is lower in height than the magnet brush formed by the pole P1.

Figure 2B:
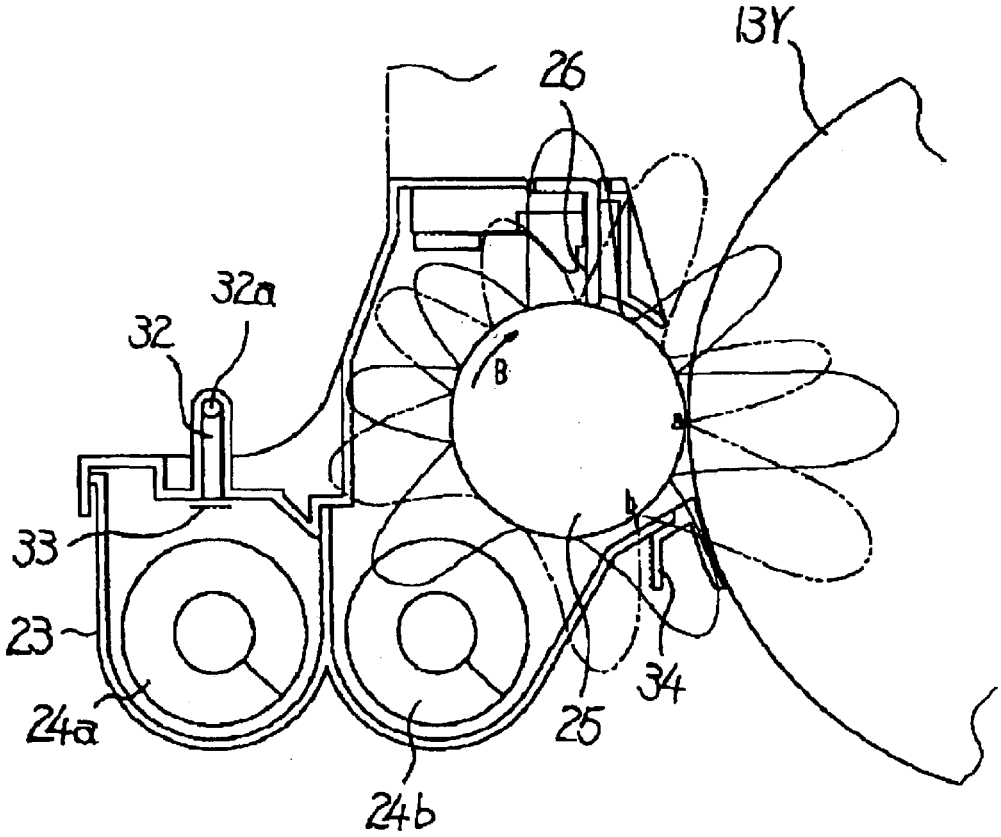
FIG. 2B is an enlarged, sectional front view showing part of the image forming unit.
Figure 3:
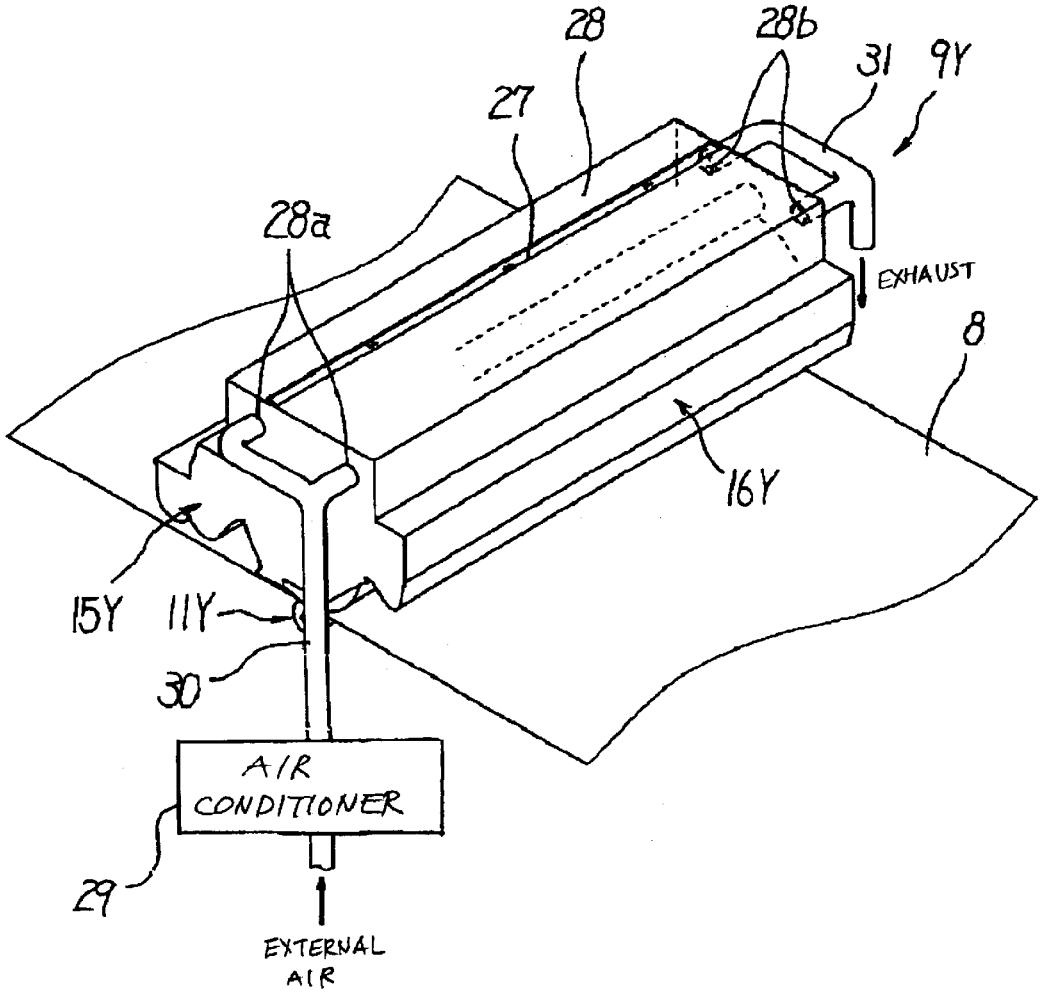
FIG. 3 is a perspective view showing the image forming unit.

During development, the sleeve is rotated clockwise, as viewed in FIG. 2B, relative to the magnet roller to thereby convey the developer deposited thereon. When image formation is not under way, the sleeve remains in a halt while the magnet roller is rotated clockwise only by a preselected angle, as will be described more specifically later. As a result, the magnetic force distributions vary as indicated by phantom lines in FIG. 2B, so that the magnetic forces in the normal direction become minimum at the positions a and b.

As shown in FIG. 2A, the casing 23 has a movable member 34 at the downstream edge 22*b* of the opening 22. The movable member 34 is freely rotatably supported together with a shaft 35 (see FIG. 4) in such a manner as to maintain, in an image forming condition, a gap G2 between the surface of the drum 13 and the casing 23 at the downstream region in the direction of rotation of the developing roller 25. When image formation is not under way, i.e., in a stand-by condition, the movable member 34 seals the gap G2 between the drum 13 and the casing 23. The gap G2 is so selected as to prevent air around the drum 13 from entering the casing 23 and prevent toner scattered around the developing zone, i.e., opening 22 from flowing out of the casing 23. An arrangement for causing the movable member 34 to seal the gap G2 by rotating it counterclockwise together with the shaft 35 will be described in detail later.

Figure 4:
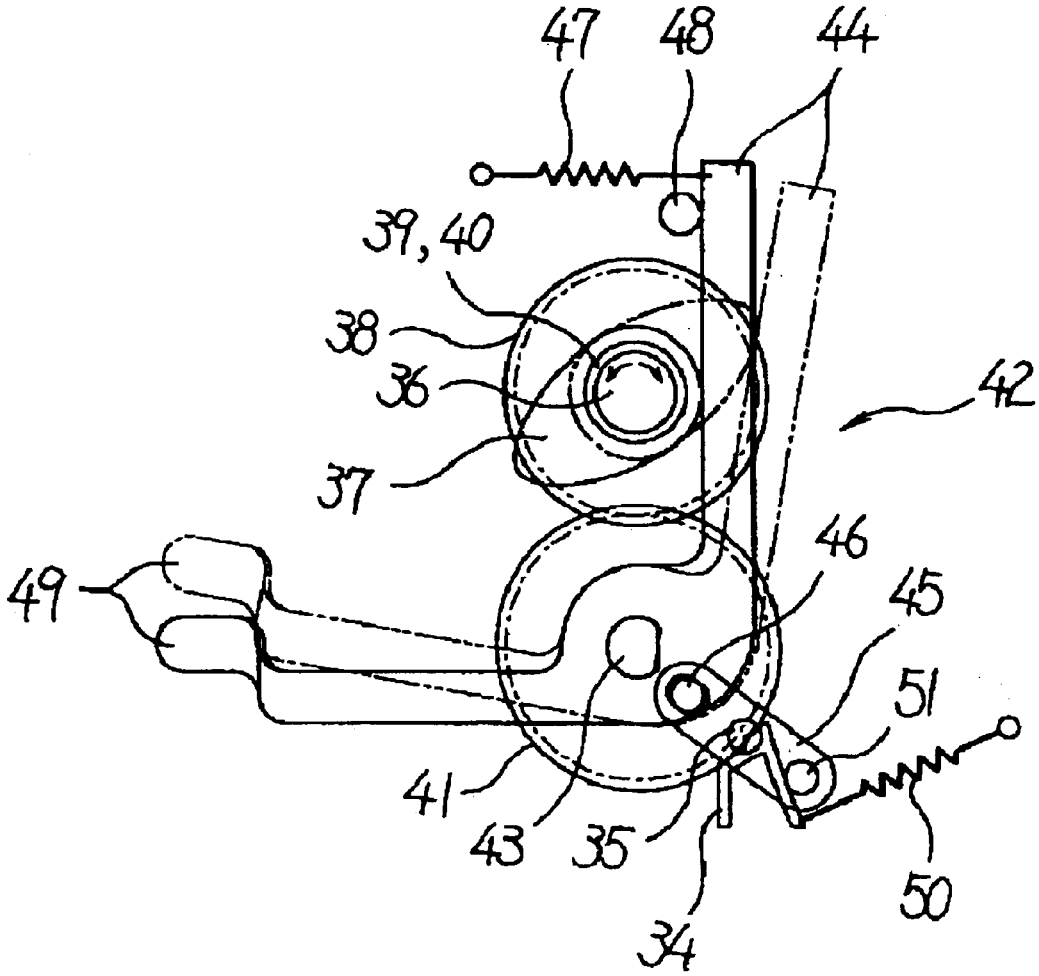
FIG. 4 demonstrates the operations of developing zone switching means, collecting zone switching means and sealing means included in the illustrative embodiment.

Reference will be made to. FIG. 4 for describing drive structures for the sleeve and magnet roller of the developing roller 25 and a drive structure for the movable member 34. As shown, the developing device 15Y includes a drive shaft 36 for driving the sleeve and connected to a reversible motor not shown. Mounted coaxially with the drive shaft 36 are an eccentric cam 37, a drive gear 38, a one-way clutch 39 configured to transfer only the clockwise torque of the drive shaft 36 to the eccentric cam 37, and a one-way clutch 40 configured to transfer only the counterclockwise torque of the drive shaft 36 to the drive gear 38. The drive gear 38 is held in mesh with a sleeve gear 41 mounted on one end of the sleeve. In this configuration, when the drive shaft 36 is rotated counterclockwise, it causes the sleeve to rotate clockwise. The one-way clutches 39 and 40, used to selectively connect the drive shaft 36 to the eccentric cam 37 or the drive gear 38, may be replaced with a single clutch so long as it can effect the selective connection.

A transmitting mechanism 42 transmits the clockwise torque of the eccentric cam 37 to the magnet roller of the developing roller 25 and movable member 34. The transmitting mechanism 42 includes a magnet shaft 43 rotatable integrally with the magnet roller, a generally L-shaped arm 44 angularly movable integrally with the magnet shaft 43, and a link 45 angularly movable integrally with the shaft 35 of the movable member 34. One end of the link 45 is connected to the arm 44 by a pin 46. The arm 44 is constantly biased counterclockwise, as viewed in FIG. 4, by a spring 47 and stopped by a stop shaft 48. A shutter 49 for closing the opening 32*a* (see FIG. 5) of the exhaust passage 32 is formed integrally with one end of the arm 44.

While the movable member 34 is so configured as to seal the gap between the casing 23 and the drum 13 under the action of the spring 50, a stop shaft 51 mounted on the link 45 limits the movement of the movable member 34. The movable member 34 extends in the axial direction of the drum 13. Therefore, to maintain the movable member 34 parallel to the drum 13, it is preferable to locate a pair of links 45 at opposite ends of the movable member 34, interlock the links 45 via the shaft 35, and cause the stop shafts 51 of the links 45 to abut against the opposite ends of the movable member 34.

Figure 5:
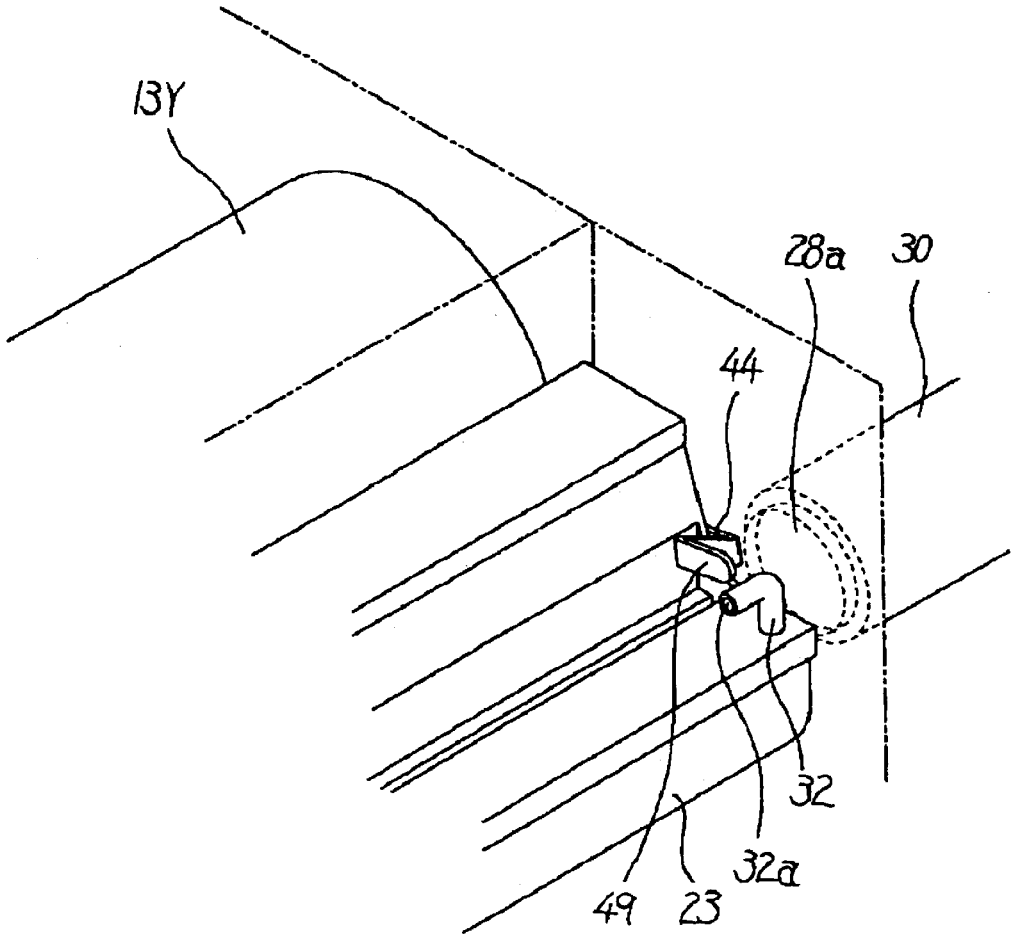
FIG. 5 shows a positional relation between an exhaust passage formed in the casing of a developing device included in the illustrative embodiment and a shutter.

FIG. 5 shows a relation between the exhaust passage 32 of the casing 23 and the shutter 49. As shown, the opening 32*a* of the exhaust passage 32 is fluidly communicated to the tube 30 via the inlet port 28*a* such that the opening 32*a* is positioned at the upstream side of the path along which the controlled gas output from the air conditioner 29 flows.

Figure 6:
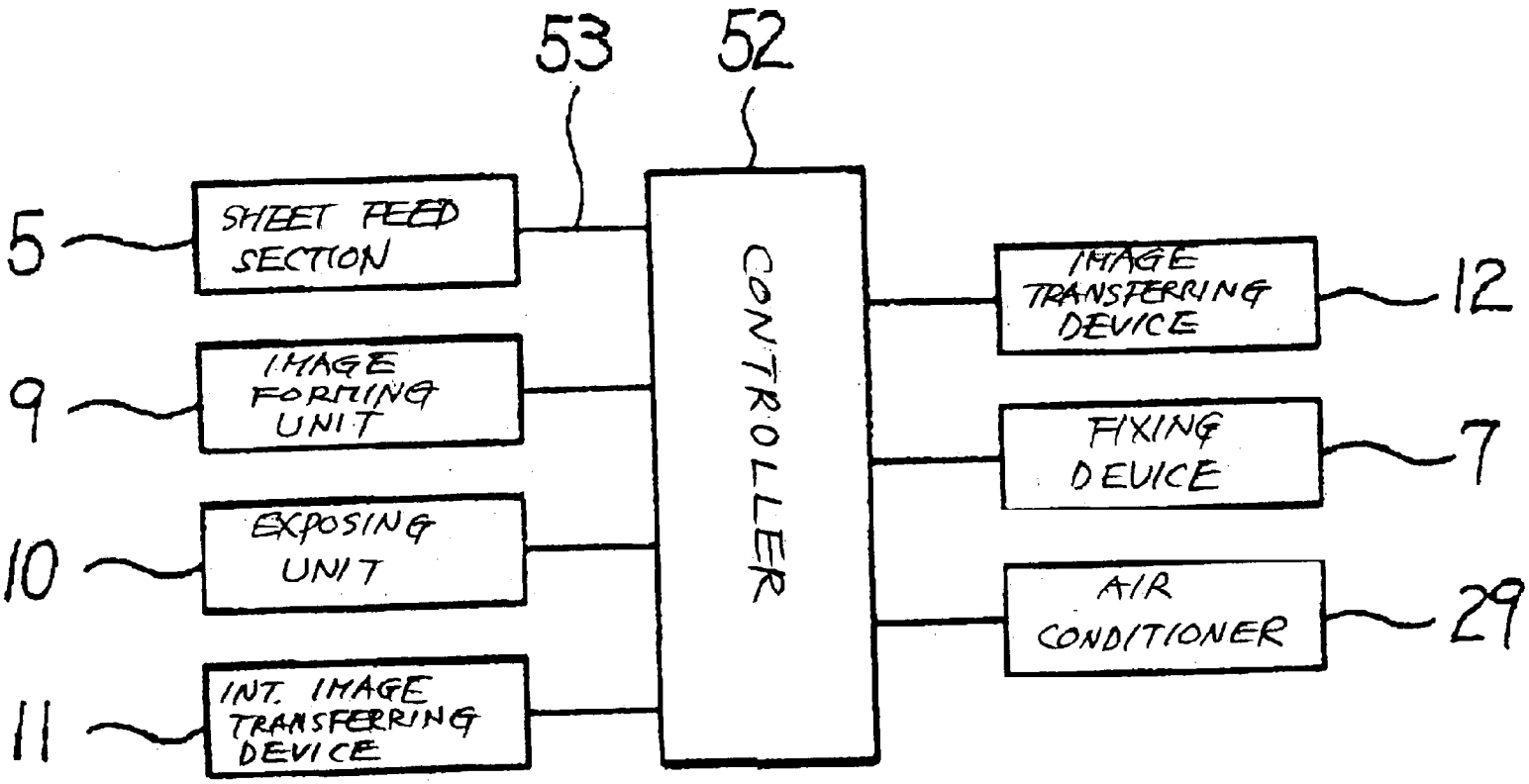
FIG. 6 is a schematic block diagram showing a control system included in the illustrative embodiment.

FIG. 6 shows a control system included in the illustrative embodiment. As shown, the control system includes a controller 52 including a CPU (Central Processing Unit), a ROM (Read Only Memory) storing various fixed data including control programs, and a RAM (Random Access Memory) playing the role of a work area, although not shown specifically. The conveying section 5, image forming units 9, exposing unit 10, intermediate image transferring devices 11, image transferring device 12, fixing unit 7 and air conditioner 29 are connected to the controller 52 via bus lines 53.

Figure 9:
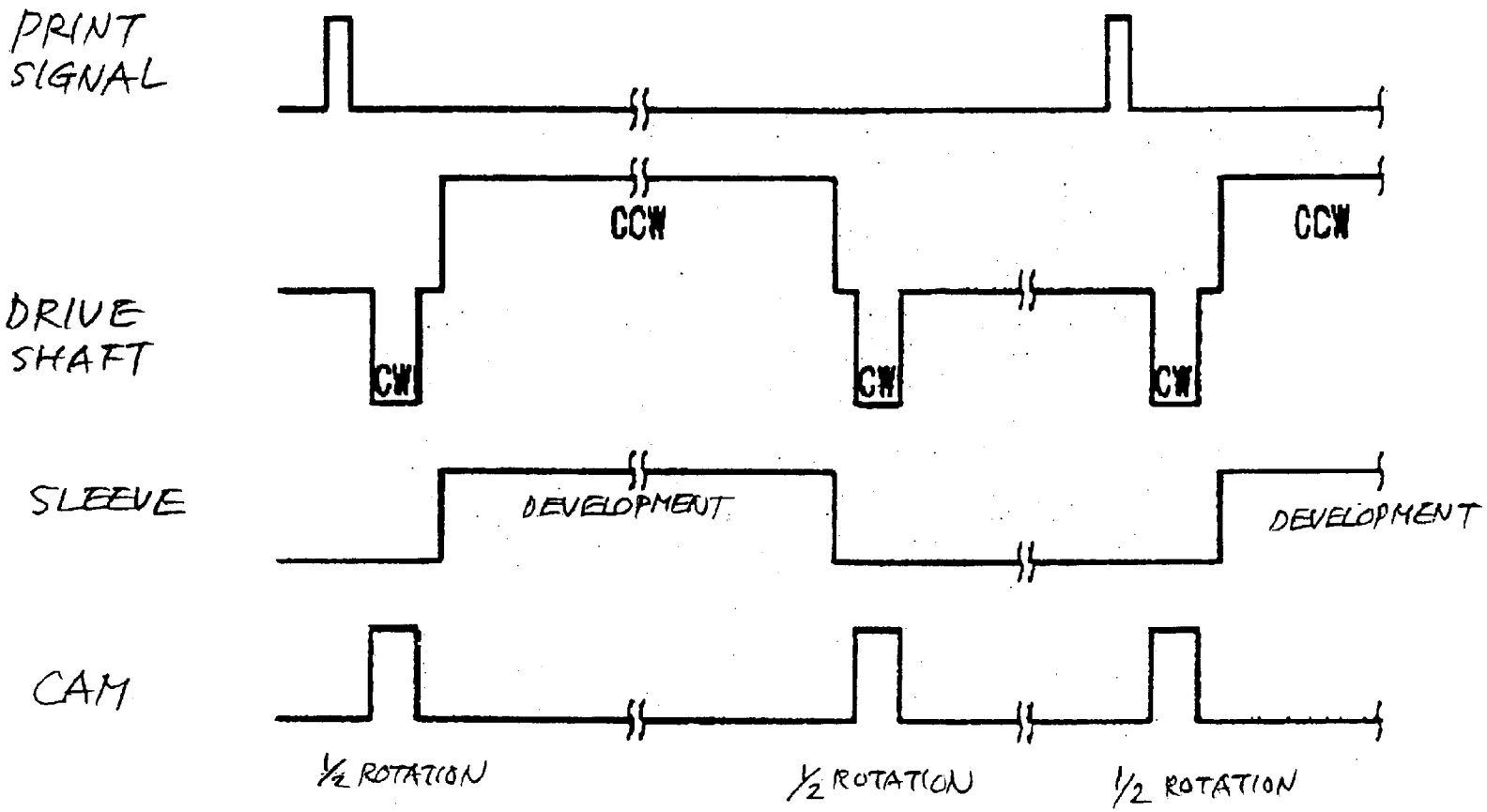
FIG. 9 is a timing chart showing the drive of a drive shaft effect in the stand-by condition.

As shown in FIG. 9, the controller 52 executes a sequence of steps of rotating, within a stand-by period after the output of a print signal, the drive shaft 36, FIG. 4, clockwise (CW) by half a rotation, rotating the drive shaft 36 counterclockwise (CCW) over a period of time necessary for development, and again rotating the drive shaft 36 clockwise by half a rotation. When the drive shaft 36 is rotated clockwise, the eccentric cam 37 is rotated by half a rotation. When the drive shaft 36 is rotated counterclockwise, the sleeve of the developing roller 25 is rotated for development.

Figure 7B:
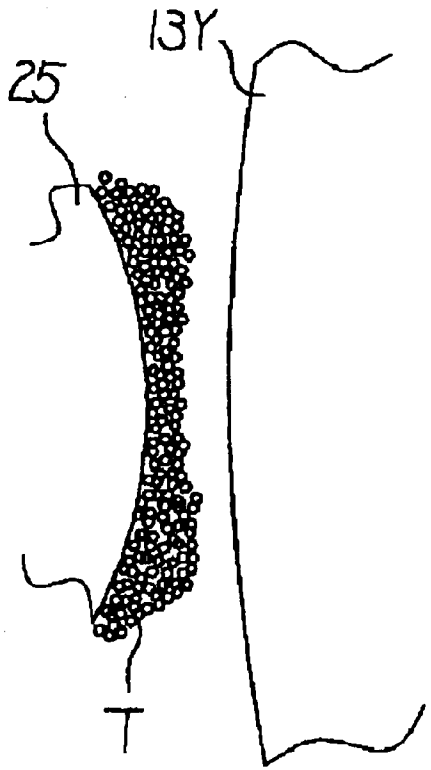
FIGS. 7A and 7B demonstrate how a developer layer varies in the developing zone of a photoconductive drum in the illustrative embodiment.
Figure 7A:
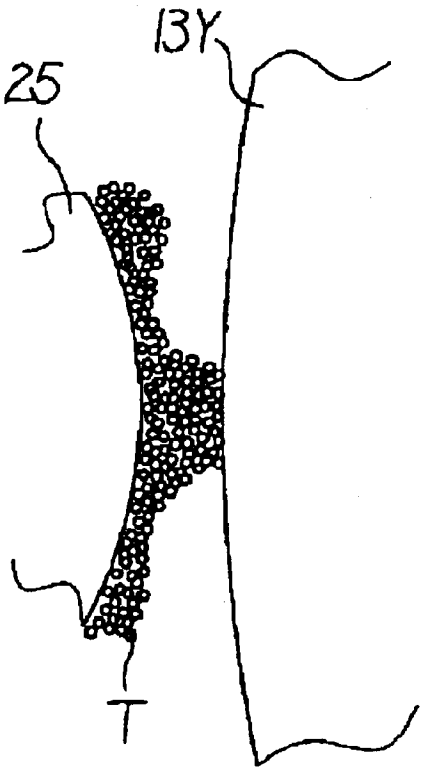

The operation of the transmitting mechanism 42, FIG. 4, will be described with reference to FIG. 9. When the drive shaft 36 is rotated clockwise by half a rotation in the stand-by period after the output of a print signal, the torque of the drive shaft 36 is transferred to the eccentric cam 37 via the one-way clutch 39. The eccentric cam 37 is therefore rotated by half a rotation and causes the arm 44 to angularly move to a phantom line position together with the magnet shaft 43 against the action of the spring 47. Because the magnet shaft 43 rotates together with the magnet roller by a preselected angle, the magnetic forces, corresponding to the positions a and b in the developer collecting zone, become minimum, reducing the height of the magnet brush. As a result, as shown in FIG. 7B, the developer layer on the developing roller 25 is brought out of contact with the developing zone of the drum 13. At the same time, the developer on the developing roller 25 is brought out of contact with the inner surface of the casing 23. In FIGS. 7A and 7B, the developer is represented by toner grains T.

Figure 8:
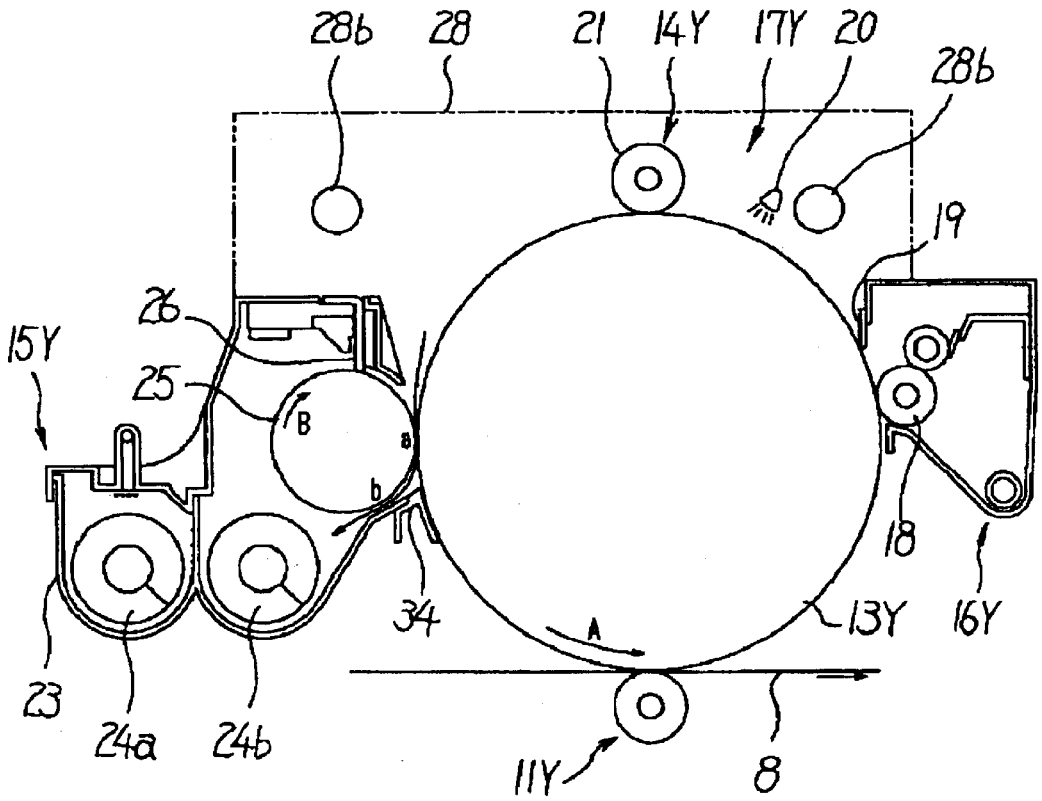
FIG. 8 is a sectional front view showing the image forming unit in a stand-by condition.

When the arm 44 is angularly moved clockwise, as stated above, the link 45 is moved counterclockwise together with the shaft 35, reducing the pressure of the stop shaft 51 acting on the movable member 34. Consequently, the movable member 34 is rotated by the spring 50 to thereby seal the gap between the casing 23 and the drum 13. Also, the shutter 49 of the arm 44 opens the opening 32*a* of the exhaust passage 32*a*. At this instant, the flow of the controlled gas output from the air conditioner 29 generates vacuum in the opening 32*a*, so that air inside the casing 23 is exhausted via the opening 32*a*. Consequently, as shown in FIG. 8, the controlled gas flows into the casing 23 via the opening 22. The controlled gas can rapidly enter the casing 23 because the developer layer at the position b is spaced from the inner surface of the casing 23. Further, the movable member 34, sealing the gap between the casing 23 and the drum 13, prevents the toner from flying out of the casing 23.

When the drive shaft 36 is rotated counterclockwise on the elapse of the stand-by period, the arm 44 returns together with the link 45 under the action of the spring 47 until the arm 44 abuts against the stop shaft 48, as indicated by a solid line in FIG. 4. The eccentric cam 37 also returns in the counterclockwise direction together with the arm 44. Consequently, the magnet shaft 43 is again rotated counterclockwise by the preselected angle together with the magnet roller. As a result, as shown in FIG. 7A, the developer on the developing roller 25 is again brought into contact with the developing zone of the drum 13 and the inner surface of the casing 23. At the same time, the link 45 is moved clockwise together with the shaft 35, intensifying the pressure of the stop shaft 51 acting on the movable member 34. The movable member 34 is therefore rotated by the spring 50 to maintain the gap G2. Further, the shutter 49 again closes the opening 32*a* of the exhaust passage 32, interrupting depressurization in the casing 23.

As stated above, as shown in FIG. 7A, during development the developer, including magnetic carrier grains, forms a magnet brush in the radial direction along the magnetic lines of force formed by the magnet. The magnet brush is curved in the circumferential direction between nearby magnetic poles. Although the thickness of the developer layer is maintained constant by the doctor blade 26 or similar metering member, the amount of the developer differs in the circumferential direction because the magnetic force varies when the developer layer is being conveyed on the sleeve. This is derived from the fact that the amount of the developer for a unit area is larger at the magnetic pole than between nearby magnetic poles. Also, in the developing zone at the position a, the gap Gp between the developing roller 25 and the drum 13 is generally small, so that the developer remains dense. Therefore, so long as the sleeve is held stationary in the above condition, the controlled gas flows little between the upper and lower portions of the gap Gp.

Although the above relation applies to the position b also, the gas relatively easily flows between the inside and the outside of the casing 23 because the gap Gb between the inner surface of the casing 23 and the developing roller 25 is larger than the gap Gp and because the magnetic force in the normal direction is relatively weak.

As stated above, the illustrative embodiment includes first switching means for selectively causing the developer on the developing roller 25 to contact or part from the developing zone of the drum 13 (developing zone switching means hereinafter) and second switching means for selectively causing the developer on the roller 25 to contact or part from the inner surface of the casing 23 in the developer collecting zone (collecting zone switching means hereinafter). To implement the two switching means, the illustrative embodiment causes the magnet roller of the developing roller 25 to rotate by use of the rotation of the drive shaft 36. Likewise, to implement sealing means that selectively maintains the gap between the drum 13 and the casing 23 at the position downstream of the developing zone in the direction of rotation of the drum 13 or seals it in the stand-by condition, the illustrative embodiment causes the movable member 34 to angularly move by use of the rotation of the drive shaft 36. In the stand-by condition, vacuum is generated in the opening 32*a* of the exhaust passage 32 by depressurizing means, i.e., the flow of the controlled gas output from the air conditioner 29, thereby allowing the controlled gas to enter the casing 23. At the time of image formation, depressurization interrupting means causes the depressurizing means to stop operating and is implemented by the shutter 49 of the movable member 44, which is also driven by the rotation of the drive shaft 36.

In the illustrative embodiment, the casing 23 is exhausted via the opening 32*a* of the exhaust path 32 on the basis of the stream of the controlled gas output from the air conditioner 29. This obviates the need for a special device for depressurizing the casing 23 and therefore simplifies the structure without increasing cost. The opening 32*a* is positioned at the upstream side of the path along which the controlled gas flows from the air conditioner 29, i.e., at the position where the initial velocity of the gas and therefore vacuum is high. Therefore, pressure inside the casing 23 can be rapidly lowered.

Second Embodiment

Figure 10:
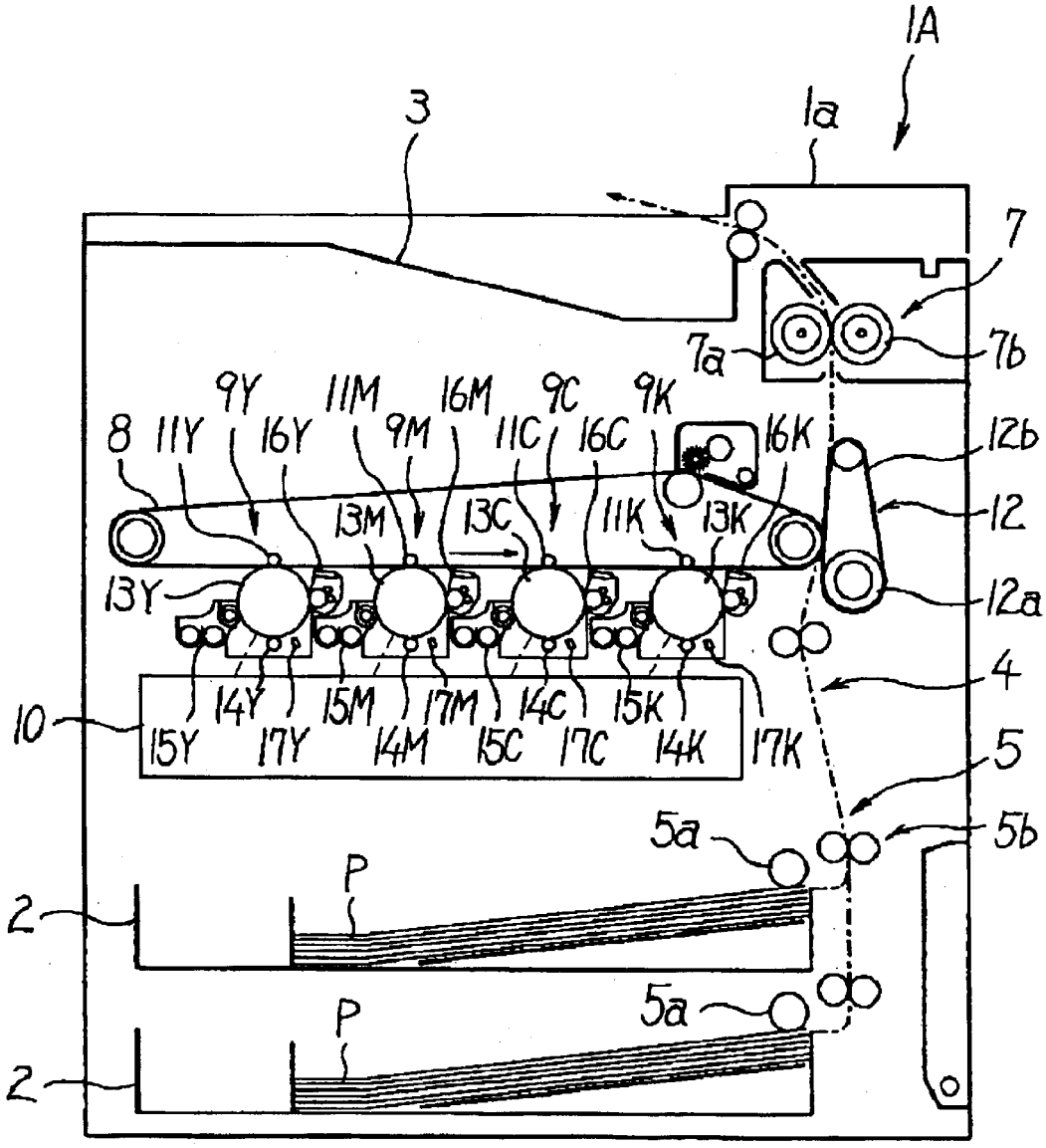
FIG. 10 is a sectional front view showing a second embodiment of the present invention.

A second embodiment of the present invention will be described with reference to FIGS. 10 and 11. In the illustrative embodiment, as well as in the other embodiments to follow, parts and elements identical with the parts and elements of the first embodiment are designated by identical reference numerals and will not be described specifically in order to avoid redundancy.

The illustrative embodiment is implemented as a tandem laser printer. As shown in FIG. 10, the illustrative embodiment differs from the first embodiment in that the sheet path 4*f* extends substantially vertically upward, in that the image forming units 9Y through 9K and exposing unit 10 are arranged below the intermediate image transfer belt 8, and in that the developing roller 25 and drum 13 of each image forming unit 9 are rotated in the same direction as each other.

Again, let the following description concentrate on the developing unit 9Y by way of example. As shown in FIG. 11, the illustrative embodiment uses a reverse developing system in which the drum 13Y, rotatable in a direction E, and developing roller 25 are rotated in the same direction as each other. The drum cleaner 16Y, discharging device 17Y, charger 14Y, developing device 15Y and intermediate image transferring device 11Y are sequentially arranged around the drum 13Y in this order, as named from the upstream side in the direction of rotation.

Part of the surface of the drum 13Y and charger 14Y, lying in the range from the position where the cleaning blade 19 contacts the drum 13Y to the opening 22 in the direction of rotation of the drum 13Y, are enclosed by the air conditioning box 28. The air conditioning box 28 is fluidity communicated to the opening 22. The air conditioning box 28 is formed with two inlet ports 28*a* and two outlet ports 28*b*. The air conditioner 29 is fluidly communicated to the two inlet ports 28*a* by the tube 30.

Figure 11:
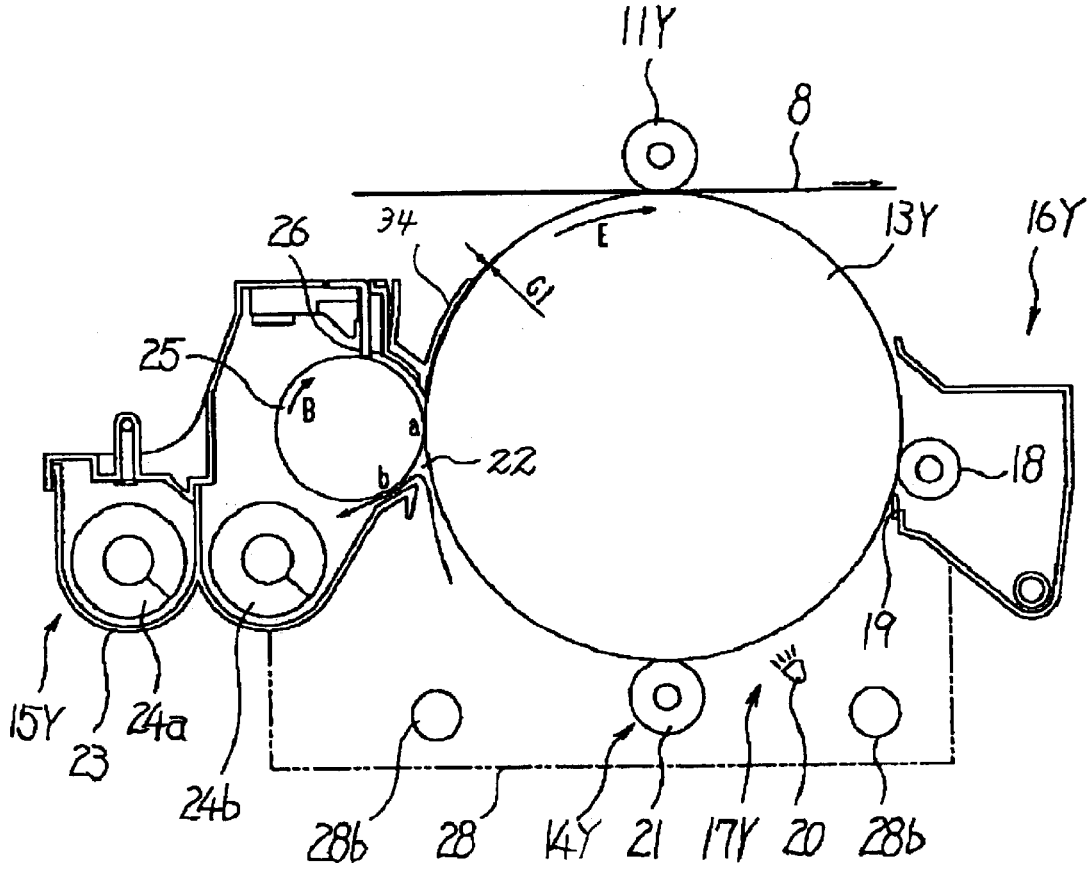
FIG. 11 is a sectional front view showing an image forming unit included in the second embodiment.
Figure 12:
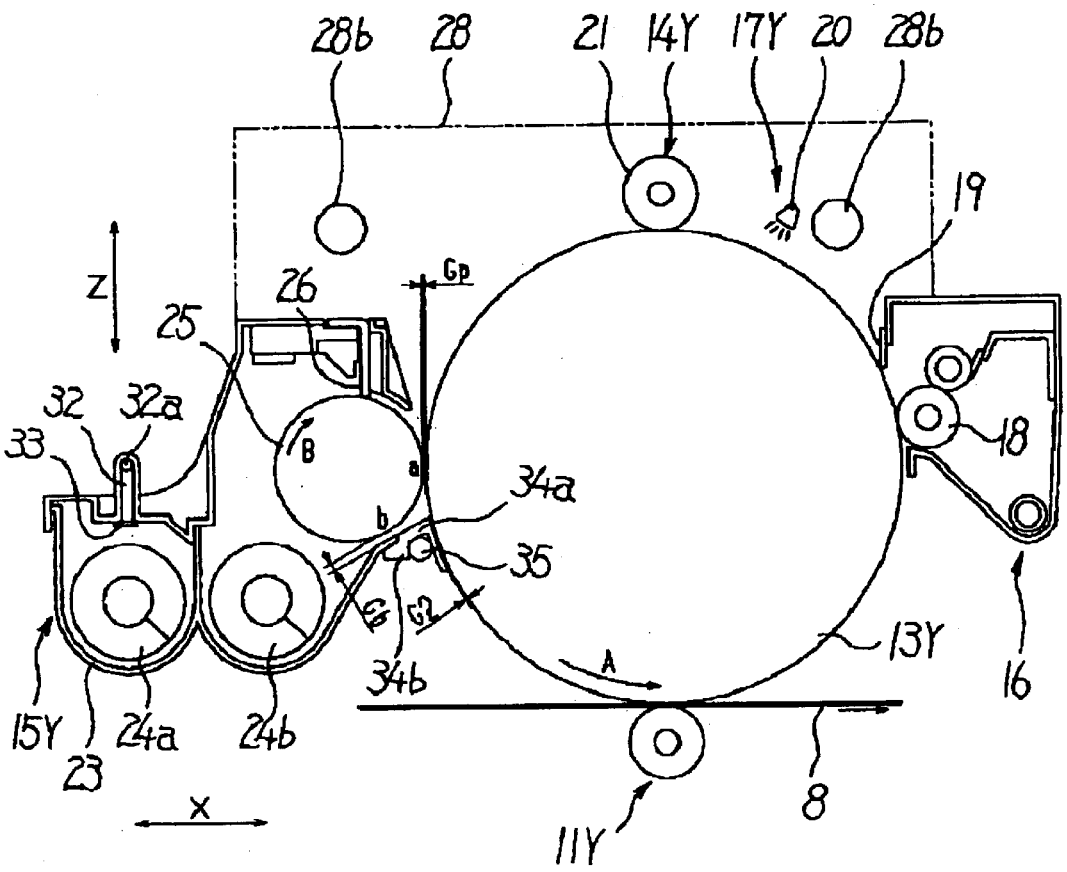
FIG. 12 is a sectional front view showing a third embodiment of the present invention.

As shown in FIG. 11, in the case of the reverse developing system, the controlled gas upstream of the developing zone, i.e., position a in the direction of rotation of the drum 13 can be effectively introduced into the casing 23 if the inside of the casing 23 is depressurized. For this purpose, the gas in a portion below the casing 23 should be introduced into the opening 22; it is not desirable to introduce the gas in an upper portion because such a gas is not controlled. It follows that the developer layer on the developing roller 25 does not have to be selectively brought into or out of contact with the developing zone of the drum 13. That is, a gap G1 between the drum 13 and the casing 23 should only be sealed at a position above the opening 22, which is the downstream side in the direction of rotation of the drum 13.

In the illustrative embodiment, the sealing means can be implemented if the movable member 34 is positioned above the opening 22 in such a manner as to selectively seal the gap G1. To angularly move the movable member 34, the shaft 35, FIG. 4 may be driven by a rotary solenoid or similar drive source as in the previous embodiment.

Third Embodiment

Reference will be made to FIGS. 12 and 13A through 13C for describing a third embodiment of the present invention. In the illustrative embodiment, the casing 23 is freely movable in a direction perpendicular to the axis of the drum 13, e.g., in a direction X or Z or the composite direction of the directions X and Z and can be locked at any desired position. In this sense, in the illustrative embodiment, the developing zone switching means is implemented by moving the casing 23 in the above direction to thereby adjust the gap between the drum 13 and the developing roller 25.

Figure 13A:
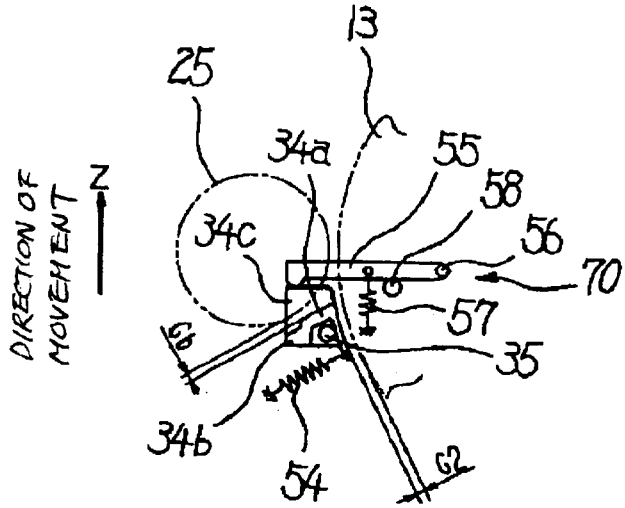
FIGS. 13A through 13C demonstrate the operations of collecting zone switching means and sealing means included in the third embodiment.
Figure 13B:
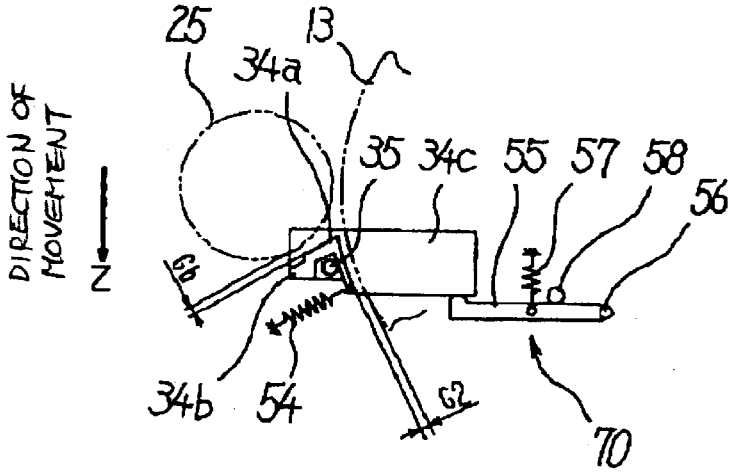
Figure 13C:
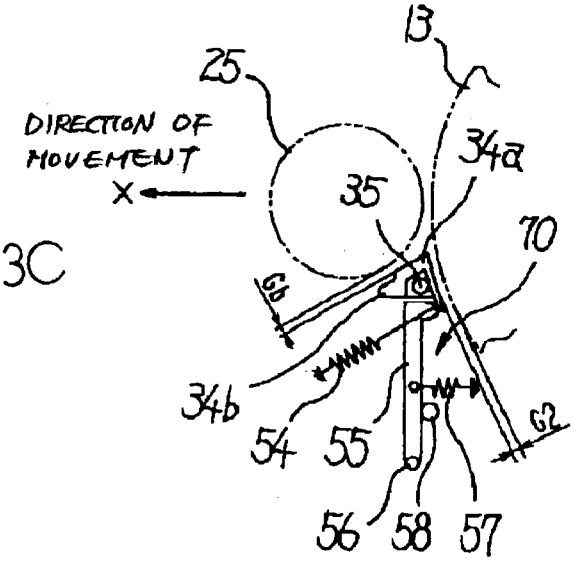

On the other hand, the collecting zone switching means and sealing means share a movable member 34*a* and an interlocking mechanism 70 (see FIGS. 13A through 13C). The movable member 34*a* is mounted on the casing 23 in such a manner as to be freely movable in the direction in which the gap between the developing roller 25 and the drum 13 varies, and capable of being locked at any desired position. The interlocking mechanism 70 causes the movable member 34*a* to move in interlocked relation to the movement of the casing 23 relative to the drum 13. The movable member 34*a* is angularly movable about the shaft 35 and can be locked at any desired position.

The collecting zone switching means is implemented by moving the movable member 34*a* about the shaft 35 to thereby adjust the gap Gb between the developing roller 25 and the inner surface of the casing 23 at the position b. In the illustrative embodiment, part of the movable member 34*a* constitutes the inner surface of the casing 23.

As for the sealing means for maintaining, during image formation, the gap G2 between the drum 13 and the casing 23 at a position downstream of the developing zone in the direction of rotation of the drum 13, but sealing the gap G2 in the stand-by condition, the movable member 34*a* is moved to adjust the gap G2 in the same manner as described in relation to the collecting zone switching means.

In the illustrative embodiment, to adjust the gaps Gb and G2, the interlocking mechanism 70 is interlocked to the displacement of the casing 23 effected to adjust the gap Gp. Specific constructions and operations of the interlocking mechanism will be described with reference to FIGS. 13A through 13C hereinafter.

In the specific configuration shown in FIG. 13A, while a spring 54 constantly biases the movable member 34*a* clockwise away from the drum 13, a stop 34*b* is formed integrally with the movable member 34*a* and limits, on abutting against part of the underside of the casing 23 (see FIG. 12) , the maximum gap between the drum 13 and the casing 13 to G2. Also, an opening member 34*c* is formed integrally with the movable member 34*a* at each of opposite ends in the lengthwise direction. A pressing member 55 faces the top of each of such opening members 34*c* and is angularly movable about a shaft 56. The pressing member 55 is constantly biased downward by a spring 57, but the movement is limited by a stop shaft 58. The force of the spring 57 is selected to be stronger than the force of the spring 54.

In the above configuration, when the stop 34*b* is held in contact with the casing 23, the movable member 34*a* is free from the pressure of the pressing member 55 and maintains the gap G2 between the developing roller 25 and the inner surface of the casing 23, i.e., the movable member 34*a*.

In the stand-by condition, when the casing 23 is moved upward in the direction Z, the gap Gp between the developing roller 25 and the drum 13 increases, allowing the controlled air to enter the casing 23 via the opening 22. At this instant, the opening member 34*c* is pressed downward by the pressing member 55, so that the movable member 34*a* moves counterclockwise about the shaft 35 to thereby seal the gap G2 between the drum 13 and the casing 13. At the same time, the gap Gb between the developing roller 25 and the inner surface of the casing 23, i.e., the movable member 34*a* noticeably varies, allowing the controlled gas to rapidly enter the casing 23 via the opening 22.

FIGS. 13B and 13C show other specific configurations for adjusting the gaps Gb and G2 in interlocked relation to the displacement of the casing 23 effected to adjust the gap Gp. The configurations of FIGS. 13B and 13C are identical with the configuration of FIG. 13A except for the direction of displacement of the casing 23 and the direction in which the pressing member 55 presses the movable member 34*a*.

In FIG. 13B, each pressing member 55, movable about the shaft 56, faces the bottom of the associated opening member 34*c*. The pressing member 55 is constantly biased upward by the spring 57, but the movement is limited by the stop 58. When the stop 34*b* is held in contact with the casing 23, the movable member 34*a* is free from the pressure of the pressing member 55 and maintains the gap G2 between the drum 13 and the casing 23. At the same time, the gap Gb between the developing roller 25 and the inner surface of the casing 23, i.e., the movable member 34*a* is maintained small.

In the stand-by condition, when the casing 23 is moved from the above position downward in the direction Z, the gap Gp between the developing roller 25 and the drum 13 increases and allows the controlled air to enter the casing 23 via the opening 22. At this instant, the opening member 34*c* is pressed upward by the pressing member 55 with the result that the movable member 34*a* angularly moves counterclockwise about the shaft 35. Consequently, the gap G2 between the drum 13 and the casing 23 is sealed. At the same time, the gap Gb between the developing roller 25 and the inner surface of the casing 23, i.e., the movable member 34*a* noticeably varies, allowing the controlled gas to be rapidly introduced into the casing 23.

In FIG. 13C, the pressing member 55 is so located to press the movable member 34*a* toward the drum 13 at a position below the shaft 35. The pressing member 55 is constantly biased toward the drum 13 by the spring 57, but the movement is limited by the stop shaft 58. When the stop 34*b* is held in contact with the casing 23, the movable member 34*a* is free from the pressure of the pressing member 55 and maintains the gap G2 between the drum 13 and the casing 23. At the same time, the gap Gb between the developing roller 25 and the inner surface of the casing 23, i.e., the movable member 34*a* is maintained small.

In the stand-by condition, when the casing 23 is moved from the above position leftward in the direction X, the gap Gp between the developing roller 25 and the drum 13 increases and allows the controlled air to enter the casing 23 via the opening 22. At this instant, the opening member 34*c* is pressed by the pressing member 55 with the result that the movable member 34*a* angularly moves counterclockwise about the shaft 35. Consequently, the gap G2 between the drum 13 and the casing 23 is sealed. At the same time, the gap Gb between the developing roller 25 and the inner surface of the casing 23, i.e., the movable member 34*a* noticeably varies, allowing the controlled gas to be rapidly introduced into the casing 23.

It is to be noted that the casing 23 may not be linearly displaced, as shown and described, but may be displaced in the direction of an arc so long as it is perpendicular to the axis of the drum 13.

Fourth Embodiment

Figure 14:
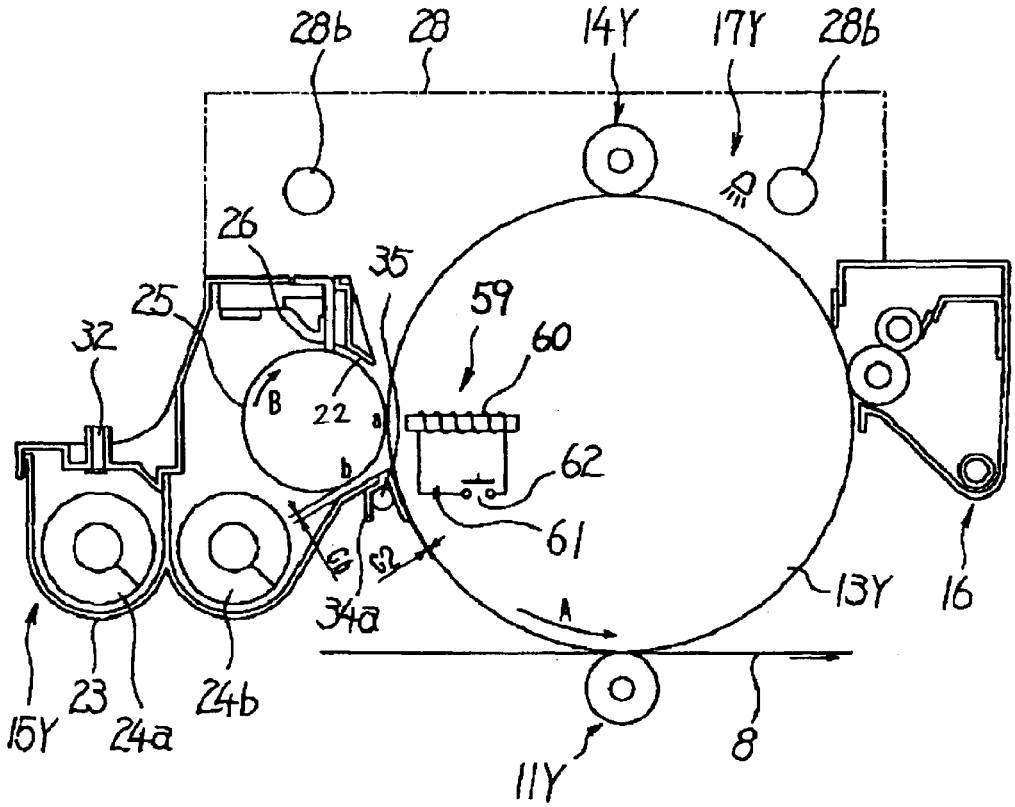
FIG. 14 is a sectional front view showing a fourth embodiment of the present invention.

FIG. 14 shows a fourth embodiment of the present invention. In the illustrative embodiment, the developing roller is made up of a sleeve and a magnet roller having a plurality of magnetic poles positioned at equally spaced locations in the circumferential direction. As shown, the developing zone switching means includes magnetic force generating means 59 buried in the drum 13 for selectively generating magnetic lines of force of the same polarity as the pole of the developing roller 25. The magnetic force generating means comprises a series connection of a coil 60, a battery 61 and a switch 62.

At the time of image formation, when the switch 62 is turned off, the developer is fed to the gap between the sleeve and the drum 13. When the switch 62 is turned on at the time of stand-by, the developer layer on the developing roller 25 is brought out of contact with the drum 13 because of repulsion acting between the magnetic lines of force generated by the coil 60 and those generated by the magnet roller. At this instant, the magnetic field does not spatially move, so that the developer does not move on the sleeve or leak from the casing 23. The switch 26 is implemented as a switching device to be selectively turned on or turned off by a signal.

In the illustrative embodiment, as in the third embodiment, the movable member 34*a* is mounted on the casing 23 and movable about the shaft 35 for controlling the gap Gb and sealing the gap G2. In this case, too, the movable member 34*a* can be moved in interlocked relation to the displacement of the casing 23.

The illustrative embodiment differs from the third embodiment in that the casing 23 does not have to be moved to bring the developer into or out of contact with the drum 13 because such a function is assigned to the coil 60. In light of this, the casing 23 may be displaced along an arc whose center coincides with the axis of the drum 13. Because the direction of such a displacement is similar to the direction Z, FIG. 12, there may be used the configuration of FIG. 13A or 13B in which the pressing member 55 presses the opening member 34*c* of the movable member 34*a* for thereby moving the casing 23.

Fifth Embodiment

Figure 15:
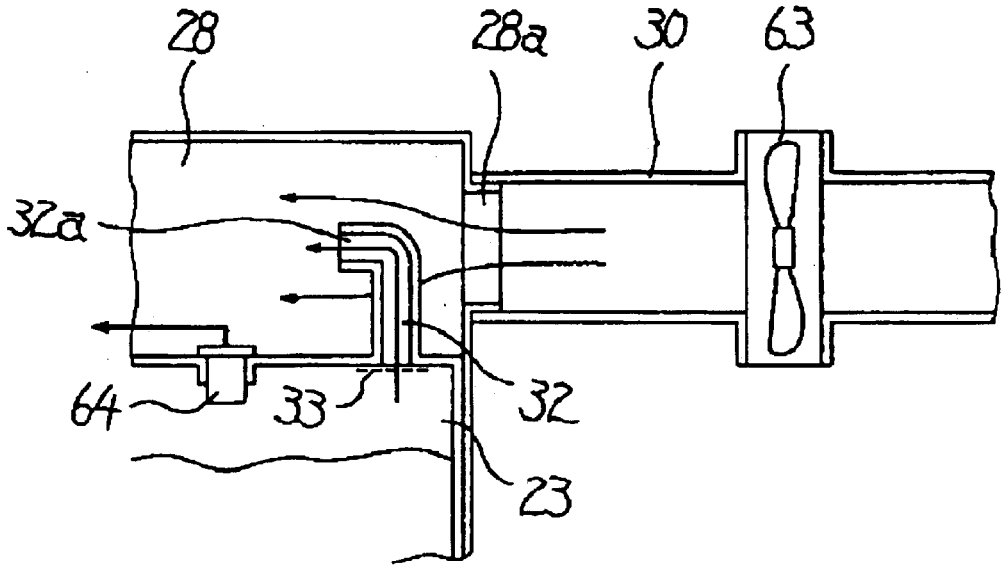
FIG. 15 is a section showing a fan representative of a fifth embodiment of the present invention.

FIG. 15 shows a fifth embodiment of the present invention. As shown, a fan 63 is located in the path along which the controlled air output from the air conditioner 29 flows. More specifically, to effectively depressurize the inside of the casing 23 without resorting to a pump, the fan 63 with variable rotation speed is located in the above path. The opening 32*a* of the exhaust path 32 is open in the direction in which the gas is sent by the fan 63.

In the illustrative embodiment, at the initial stage of operation, the rotation speed of the fan 63 is increased to enhance the depressurization of the casing 23 for thereby rapidly replacing and stabilizing the gas inside the casing 23. When the environment in the casing 23 does not noticeably vary, the rotation speed of the fan 63 may be lowered to save energy.

The illustrative embodiment, like the first embodiment, depressurizes the inside of the casing 23 without resorting to a pump, i.e., by using the dynamic pressure of the stream of the controlled gas. More specifically, in the stand-by condition, a pump or similar part should be excluded as far as possible from the power saving and noise reduction standpoint. Further, because the volume of air inside the casing 23 is generally small, enhanced sealing achievable with any one of the illustrative embodiments shown and described suffices, once the gas inside the casing 23 is replaced with the controlled gas, to reduce the amount of the controlled gas to be fed to the space including the casing 23. This is why the illustrative embodiment depressurizes the inside of the casing 23 by use of the dynamic pressure of the controlled gas.

While the depressurizing means is not essential with the forward developing system, if depressurization can be effected in the initial stage of operation after power-up, in particular, then the replacement of air inside the casing 23 is noticeably sped up, contributing to the stabilization of the developer characteristics. However, to interrupt depressurization during development, the exhaust path 32 must be closed by the shutter 49, as described with reference to FIG. 5. As shown in FIG. 15, a sensor 64 responsive to temperature and humidity inside the casing 23 may be mounted on the casing 23, in which case the rotation speed of the fan 63 will be controlled in accordance with the output of the sensor 64.

Sixth Embodiment

Figure 16:
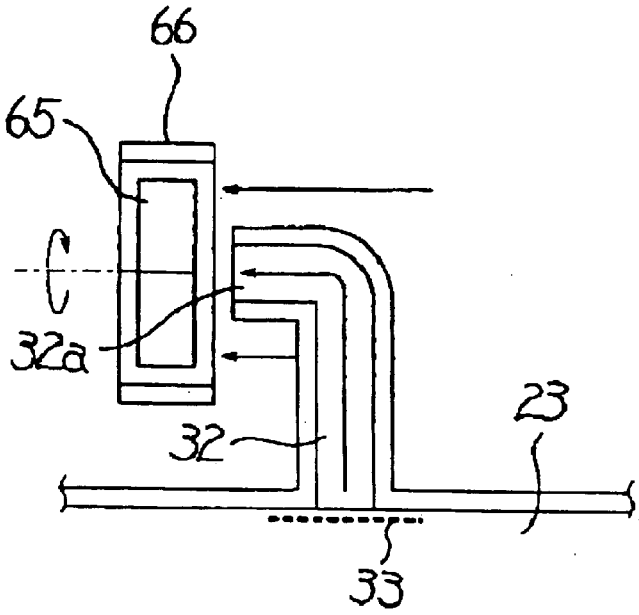
FIG. 16 is a section showing a bladed wheel representative of a sixth embodiment of the present invention.

FIG. 16 shows a sixth embodiment of the present invention. As shown, a bladed wheel 65 adjoins the opening 32*a* of the exhaust fan 32. The bladed wheel 65 is mounted on a support frame 66 and has an axis parallel to the steam of the controlled gap output from the air conditioner 29. In this configuration, the gas, flowing in a direction indicated by an arrow in FIG. 16, causes the bladed wheel 65 to rotate. The resulting air stream generates vacuum in the exhaust path 32 for thereby surely depressurizing the inside of the casing 23. For effective depressurization, the diameter of the bladed wheel 65 should preferably be larger than the diameter of the opening 32*a*.

More specifically, the exhaust path 32 effectively operates when subject to high air velocity and should therefore be positioned as close to air sending means as possible. However, because extending the exhaust path 32 aggravates the pressure loss of the exhaust path 32, the exhaust path 32 should preferably be located at the most upstream side in the vicinity of the developing device 15. Further, considering the fact that an eddy is apt to occur in a portion where the sectional area of the path is increased or decreased and thereby obstruct the generation of vacuum in the opening 32*a*, it is also desirable to locate the exhaust path 32 at a position preceding the above portion.

In the embodiment shown in FIG. 5, the controlled gas is sent to the space above the screw 24*a* disposed in the casing 23. However, it is preferable to connect the exhaust path 32 to the space remote from the developing zone, as shown in FIG. 2 within the range that does not noticeably aggravate pressure loss, thereby reducing the space via which the control gas flows.

Seventh Embodiment

Figure 17A:
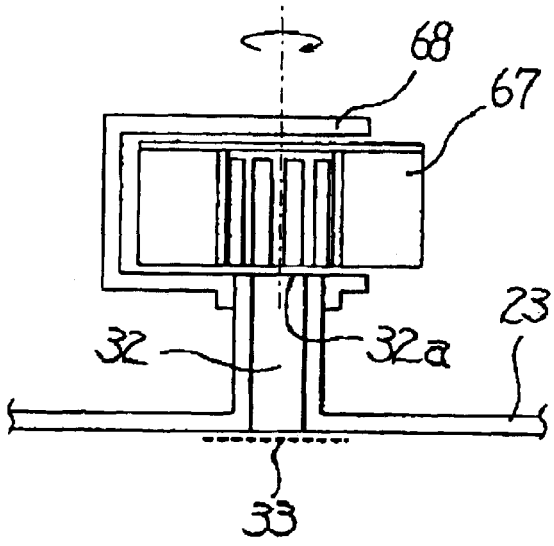
FIG. 17A is a section showing a centrifugal fan type of bladed wheel representative of a seventh embodiment of the present invention.
Figure 17B:
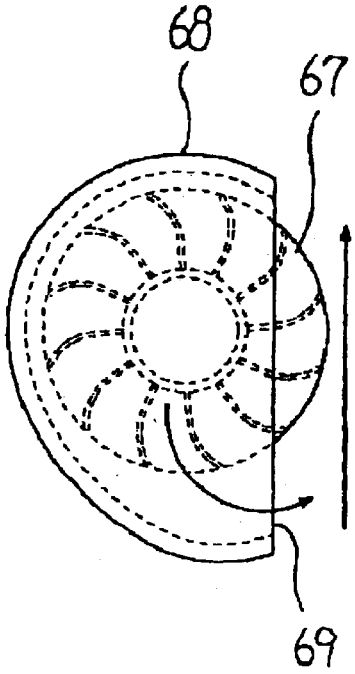
FIG. 17B is a plan view of the bladed wheel shown in FIG. 17A.

FIGS. 17A and 17B show a seventh embodiment of the present invention. As shown, a centrifugal fan type of bladed wheel 67 is attached to the opening 32*a* of the exhaust path 32 and has an axis perpendicular to the direction of flow of the gas derived from the air conditioner 29. The bladed wheel 67 is mounted on the case 68 and positioned such that its circumference is partly exposed to the outside via an opening 69 formed in the case 68.

In the illustrative embodiment, the gas exhausted from the casing 23 via the air passage 32 by the bladed wheel 67 is steered at a right angle on passing the opening 32*a*. It is therefore not necessary to bend the exhaust path 32. This successfully reduces the length of the exhaust path 32 for thereby reducing pressure loss. Further, high static pressure available with the bladed wheel 67 further promotes depressurization.

Eighth Embodiment

Figure 18:
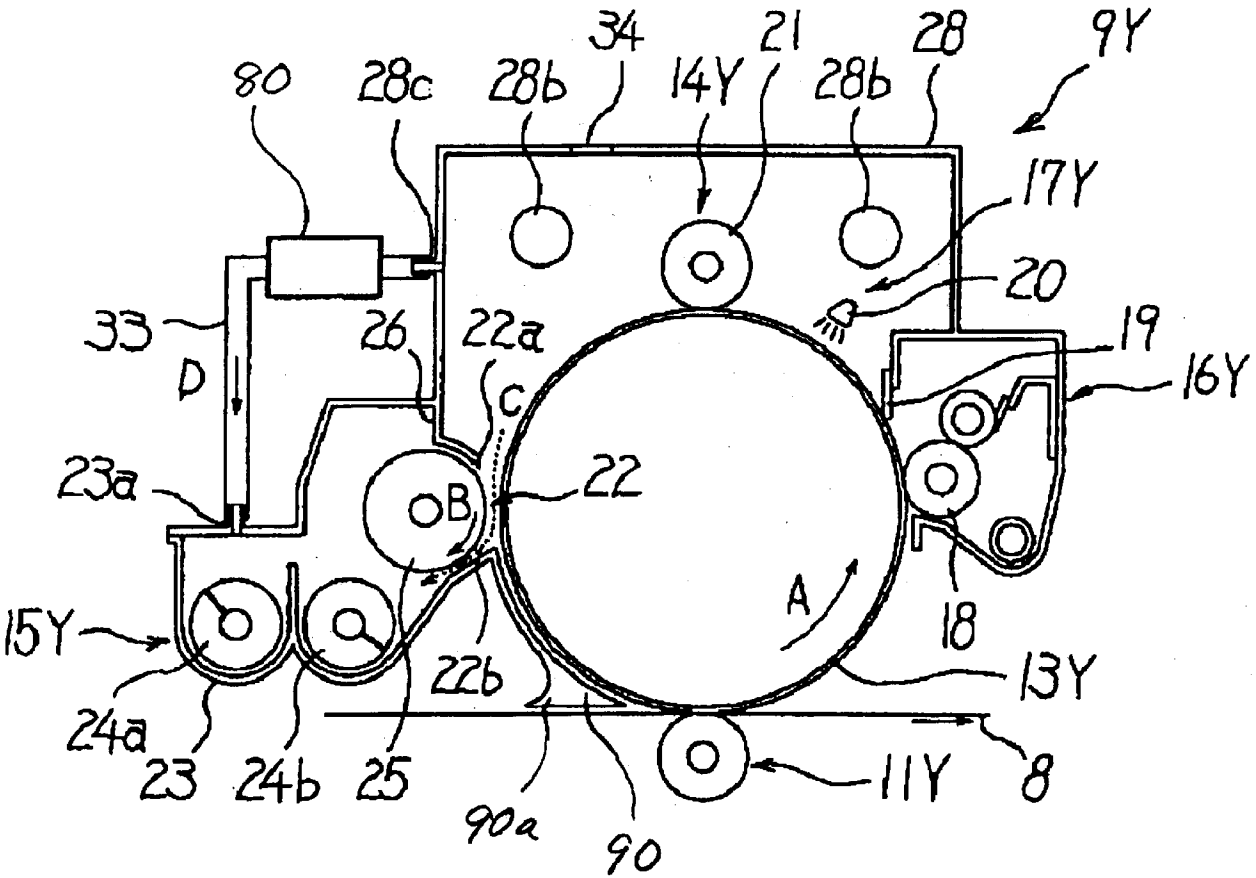
FIG. 18 is a section showing an image forming unit representative of an eighth embodiment of the present invention.
Figure 19:
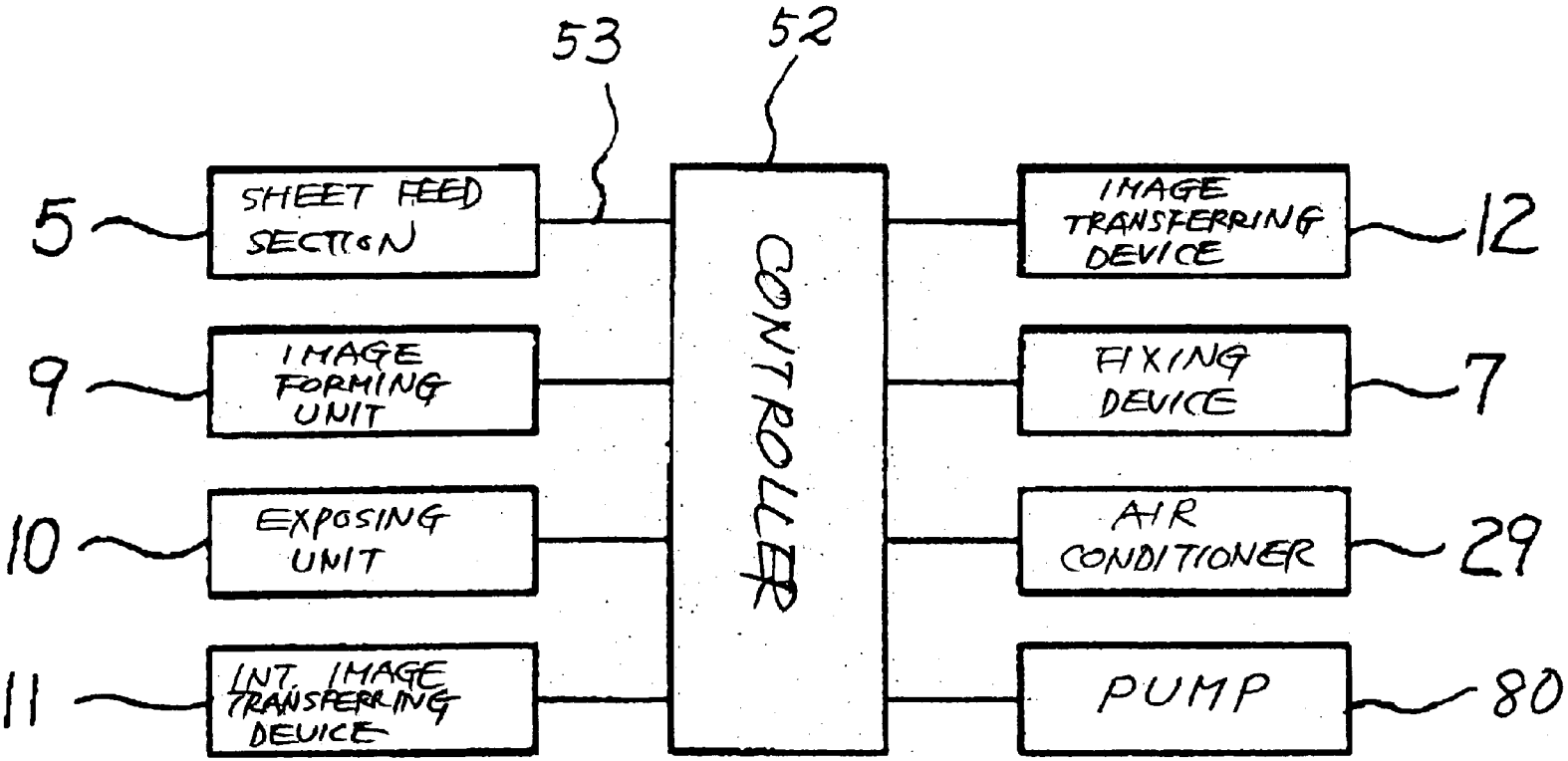
FIG. 19 is a schematic block diagram showing a control system included in the eighth embodiment.
Figure 20:
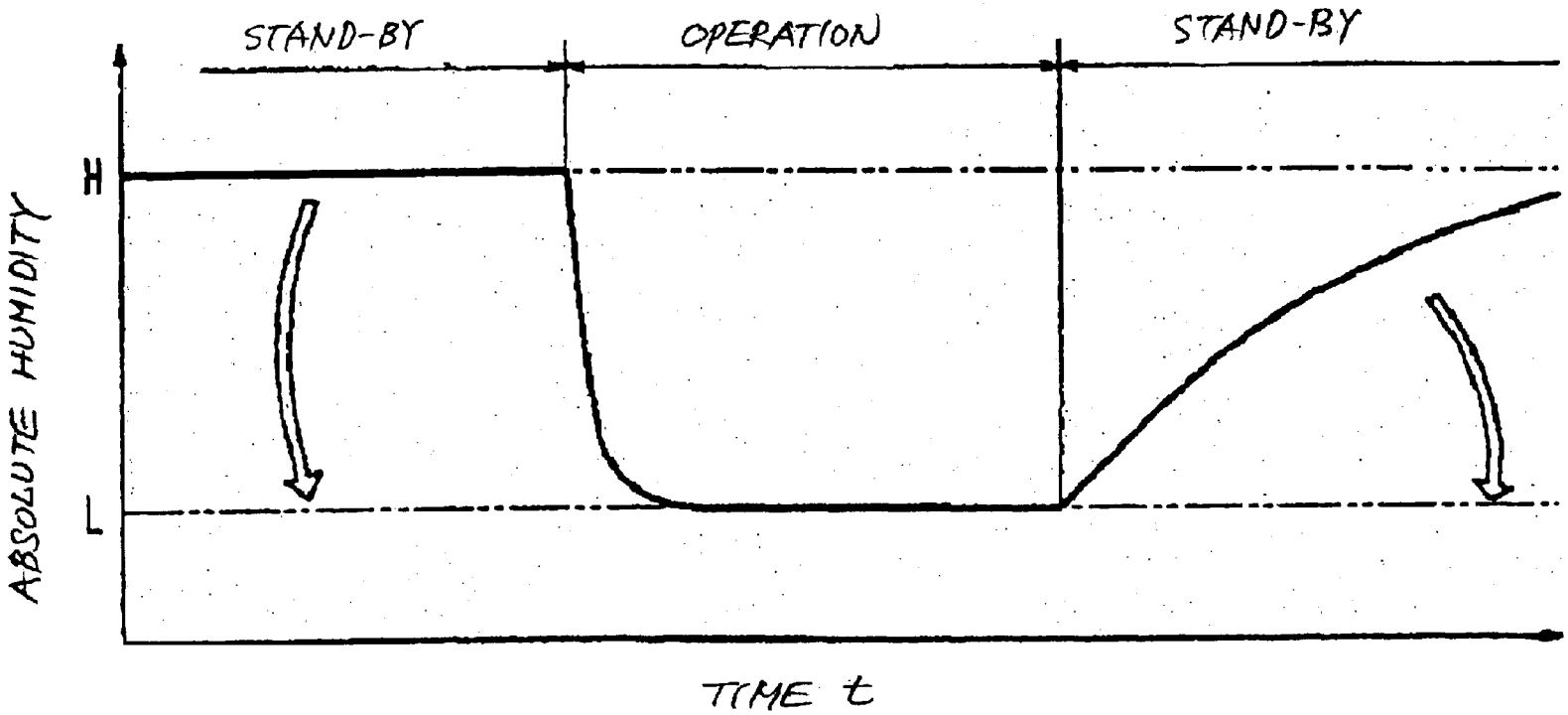
FIG. 20 is a graph showing a relation between absolute humidity in the casing of a developing device and time.
Figure 21:
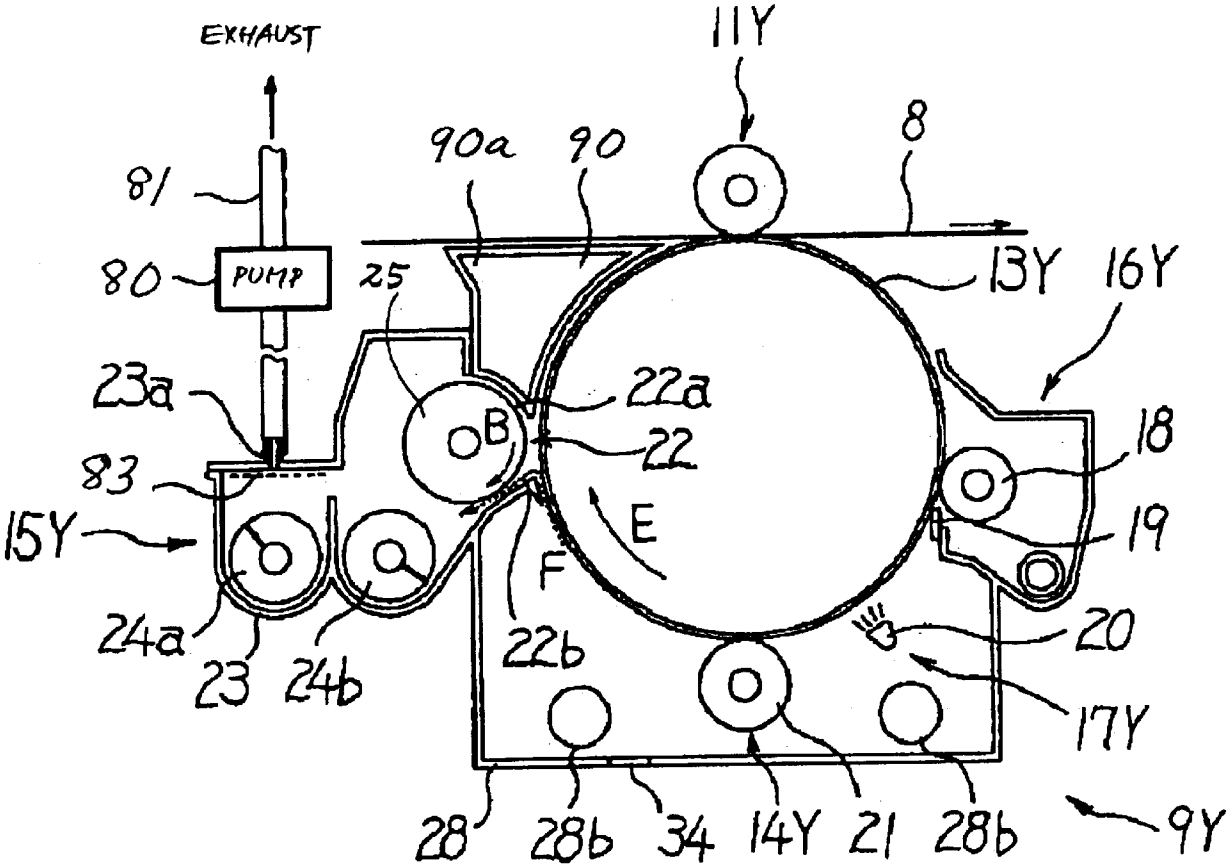
FIG. 21 is a section showing an image forming unit representative of a ninth embodiment of the present invention.
Figure 22:
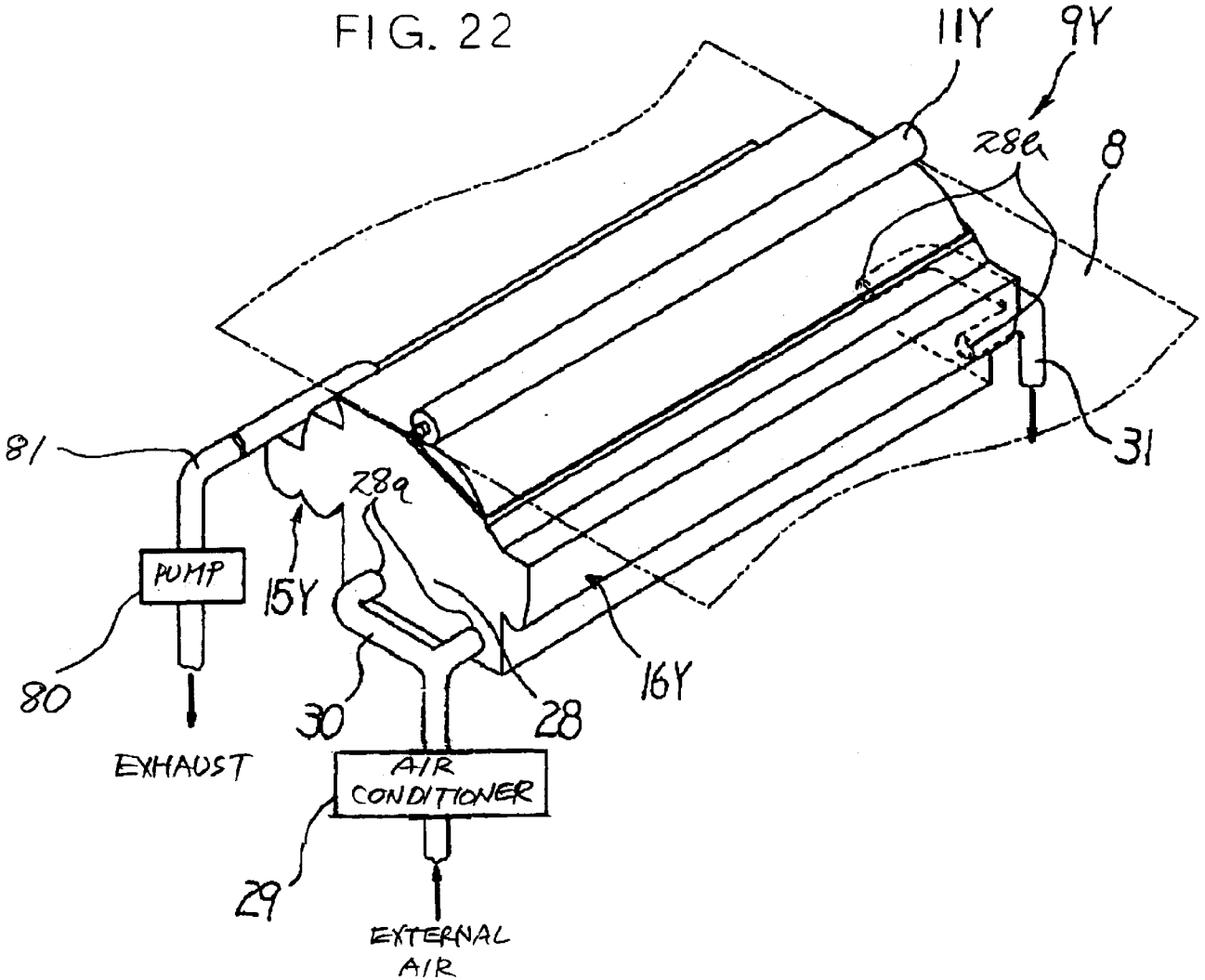
FIG. 22 is an external view of the image forming unit shown in FIG. 21.

Referring to FIGS. 18 through 20, an eighth embodiment of the present invention will be described. As shown in FIG. 18, the developing device 15Y, for example, includes a guide or guide member 90 extending from the downstream edge 22*b* of the opening 22 toward the downstream side in the direction of rotation of the drum 13Y. The guide 90 reduces a turbulent flow ascribable to a viscous air flow produced on the surface of the intermediate image transfer belt 8, thereby preventing air from flowing into the casing 23 via the opening 22.

Further, a viscous air flow produced on the surface of the drum 13Y and the above viscous air flow on the belt 8 join each other at the position around the intermediate image transfer roller 11Y, raising pressure around the above position and thereby producing a turbulent flow. In light of this, the guide 90 includes a nail-like peeler 90*a* configured to peel off the viscous air flow on the surface of the belt 8. The guide 90 plays the role of a first guide portion for guiding the, viscous airflow on the surface of the belt 8 to a direction different from the direction in which the belt 8 moves. This configuration is particularly effective when the developing device 15Y and intermediate image transferring device 11Y are close to each other.

FIG. 19 shows a control system included in the illustrative embodiment. As shown, the control system is identical with the control system of the first embodiment, FIG. 6, except that it additionally includes a pump 80. Only when the developing roller 25 of the developing device 15Y is held in a halt, a pump motor, not shown, drives the pump 80 in response to a control signal output from the controller 52, so that the low humidity gas is fed from the air conditioning box 28 into the casing 23.

FIG. 20 shows a relation between absolute humidity inside the casing 23 and a period of time t elapsed. Assume that the image forming apparatus 1 is situated in a high humidity environment. Then, as FIG. 20 indicates, humidity inside the casing 23 (absolute humidity H) also increases. If the apparatus 1 is operated in such an environment, then humidity inside the casing 23 becomes equal to humidity inside the air conditioning box 28 (absolute humidity L) due to the rotation of the developing roller 25, as indicated by a solid curve in FIG. 20. This is because a viscous air flow produced by the rotation of the developing roller 25 entrains low humidity air present in the air conditioning box 28 into the casing 23 via the downstream edge 22*b* of the opening 22.

Subsequently, when the apparatus 1 ends image formation, i.e., when the developing roller 25 stops rotating, humidity inside the casing 23 is restored to the environmental humidity (absolute humidity H) in which the apparatus 1 is situated little by little, as also indicated by the solid curve in FIG. 20.

Therefore, in the stand-by condition of the apparatus 1, i.e., when the developing roller 25 is in a halt, the controller 52 causes the pump 80 to send low humidity air present in the air conditioning box 28 into the casing 23. This successfully makes humidity inside the casing 23 equal to humidity (absolute humidity L) inside the air conditioning box 28.

The image forming operation of the apparatus 1 for forming a color image on the sheet P will not be described specifically in order to avoid redundancy.

An environment control procedure unique to the illustrative embodiment will be described hereinafter. When the developing roller 25 is rotating for effecting development, the controller 52 interrupts the operation of the pump 80. This implements the function of interrupting means. At this instant, the viscous air flow ascribable to the rotation of the developing roller 25 entrains low humidity air present in the air conditioning box 28 into the casing 23 via the downstream edge 22*b* of the opening 22, as indicated by an arrow C in FIG. 18. As a result, the environment inside the casing 23 becomes substantially identical with the environment inside the air conditioning box 28 (low humidity condition) even when image formation is under way.

When the apparatus 1 is in the stand-by condition, i.e., when the developing roller 25 is in a halt, the controller 52 energizes the pump 80. This implements feeding means. The pump 80 causes low humidity air inside the air conditioning box 28 to flow into the casing 23, as indicated by an arrow D in FIG. 18. At this instant, although pressure inside the casing 23 rises, almost no toner is floating in the casing 23 because the screws 24*a* and 24*b* are also in a halt. This, coupled with the fact that the magnet brush present on the developing roller 25 allows substantially no air to flow out via the opening 22, obviates scattering of the toner. Therefore, the environment inside the casing 23 is substantially identical with the environment inside the air conditioning box 28 (low humidity environment).

As stated above, in the illustrative embodiment, the low humidity gas introduced from the air conditioner 29 into the air conditioning box 28 replaces air present in the box 28 and containing discharge products and floating toner, thereby removing discharge products and floating toner. Further, low humidity gas in the air conditioning box 28 is fed to the casing 23 to thereby maintain the environment in the casing 23 low in humidity, so that the durability of the drum 13 is enhanced to, in turn, surely obviate the degradation of image quality. Moreover, when the developing roller 25 is in operation, the pump 80 does not operate and prevents pressure inside the casing 23 from undesirably rising, thereby preventing toner from flying about. This not only saves power, but also surely protects image quality from degradation.

The guide 27 limits the space between the drum 13 and the intermediate image transfer belt 8 from the developing position to the image transfer position, thereby reducing a turbulent flow ascribable to the surface of the belt 8. It is therefore possible to obviate pressure elevation at the image transfer position and an air flow from the image transfer position to the developing position and therefore to reduce toner scattering. In addition, it is possible to prevent a gas not subject to humidity control, e.g., a high humidity gas from entering the casing 23 via the downstream edge 22*b* of the opening 22. The environment inside the casing 23 is therefore identical with the environment inside the air conditioning box 28, insuring high image quality.

In the illustrative embodiment, the pump 80 serves as feeding means and is controlled in accordance with the drive/non-drive of the developing roller 25. Alternatively, the feeding means may be implemented by a solenoid-operated valve selectively opened or closed in accordance with the condition of the developing roller 25.

Ninth Embodiment

A ninth embodiment of the present invention will be described with reference to FIGS. 10 and 21 through 23. As for basic construction, the ninth embodiment is identical with the color image forming apparatus 1A of the second embodiment shown in FIG. 10.

In the illustrative embodiment, too, part of the surface of the drum 13Y and charger 14Y, lying in the range from the position where the cleaning blade 19 contacts the drum 13Y to the opening 22 in the direction of rotation of the drum 13Y, are enclosed by the air conditioning box 28. The air conditioning box 28 is fluidity communicated to the opening 22. The air conditioning box 28 is formed with two inlet ports 28*a* and two outlet ports 28*b*, as in the ninth embodiment. The air inlets 28*a* are fluidity communicated to the air conditioner 29, which sends low humidity air by way of example, by an inlet tube 30. The air outlets 28*b* are fluidly communicated to the outside of the apparatus 1A by an outlet tube 31.

The casing 23 is formed with a port 23*a* communicated to the outside of the apparatus 1A by a tube 81 via the pump 80, which constitutes an air discharge section. The tube 81 plays the role of an exhaust path. The pump 80 includes a pump motor or drive source not shown. A filer 83 is attached to the port 23*a* for preventing toner from flying out of the casing 23.

Again, the slit-like window 27 is formed in the air conditioning box 28, so that a laser beam issuing from the exposing unit 10 can be incident to the surface of the drum 13Y. The window 27 is implemented by a transparent plate formed of, e.g., glass or resin.

A control system included in the illustrative embodiment is identical with the control system of FIG. 19 except that the pump 80 is constantly driven by a control signal output from the controller 52 although the pump 80 may not be done so.

Figure 23:
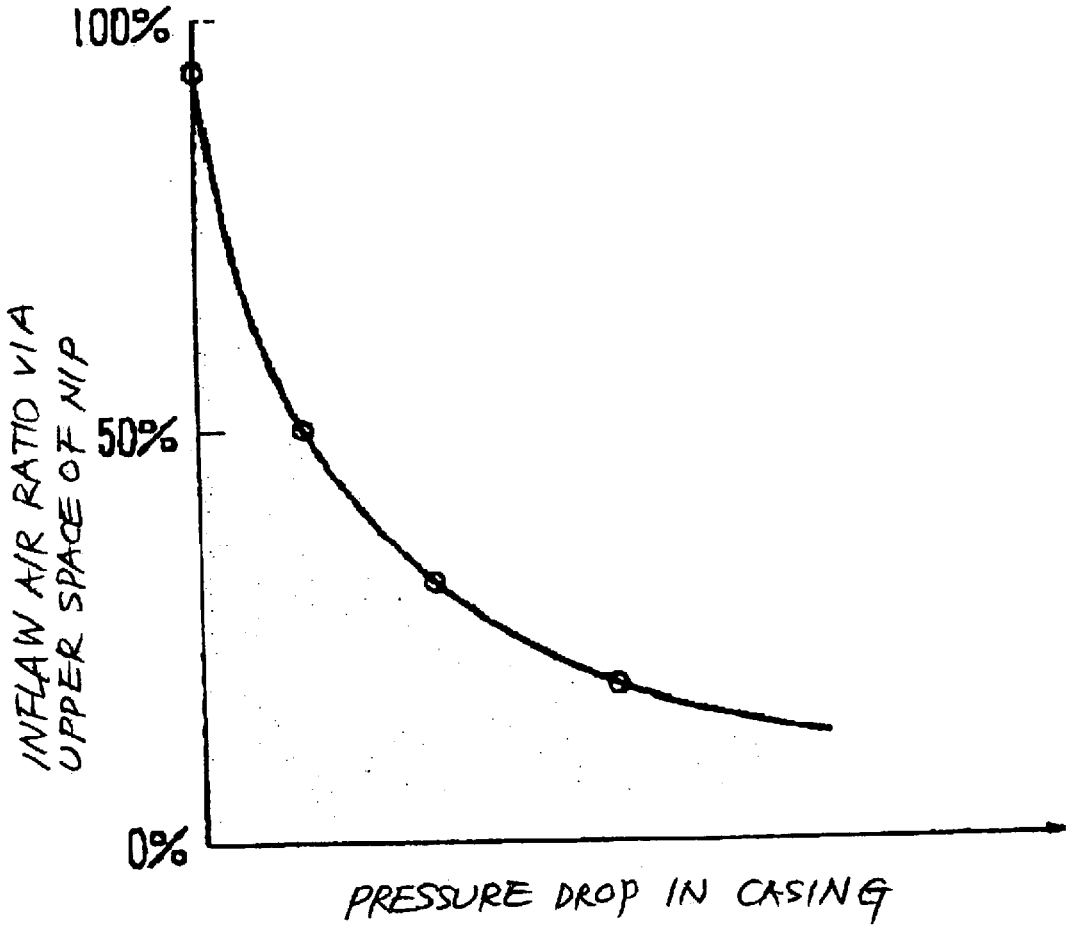
FIG. 23 is a graph showing a relation between the drop of pressure inside the casing to occur in the stand-by position and the ratio of air flowing into the casing via a space above the opening of the casing.

FIG. 23 shows a relation between the drop of pressure inside the casing 23 to occur when the developer 25 stops rotating and the ratio of air to flow into the casing 23 via the space above the opening 22 to the entire air to flow into the casing 23. As shown, when pressure inside the casing 23 drops, the above ratio of air inflow increases, i.e., the amount of air flowing into the casing 23 via the space above the opening 22 increases. Conversely, when pressure inside the casing 23 rises, the ratio of air inflow decreases while the amount of air flowing into the casing 23 via the space below the opening 22 increases. This indicates that air can be selectively caused to flow into the casing 23 via the space above or below the opening 22. Therefore, by exhausting the casing 23, it is possible to introduce air into the casing 23 via the space below the opening 22.

It follows that if the air conditioning box 28 is positioned in the space below the opening 22 and driven by the controller 52 to exhaust the casing 23, then low humidity air present in the air conditioning box 28 is introduced into the casing 23 via the opening 22. As a result, the environment inside the casing 23 can be maintained substantially identical with the environment inside the air conditioning box 28.

In operation, the pump 80 is operated to exhaust the casing 23 when the apparatus 1A is in operation, i.e., when the developing roller 25 is in rotation and when the apparatus 1A is out of operation, i.e., when the developing roller 25 is out of rotation. Consequently, low humidity air inside the air conditioning box 28 flows into the casing 23 via the downstream edge 22*b* of the opening 22, as indicated by an arrow F in FIG. 21. This prevents toner from flying out of the casing 23 via the opening 22 and maintains the environment inside the casing 23 substantially identical with the environment inside the air conditioning box 28 (low humidity environment).

As stated above, in the illustrative embodiment, the low humidity gas introduced from the air conditioner 29 into the air conditioning box 28 replaces air present in the box 28 and containing discharge products and floating toner, thereby removing discharge products and floating toner. Further, low humidity gas in the air conditioning box 28 is fed to the casing 23 to thereby maintain the environment in the casing 23 low in humidity, so that the durability of the drum 13 is enhanced to, in turn, surely obviate the degradation of image quality.

Tenth Embodiment

Figure 24:
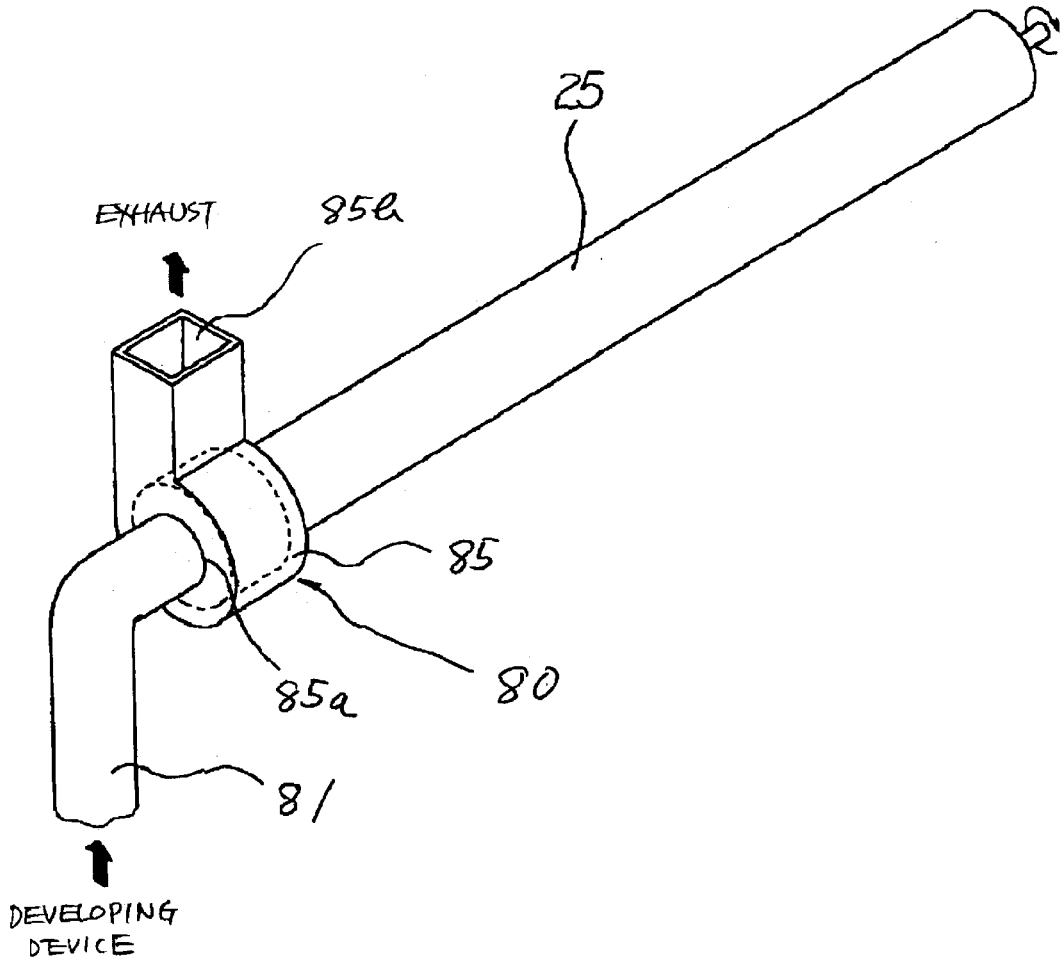
FIG. 24 is an external view showing a developing roller and members associated therewith representative of a tenth embodiment of the present invention.

FIG. 24 shows a tenth embodiment of the present invention identical with the ninth embodiment except for the following. As shown, a centrifugal fan 85, playing the role of the pump 80, is driven by the developing roller 25. Therefore, the pump 80 and developing roller 25 share a single drive source.

More specifically, the centrifugal fan 85 is mounted on one end of the developing roller 25 and includes a suction port 85*a* and an exhaust port 85*b*. The suction port 85*a* is communicated to the opening 23*a* of the casing 23 by a tube 81 while the exhaust port 80*b* is communicated to the outside of the apparatus 1A by the tube 81.

When the apparatus is in operation, i.e., when the developing roller 25 is in rotation for development, the centrifugal fan 85 is driven by the developing roller 25, exhausting air from the casing 23. As a result, low humidity air inside the air conditioning box 28 flows into the casing 23 via the downstream edge 22*b* of the opening 22, as indicated by an arrow F in FIG. 21. This prevents toner from flying out of the opening 22 and maintains the environment in the casing 23 substantially identical with the environment in the air conditioning box 28 (low humidity environment).

When the apparatus 1A is in the stand-by condition, i.e., when the developing roller 25 is in a halt, almost no air flows into the casing 23 via the downstream edge 22*b* of the opening 22 because of the magnet brush formed on the developing roller 25. On the other hand, low humidity air in the air conditioning box 28 flows into the casing 23 via the downstream edge 22*b* little by little, as indicated by the arrow F in FIG. 21, so that the environment in the casing 23 becomes identical with the environment in the air conditioning box 28 as the time elapses.

As stated above, the illustrative embodiment drives the centrifugal fan 85 and developing roller 25 at the same time with a single drive source for thereby simplifying control and reducing the number of parts and therefore cost. Further, the illustrative embodiment achieves the same advantages as the ninth embodiment.

If desired, the centrifugal fan 85 may be included in the speed reduction stage associated with the motor and may even be replaced with a piston type pump using a slider-crank mechanism.

Eleventh Embodiment

An eleventh embodiment of the present invention will be described with reference to FIGS. 25A, 25B and 26. The illustrative embodiment is also similar to the ninth embodiment except for the following.

Figure 25A:
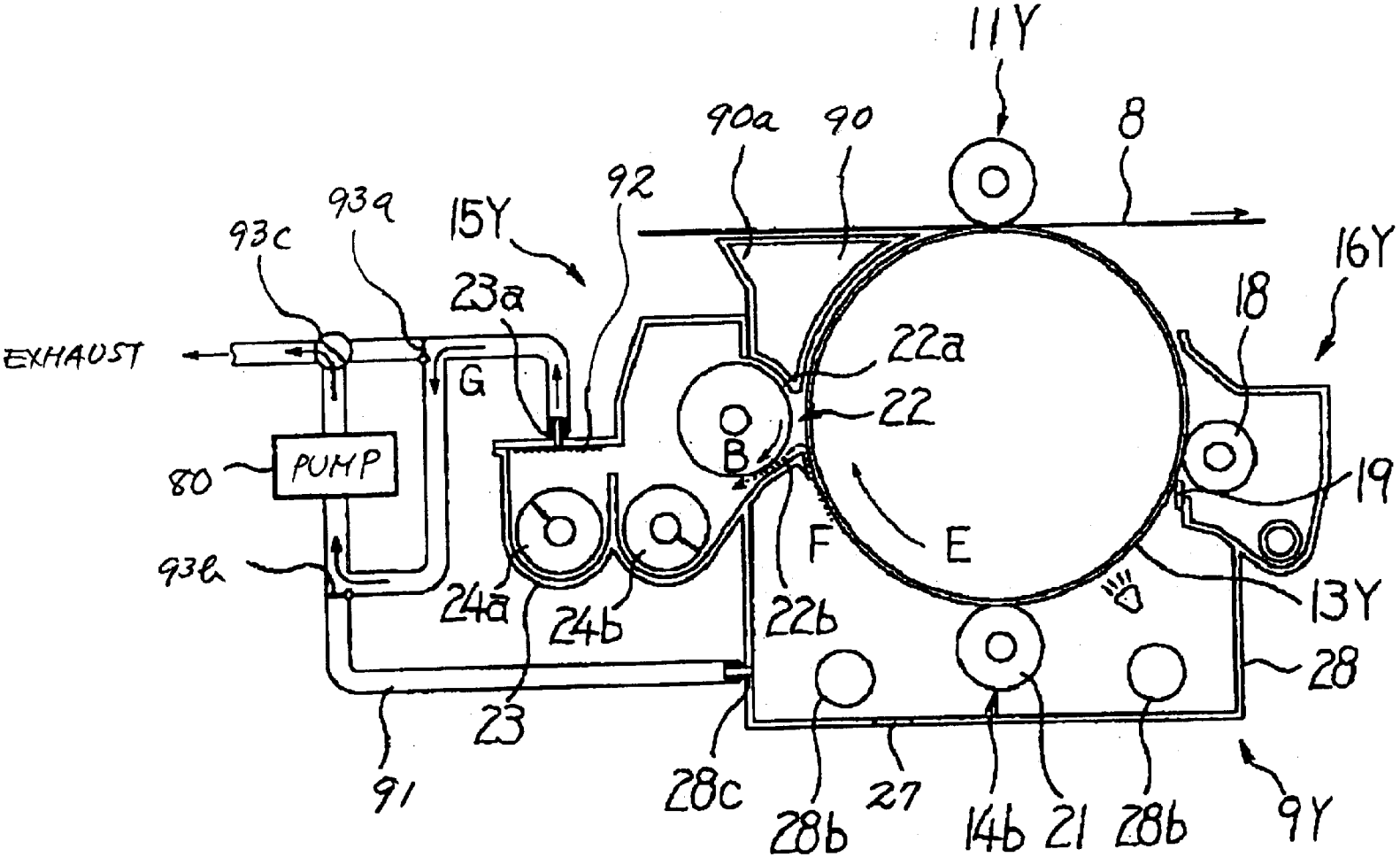
FIG. 25A is a section showing an image forming unit representative of an eleventh embodiment of the present invention and conditioned to establish a discharge path.
Figure 25B:
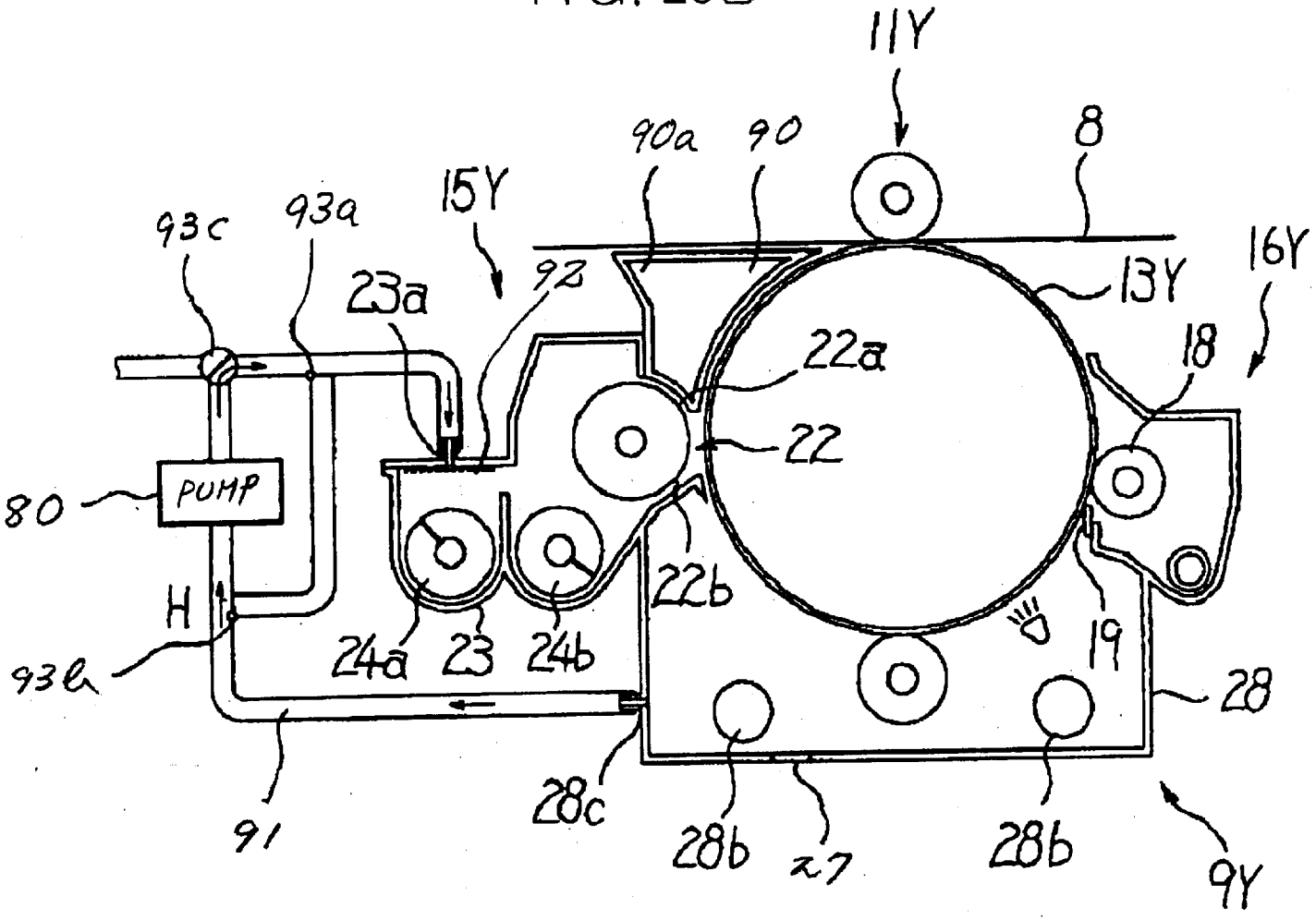
FIG. 25B is a view similar to FIG. 25A, showing the image forming unit conditioned to establish a feed path.

As shown in FIGS. 25A and 25B, the image forming unit 9Y, for example, has the casing 23 formed with the opening 23*a*, which is fluidly communicated to the outside of the apparatus 1A by a tube 91 via the pump 80. The path so extending from the opening 23*a* to the outside of the apparatus 1A constitutes a discharge path, as indicated by an arrow G in FIG. 25A. The air conditioning box 28 is formed with an opening 28*c* communicated to the opening 23*a* of the casing 23 by the tube 91. The path so extending from the opening 28*c* to the opening 23*a* constitutes a feed path, as indicated by an arrow H in FIG. 25B. The pump 80 is driven by a motor or drive source not shown. A filter 92 is attached to the opening 23*a* of the casing 23 in order to prevent toner from flying out of the casing 23.

The discharge path and feed path mentioned above are communicated to each other. A first, a second and a third flow control valve 93*a*, 93*b* and 93*c*, respectively, are disposed in the discharge path and feed path in order to select either one of the two paths. The flow control valves 93*a* through 93*c* serve as a blocking/unblocking section for selectively blocking or unblocking the paths.

Figure 26:
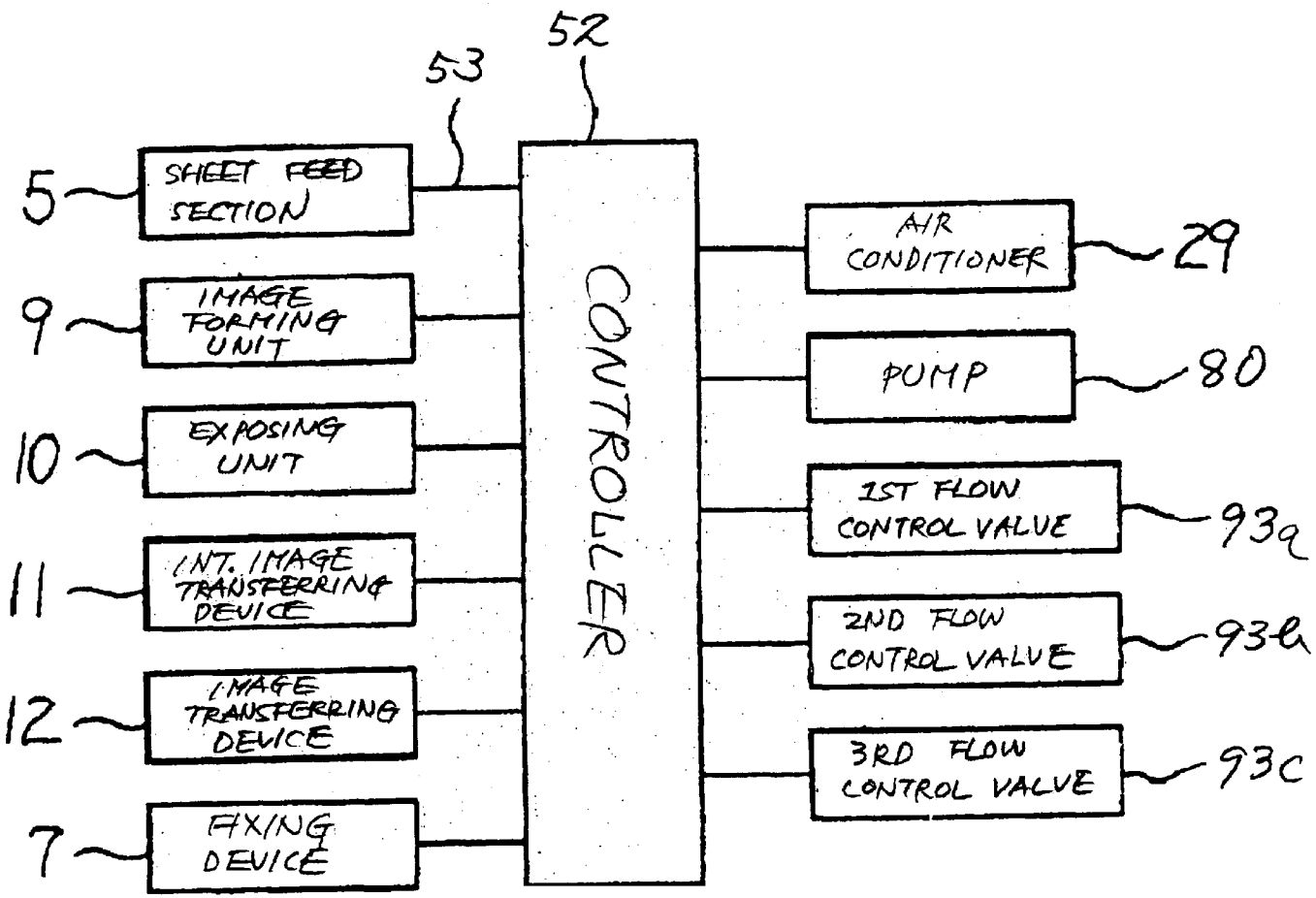
FIG. 26 is a schematic block diagram showing a control system included in the eleventh embodiment.

FIG. 26 shows a control system included in the illustrative embodiment. As shown, the control system is identical with the control system shown in FIG. 19 except that the first to third flow control valves 93*a* through 93*c* are additionally connected to the controller 52 and controlled thereby.

When the apparatus 1A is in operation, i.e., when the developing roller 25 is in rotation for development, the controller 52 so switches the first to third flow control valves 93*a* through 93*c* as to establish the discharge path, as shown in FIG. 25A. This implements the function of switching means. As a result, the pump 80, which is constantly driven, exhausts air from the casing 23 in a direction indicated by an arrow G in FIG. 25A, so that low humidity air in the air conditioning box 28 flows into the casing 23 via the opening 22 of the casing 23, as indicated by the arrow F in FIG. 25A. This prevents toner from flying out of the opening 22 and maintains the environment in the casing 23 substantially identical with the environment in the air conditioning box 28 (low humidity environment).

When the apparatus 1A is in the stand-by condition, i.e., when the developing roller 25 is in a halt, the controller 52 so switches the flow control paths 93*a* through 93*c* as to establish the feed path, as shown in FIG. 25B. This also implements the function of switching means. As a result, the pump 80 feeds low humidity air present in the air conditioning box 28 to the casing 23 via the feed path, as indicated by an arrow H in FIG. 25B. Although air thus introduced into the casing 23 raises pressure inside the casing 23, toner floats little because the screws 24*a* and 24*b* are in a halt. This, coupled with the fact that the magnet brush on the developing roller 25 allows almost no air to flow out via the opening 22, prevents toner from flying out of the casing 23 via the opening 22. Consequently, the environment in the casing 23 is maintained substantially identical with the environment in the air conditioning box 28 (low humidity environment).

The illustrative embodiment described above achieves the same advantages as the ninth embodiment. Further, by feeding low humidity air present in the air conditioning box 28 to the casing 23 in the stand-by condition, the illustrative embodiment allows the environment in the casing 23 to become identical with the environment in the air conditioning box 28 in a shorter period of time than the ninth embodiment. In addition, inflow air flows to the opening 23*a* of the casing 23 and prevents the filter 92 from being stopped up.

The pump 80 shared by the discharge path and feed path may be replaced with two pumps respectively assigned to the discharge path and feed path. In this case, the discharge path and feed path are not fluidly communicated to each other. When the developing roller 25 is in a halt, the pump assigned to the discharge path is driven and functions as discharging means. As a result, low humidity air in the air conditioning box 28 flows into the casing 23 via the opening 22 of the casing 23. When the developing roller 25 is in rotation for development, the pump assigned to the feed path is driven and functions as feeding means. As a result, low humidity air flows into the casing 23 via the feed path. In this manner, the environment in the casing 23 is maintained substantially identical with the environment in the air conditioning box 28 (low humidity environment).

Twelfth Embodiment

Figure 27A:
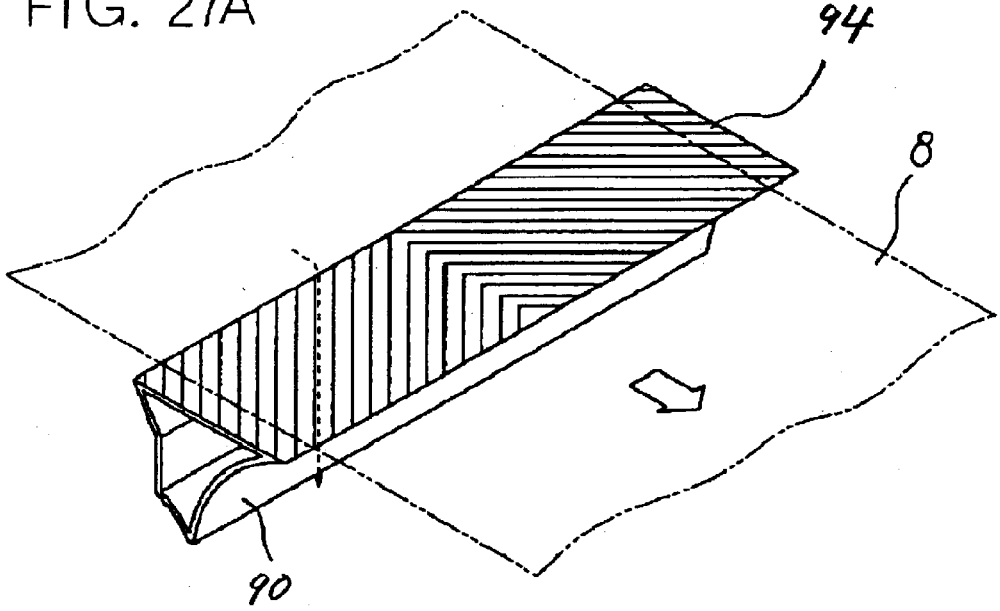
FIGS. 27A through 27C show specific configurations of a guide representative of a twelfth embodiment of the present invention.
Figure 27B:
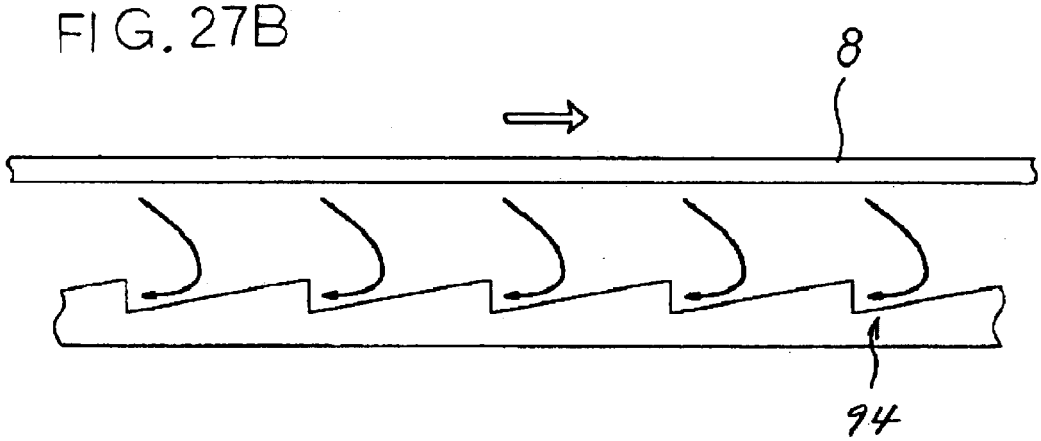
Figure 27C:
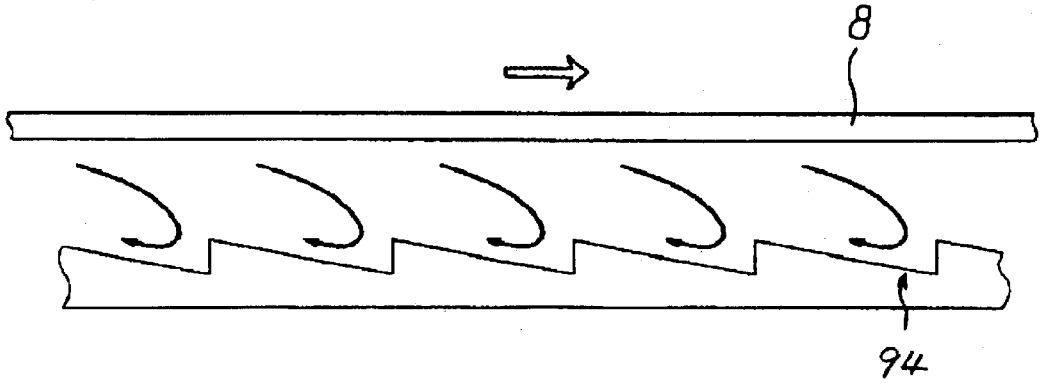

FIGS. 27A through 27C show a twelfth embodiment of the present invention identical with the ninth embodiment except for the following. As shown, the guide 90, included in the developing device 15, is formed with guide grooves, or first guide portion, 94 adjoining the intermediate image transfer belt 8. The guide grooves 94 guide the viscous air flow produced on the surface of the belt 8 in directions other than the direction in which the belt 8 moves.

More specifically, the guide grooves 94 extend obliquely rightward and leftward from the center toward the downstream side in the direction of movement of the intermediate image transfer belt 8 and have saw-toothed sections asymmetric to each other. As for section, each guide groove 94 may be inclined upward toward the downstream side in the above direction, as shown in FIG. 27B, or may be inclined downward toward the upstream side, as shown in FIG. 27B.

The guide 90 formed with the guide grooves 94, as stated above, guides the viscous air flow produced on the surface of the intermediate image transfer belt 8 in directions other than the direction of movement of the belt 8. This successfully obviates pressure elevation and therefore a turbulent flow at the image transfer position where a toner image is transferred to the sheet P, thereby preventing toner from flying about and insuring high image quality.

If desired, guide grooves identical in configuration with the guide grooves 94 may be formed in the surface of the guide 90 adjoining the drum 13 as a second guide portion.

Thirteenth Embodiment

Figure 28:
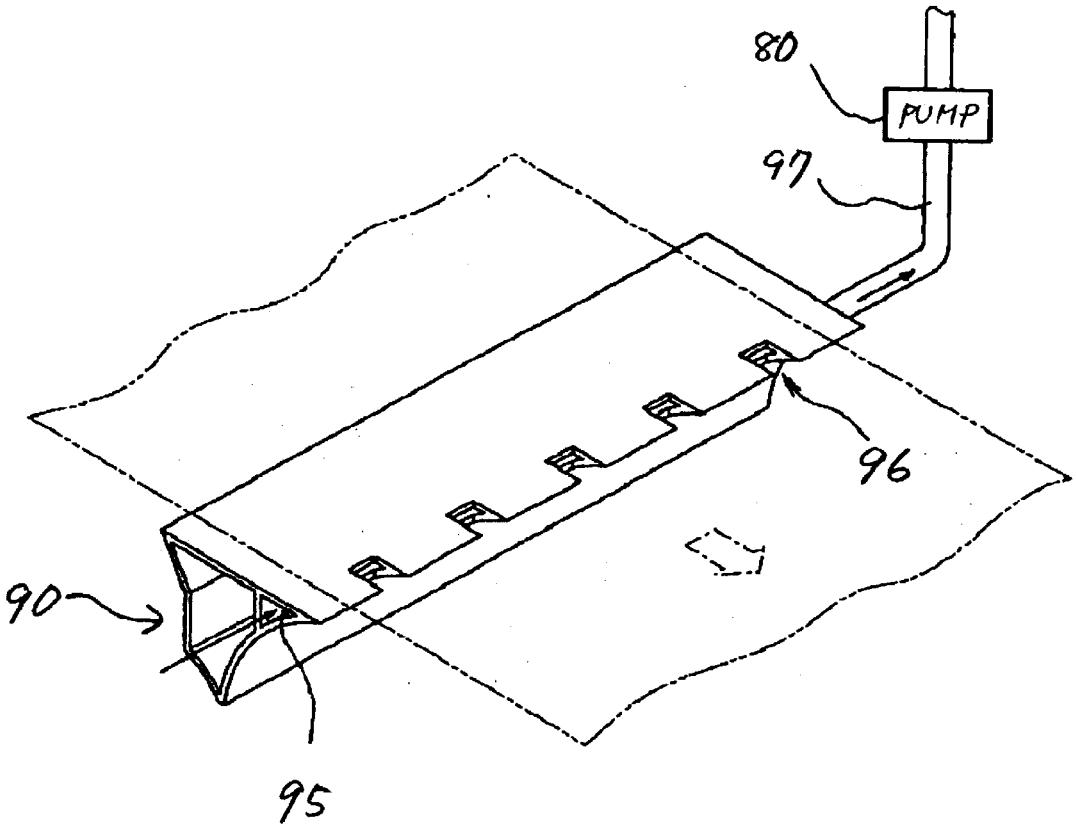
FIG. 28 is an external view showing a guide representative of a thirteenth embodiment of the present invention.

FIG. 28 shows a thirteenth embodiment of the present invention also identical with the ninth embodiment except for the following. As shown, the guide 90 is formed with a duct or suction path 95 and a plurality of openings 96 communicated to the duct 95 and adjoining the belt 8. The openings 96 are positioned in the vicinity of the image transfer position. The duct 95 is connected to the pump 80 by a tube 97 at one end and connected to the opening 23*a* of the casing 23 or the opening 28*c* of the air conditioning box 28 at the other end.

When the pump 80 is driven to suck air present in the duct 95, streams of air are produced around the openings 96 with the result that the viscous air flow on the surface of the intermediate image transfer belt 8 is guided into the duct 95 via the openings 96. This also successfully obviates pressure elevation and therefore a turbulent flow at the image transfer position where a toner image is transferred to the sheet P, thereby preventing toner from flying about and insuring high image quality.

It is to be noted that low humidity air, used as a humidity-controlled gas, may be replaced with, e.g., room temperature, low humidity air or a mixture gas whose components are controlled. Also, external air, caused to flow into the air conditioner 29, may be replaced with low humidity air discharged from the air conditioning box 28, in which case low humidity air will be circulated. Further, the tubes 33, 81, 91 and 97 may be replaced with, e.g., ducts.

Fourteenth Embodiment

Figure 29:
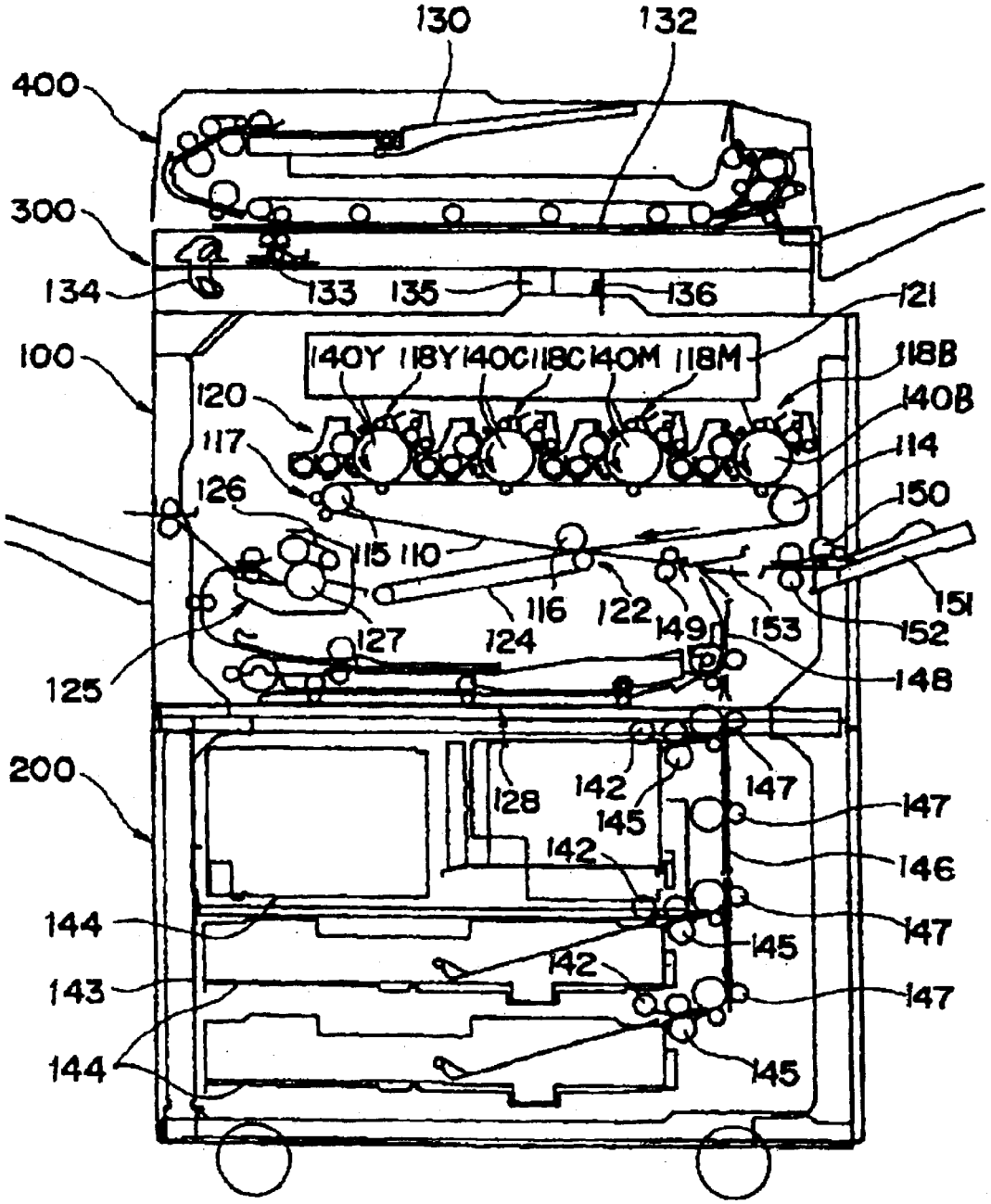
FIG. 29 is a view showing a fourteenth embodiment of the present invention.

Referring to FIGS. 29 through 40, a fourteenth embodiment of the present invention, implemented as a tandem color copier, will be described hereinafter. As shown in FIG. 29, the color copier includes a casing 100, a table 200 on which the casing 100 is mounted, a scanner 300 mounted on the casing 100, and an ADF (Automatic Document Feeder) 400 mounted on the scanner 300. An intermediate image transfer belt or intermediate image transfer body 110 is positioned at the center inside the casing 100.

The intermediate image transfer belt (simply belt hereinafter) 110 is passed over a first, a second and a third rollers 114, 115 and 116, respectively, and caused to turn clockwise, as viewed in FIG. 29. In the illustrative embodiment, a belt cleaner 117 is positioned at the left-hand side of the second roller 115 in order to remove toner left on the belt 110 after image transfer. Four image forming means 118Y, 118C, 118M and 118B (black) are positioned side by side on the upper run of the belt 110 between the first and second rollers 114 and 115, constituting a tandem image forming section 120. It is to be noted that the order in which the image forming means 118Y through 118B are arranged is open to choice.

The belt 110 has a laminate structure made up of a base layer, an elastic layer and a coat layer. The base layer is formed of fluorocarbon resin, canvas or similar material that stretches little. The elastic layer is formed of, e.g., fluororubber or acrylonitrile-butadien copolymer rubber. The coat layer is formed of fluorocarbon resin or similar smooth material coated on the surface of the elastic layer.

An exposing unit 121 is positioned above the tandem image forming section 120. A secondary image transferring device 122 is arranged at the opposite side to the image forming section 120 with respect to the belt 110. A fixing unit 125 is positioned beside the secondary image transferring device 122 for fixing a toner image on a sheet. The fixing unit 125 includes a fixing roller 126 and a press roller 127 pressed against the fixing roller 126.

The secondary image transferring device 122 serves to convey the sheet, carrying a toner image thereon, to the fixing device 125 at the same time. The secondary image transferring device 122 may, of course, be implemented as an image transfer roller or a non-contact type of charger although it is difficult to convey a sheet with such an alternative image transferring device. In the illustrative embodiment, a sheet turning device 128 is arranged below the secondary image transferring device 122 and fixing unit 125 in parallel to the image forming section 120. The sheet turning device 128 turns a sheet in a duplex copy mode.

Figure 30:
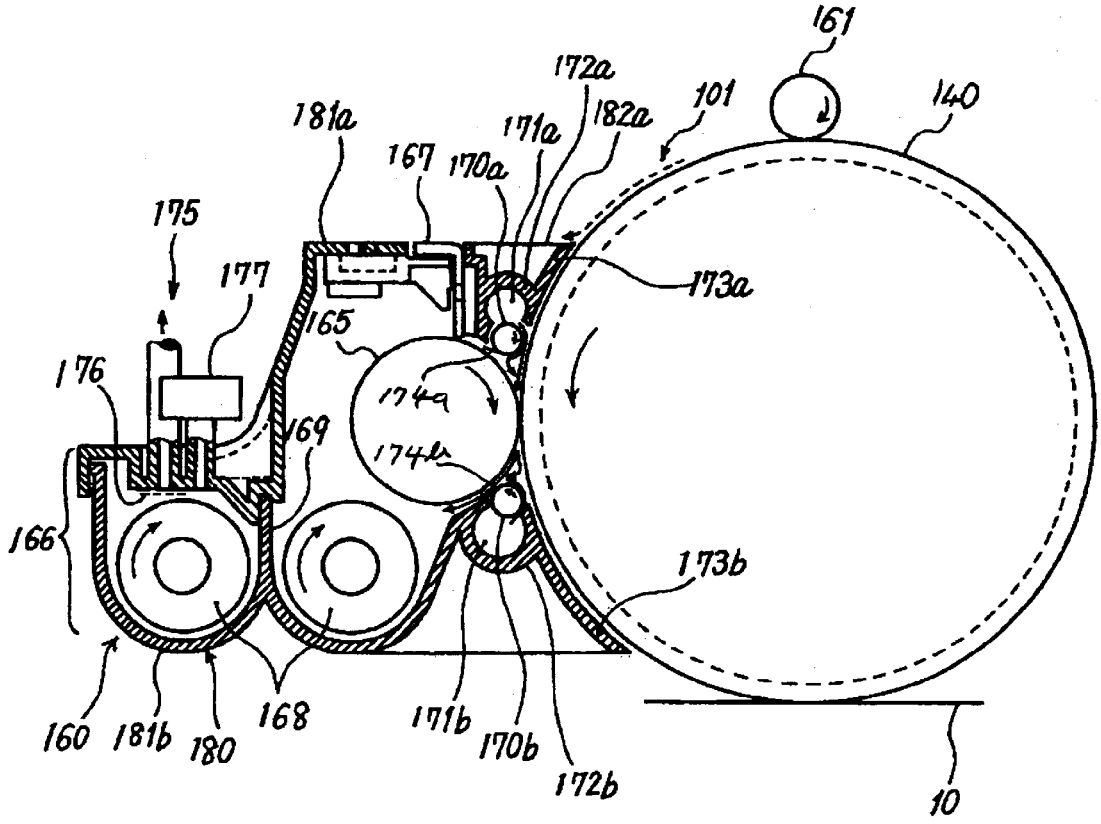
FIG. 30 shows a developing device included in the fourteenth embodiment.

FIG. 30 shows one of developing devices 160 included in the image forming section 120 in an enlarge scale. As shown, each image forming means 118, included in the image forming section 120, includes a photoconductive drum or image carrier 140 provided with a diameter of 60 mm. Arranged around the drum 140 are the developing device 160, a charger 161, a primary image transferring device, not shown, a drum cleaner, not shown, and a discharging device not shown. The drum 140 is made up of an aluminum or similar metal pipe and a photoconductive layer formed on the pipe by coating an organic photoconductor although the drum 140 may be replaced with a photoconductive belt. At least the drum 140 and part of or the entire image forming means 118 may be constructed into a single process cartridge removably mounted to the casing 100 and easy to maintain.

Figure 31:
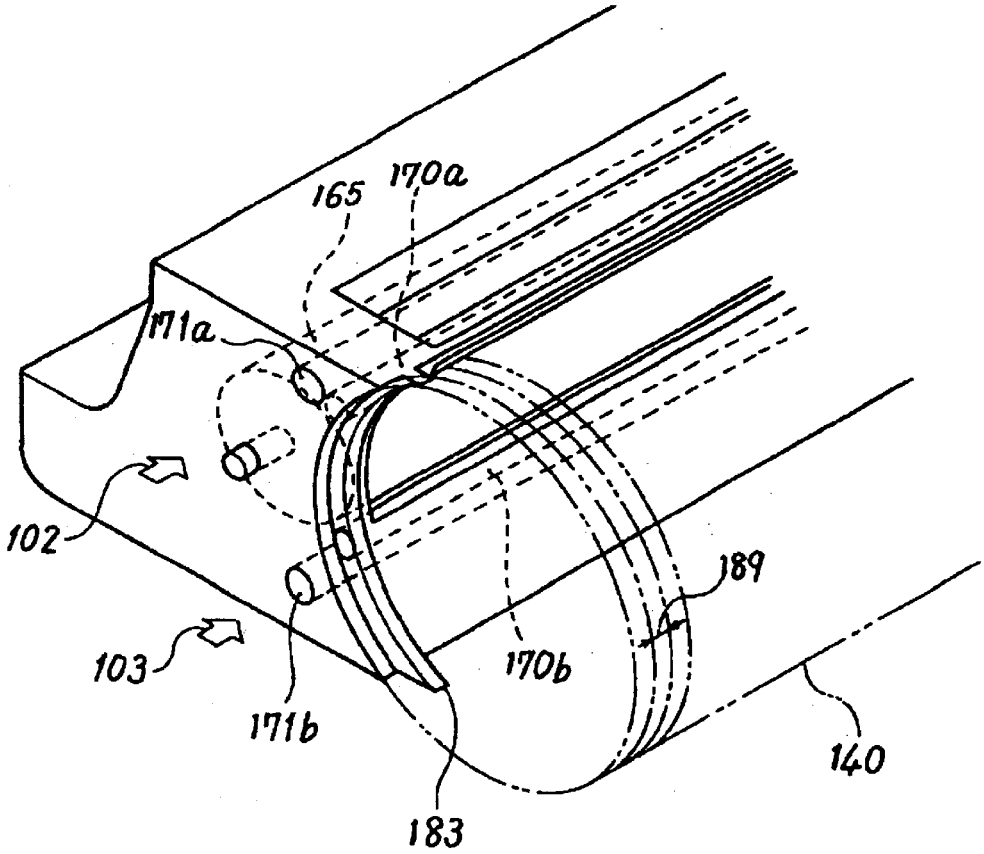
FIG. 31 is a perspective view showing the developing device of FIG. 30.
Figure 32:
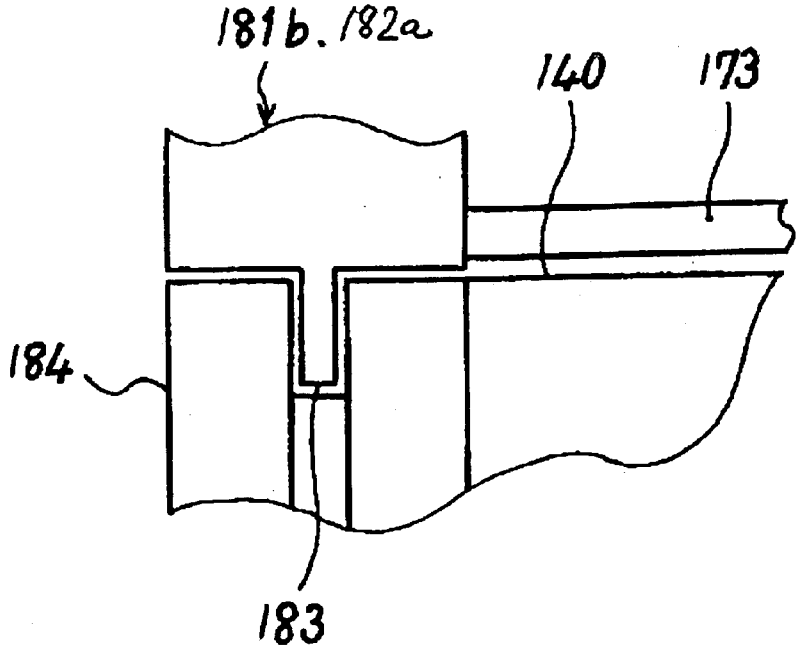
FIG. 32 shows a specific arrangement for preventing a controlled gas from leaking via the end of a sleeve included in the fourteenth embodiment.

The developing device 160 stores a two-ingredient type developer, i.e., a magnetic carrier and non-magnetic toner mixture. As shown in FIG. 31, the developing device 160 includes a casing 180 formed with an opening. A developing sleeve 165, provided with a diameter of 30 mm, is disposed in the casing 180 and faces the drum 140 via the above opening. A stationary magnet roller, not shown, is accommodated in the sleeve 165. A doctor blade 166 has an edge adjoining the sleeve 165. An agitating portion 167 conveys the developer toward the sleeve 165 with two screws 168 while agitating it. The agitating portion 167 is divided by a partition 169 except for opposite ends thereof.

The developer fed to and deposited on the sleeve 165 is scooped up by the magnet roller and retained on the sleeve 165 in the form of a magnet brush. The doctor blade or metering member 166 regulates the height of the magnet brush being conveyed by the sleeve 165. The developer removed by the doctor blade 166 is returned to the agitating portion 167. The toner of the developer deposited on the sleeve 165 is transferred to the drum 140 by a bias applied to the sleeve 165, developing a latent image formed on the drum 140 to thereby produce a corresponding toner image. The developer left on the sleeve 165 after development parts from the sleeve 165 at a position where the magnetic force of the magnet roller does not act, and returns to the agitating portion 167.

As shown in FIG. 30, part of the drum 140 and part of the sleeve 165 face each other, forming a nip for development or developing zone. Two rollers 170*a* and 170*b*, having a diameter of 3 mm to 6 mm each, face the sleeve 165 and drum 140 at the upstream side and downstream side, respectively, of the nip in the direction of movement of the sleeve 165. Let the upstream side and downstream side of the nip be referred to as an upper space and a lower space, respectively. The rollers 170*a* and 170*b* are rotated by, e.g., a motor not shown.

The roller 170*a* is rotated such that its surface moves in the same direction as the surface of the drum 140 while the roller 170*a* is rotated such that its surface moves in the opposite direction to the surface of the drum 140. While the peripheral speed of the rollers 170*a* and 170*b* is selected to be substantially the same as the peripheral speed of the drum 140, the peripheral speed of the rollers 170*a* and 170*b* may be varied, as will be described later specifically. Passage forming members 172*a* and 172*b* are respectively associated with the rollers 170*a* and 170*b*, and each is formed with a slit extending in the axial direction of the associated roller. Spaces inside the passage forming members 172*a* and 172*b* constitute passages 171*a* and 171*b*, respectively.

Facing members 173*a* and 173*b* are formed integrally with or so positioned as to abut against the passage forming members 172*a* and 172*b*, respectively. The facing members 173*a* and 173*b* respectively form preselected gaps G1 and G2 between them and the drum 140. The gaps G1 and G2 are respectively so dimensioned as to restrict the inflow of an air stream, indicated by a dotted arrow in FIG. 30, produced on the surface of the drum 140 into the upper space of the nip and to restrict the outflow of air, containing toner, via the lower space of the nip.

As shown in FIG. 31, controlled gases 102 and 103 are caused to flow through the passages 171*a* and 171*b*. As shown in FIG. 30, scrapers 174*a* and 174*b* are positioned at the opposite ends of the slits of the passage forming members 172*a* and 172*b*; which respectively adjoin the rollers 170*a* and 170*b*, in order to prevent scattered toner from entering the passages 171*a* and 171*b* via the upper and lower spaces of the nip and to obviate the unnecessary outflow of the controlled gases 102 and 103. The passages 171*a* and 171*b* each have a great axial length relative to the cross-sectional area, so that the pressure loss is great. Generally, therefore, use is made of, e.g., a pump capable of implementing high static pressure with a low flow rate. In the illustrative embodiment, use is made of a diaphragm pump.

In the illustrative embodiment, the passages 171*a* and 171*b* each have a small sectional area and can therefore be easily formed by a single hermetic member. The controlled gases 102 and 103, respectively fed via the passages 171*a* and 171*b*, flow out to the spaces around the nip as surface air flows produced by the rotation of the rollers 170*a* and 170*b*, respectively. Because the flow rate of the gases 102 and 103 is small, pressure inside the passages 171*a* and 171*b* is maintained high enough to produce stable surface air flows in the axial direction. The surface air flow produced by the roller 170*a* prevents the surface air flow 101 on the drum 140 from entering the nip. This reduces the amount of external air to enter the developing device for thereby maintaining stable environment in the developing device. On the other hand, the surface air flow produced by the roller 170*b* prevents the controlled gas downstream of the nip and containing toner from flowing out of the developing device as a surface air flow on the drum 140.

The gases 102 and 103 are so controlled as to stabilize the frictional charging characteristic of the developer and refer to gases controlled in at least one of temperature and humidity. The gases 102 and 103 are sent from a tank or similar adjusting means.

The developing device 160 is usually provided with a hermetic structure because the developer is circulated in the developing device 160 and because toner grains with short charges fly about. In light of this, depressurizing means 175, which will be described later, is fluidly communicated to the developing device 160 via a filter 176 in order to prevent the controlled gas 103 from flowing out via the gap G2 between the drum 140 and the facing member 173*b*.

Reference will be made to FIGS. 31 and 31 for describing the developing device 160 of the illustrative embodiment in which the facing members 173*a* and 173*b* and opposite end portions constituted by either one of an above-sleeve cover 182*a* or a below-development case 181*b* are tightly connected to each other. As shown, a rib 183 protrudes from each end portion of the developing device 160 that faces a flange 184 included in the drum 140. The rib 183 is received in a groove 189 formed in the flange 184. The rib 183 provided on developing device 160, which is stationary, reduces the size when assembled than a rib provided on the drum 140. Such ribs 183 prevent the controlled gases 102 and 103, flown out of the passages 170*a* and 170*b* to the spaces around the nip, from blowing out toward the outside of the developing device 160 at axially opposite ends. Further, the ribs 183 reduce the amount of, among gases to flow into the developing device 160, external air to be introduced into the gases, thereby stabilizing the environment in the developing device 160.

The gap between the rib 183 and the groove 189 formed in the flange 184 should be as small as possible, so that the pressure loss increases when the gap is regarded as a passage, thereby obviating the leak of the controlled gases 102 and 103. If desired, the number or the length of the ribs may be increased or the direction of flow of the controlled gases may be varied for the purpose of obviating the leak of the controlled gases. Such a configuration is simple and facilitates the mounting and dismounting of the unit.

In operation, a surface air flow produced by the rotation of the drum 140 in the same direction and the rib 183 serve, in combination, to prevent the controlled gases flown out to the spaces around the nip from flowing further to the outside. The spaces around the nip are therefore held in a substantially hermetically sealed condition. Consequently, the controlled gases 102 and 103 fed via the passages 171*a* and 171*b*, respectively, flow into the developing device 160 on the basis of balance in pressure between the outside and the inside of the developing device 160. Further, because the spaces around the nip are filled with the controlled gases, the environment up to the time when toner is caused to deposit on a latent image by an electric field can be controlled. For these reasons, it is possible to stabilize an image. In addition, the ratio of the controlled gases in the developing device 160 is high, so that a circulation system can be easily established by collecting the gases.

Figure 33:
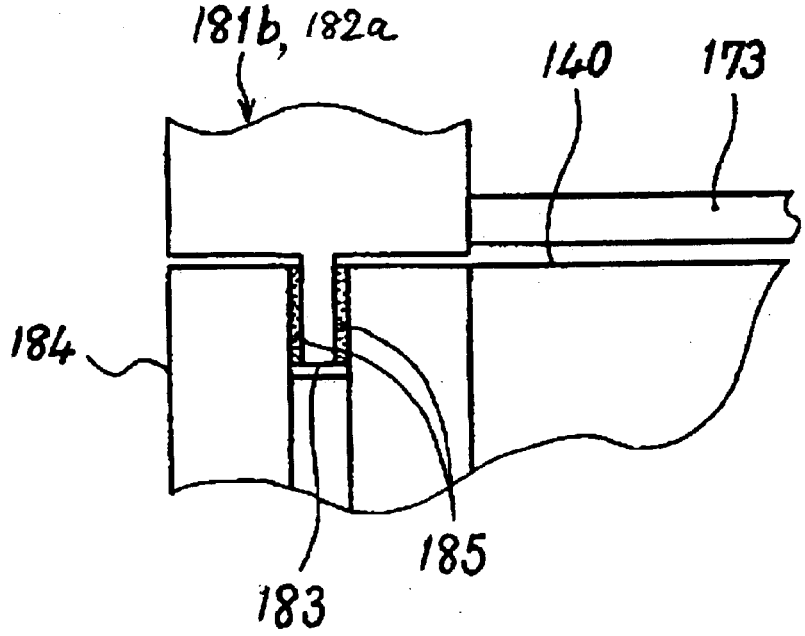
FIG. 33 shows another specific arrangement for obviating the leak of the controlled gas.

As shown in FIG. 33, seal members 185 may be fitted on the ribs 183 of the developing device 160. With this simple arrangement, it is possible to maintain hermetic sealing by reducing the deformation of the seal members 185 ascribable to compression while maintaining the gap between the sleeve 165 and the drum 140 accurate.

How the illustrative embodiment controls pressure in the developing device 160 will be described hereinafter. Briefly, to control pressure in the developing device 160, the illustrative embodiment uses, in addition to the depressurizing means 175, FIG. 30, means that varies the rotation speed of the rollers 170*a* and 170*b* and means that feeds pressure derived from the controlled gases 102 and 103. Further, a sensor senses a pressure difference between the inside and the outside of the developing device 160 during operation. The adjusting means mentioned above are controlled in accordance with the output of the sensor. Therefore, even in an image forming apparatus of the type capable of varying the rotation speed of the sleeve 165, pressure in the developing device can be controlled to prevent pressure in the spaces around the nip from rising for thereby obviating the scattering of toner ascribable to pressure variation.

For the depressurizing means 175, use may be made of a suction pump. Alternatively, pressure may be controlled by use of vacuum available in another air stream. The pressurizing means 175 allows the control gas 103 to easily flow into the developing device via the lower space of the nip. It is to be noted that the controlled gas 102 fed via the upper space of the nip is intercepted by the nip and therefore little susceptible to depressurization effected in the developing device.

Further, the depressurizing means 175, disposed in the developing device 160 having a relatively large capacity, realizes a broad pressure control range and therefore a broad allowable range of, e.g., the peripheral speed of the sleeve 165.

To control pressure in the developing device 160 by varying the rotation speed of the roller 170, e.g., to maintain it low, it is effective to maintain the peripheral speed of the roller 170 low. On the other hand, the peripheral speed of the roller 170, which additionally serves to feed the controlled gas as a surface air flow and obviate toner scattering, should be confined in a certain adequate range. Because delicate control over the rotation speed of the roller 170 is easy to execute, it is possible to balance the function of obviating toner scattering and the function of feeding the controlled gas while controlling pressure, promoting stable operation of the developing device 106. Further, the developing device 160 is small size because the roller 170 bifunctions as a drive section for pressure control. Moreover, the mechanism for controlling the rotation speed of the roller 170 reduces the size of the developing device 160 more than, e.g., pumping means.

The pressure feeding means stated above is auxiliary means used for pressure control. When the depressurization of the developing device 160 and the feed of the controlled gases 102 and 103 to the passages 171*a* and 171*b* are implemented by a single pump, the controlled gases constitute a circulation system and therefore simplify the device configuration. In addition, because gases should only be replenished in a small amount sufficient to making up for leak, the range of the kind of control gases applicable to the illustrative embodiment is broadened.

The illustrative embodiment is practicable not only with an image forming apparatus in which the peripheral speed of the drum 140 is constant, but the peripheral speed of the sleeve 165 is variable in accordance with image forming conditions, and an image forming apparatus in which a plurality of different peripheral speeds are assigned to each of the drum 140 and sleeve 165.

In the stand-by condition, because the amount of controlled gases to flow out from the spaces around the nip is small, the control gases are replenished in an amount just enough to make up for leak.

Even in a counter developing system in which the drum 140 rotates in the direction opposite to the direction shown and described, the illustrative embodiment is practicable without changing the configuration of the developing device.

Figure 34:
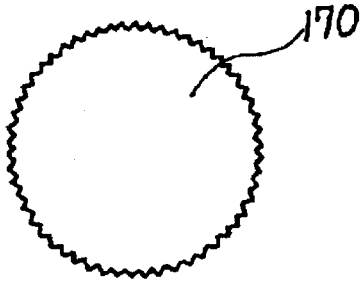
FIG. 34 shows a specific configuration of a roller included in the fourteenth embodiment.
Figure 35:
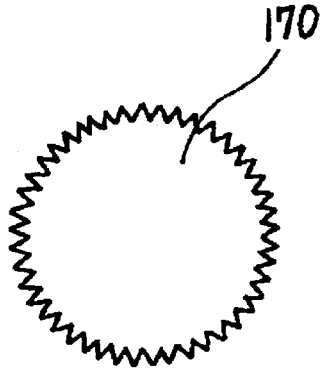
FIG. 35 shows another specific configuration of the roller.
Figure 36:
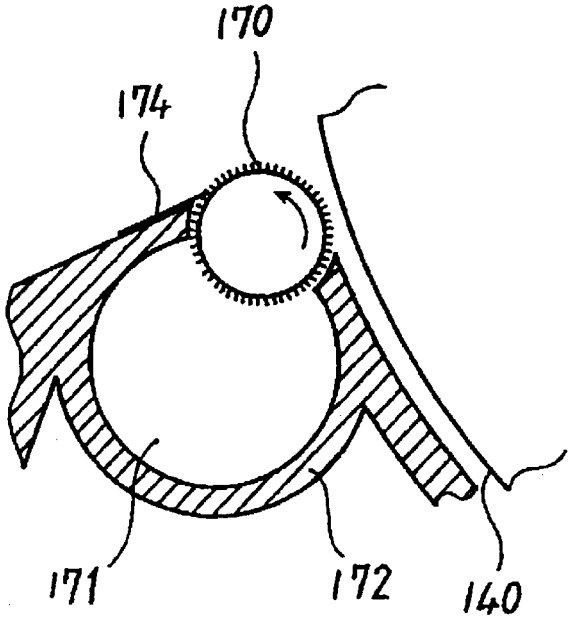
FIG. 36 shows still another specific configuration of the roller.

FIGS. 34 through 36 show specific configurations of the roller 170. In FIG. 34, the surface of the roller 170 is roughened by sand blasting so as to form a thick surface air flow during rotation. Surface air flows produced by such two rollers 170*a* and 170*b* during rotation smoothly entrain the controlled gases 102 and 103 into the developing device 160 while promoting the peeling of the surface air flow 101 produced by the drum 140. Sand blasting may be replaced with etching, if desired.

In FIG. 35, the surface of the roller 170 is provided with a rough surface by machining, component rolling or similar technology. In FIG. 36, fibers are implanted in the surface of the roller 170 by electrostatic flock printing. Although electrostatic flock printing is slightly higher in cost than the other technologies stated above, it allows the fibers to contain a large amount of controlled gas and to drive the flow for thereby promoting the peeling of the surface air flow 101 of the drum 140. Further, the fibers, which are soft, can be held in contact with the passage forming member 172, obviating the leak of the controlled gas. Consequently, the controlled gases 102 and 103 fed via the two passages 171*a* and 171*b* can be effectively used. Each roller 170 is formed of metal, resin or the like held at the same potential as the bias for development.

Referring again to FIG. 29, the operation of the color copier will be described hereinafter. First, the operator of the copier stacks desired document on a document tray 130 included in the ADF 400 or opens the ADF 400, lays a desired document on a glass platen 132 and again closes the ADF 400. Subsequently, when the operator presses a start switch, not shown, the scanner 300 is driven after one document has been conveyed from the ADF 400 to the glass platen 132 or is immediately driven when a document is set on the glass platen 132 by hand. While a first carriage 133 in movement illuminates the document positioned on the glass platen 132, the resulting reflection from the document is further reflected toward a second carriage 134 also in movement. The reflection is then reflected by a mirror mounted on the second carriage 134 to be incident to an image sensor 136 via a lens 135. The image sensor 136 outputs image data representative of the document.

In the image forming means 18Y through 18B, the drums 40Y through 40B are rotated while being uniformly charged by the chargers 160Y through 160M, respectively. The scanner 300 scans the charged surfaces of the drums 140Y through 140B light beams issuing from laser diodes or LEDs in accordance with image data, thereby forming latent images on the drums 140Y through 140B.

Subsequently, the developing devices 160Y through 160B respectively develop the latent images formed on the drums 140Y through 140B with Y, C M and B toners to thereby produce corresponding toner images. At this instant, one of the rollers 114 through 116, supporting the belt 110, is rotated to move the belt 110 with the result that the toner images are sequentially transferred from the drums 140Y through 140B to the belt 110 one above the other, completing a composite color image on the belt 110. After the image transfer, drum cleaners 163Y through 163B respectively remove toners left on the drums 140Y through 140B. Subsequently, discharging devices 164Y through 164B respectively discharge the surfaces of the drums 140Y through 140B to thereby prepare them for the next image forming cycle.

When the operator presses the start switch, as stated earlier, one of pickup rollers 142 disposed in the sheet feed table 200 is selected and caused to pay out one sheet from associated one of a plurality of sheet cassettes 144. At this instant, a reverse roller 145 separates the above sheet from the underlying sheets. As a result, the sheet thus paid out is conveyed via a path 146, roller pairs 147 and a path 148, which is arranged in the copier body 100, to a registration roller pair 149. Alternatively, a pickup roller 150 associated with a manual feed tray 151 may be driven to pay out a sheet from the manual feed tray 151, in which case the sheet is separated from the underlying sheets by a reverse roller 152 and then conveyed to the registration roller pair 149 via a path 153. The registration roller pair 149 stops the sheet and then conveys it at such timing that the leading edge of the sheet meets the leading edge of the composite color image formed on the belt 110 at the nip between the belt 110 and the secondary image transferring device 122. The secondary image transferring device 122 transfers the composite color image from the belt 110 to the sheet. While the registration roller pair 149 is, in many cases, grounded, a bias may be applied to the registration roller pair 149 for removing paper dust from the sheet.

If desired, the belt 140 may be omitted, in which case the toner image will be directly transferred from the drums 140 to the sheet.

The illustrative embodiment is, of course, similarly applicable to an image forming apparatus other than the tandem color image forming apparatus shown and described. The crux of the image forming apparatus to which the present invention is that it includes at least a developer carrier and an image carrier, forms a preselected gap for development between the developer carrier and the image carrier, and drives at least one of the developer carrier and image carrier.

Figure 37:
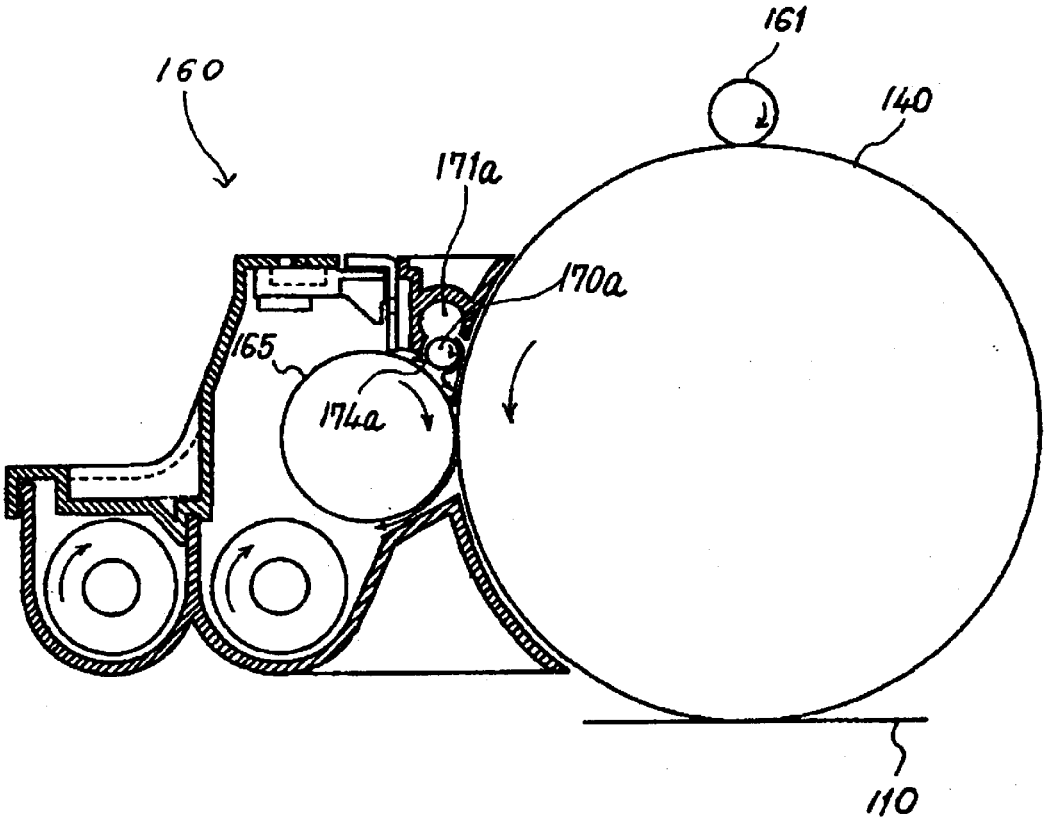
FIG. 37 shows a first modification of the fourteenth embodiment.

FIG. 37 shows a first modification of the illustrative embodiment. As shown, the controlled gas 102 is fed into the developing device 160 only via the upper space of the nip for the purpose of filling up the developing device 160 with the control gas. The controlled gas 102 flows into the developing device 160 via the nip and replaces air present in the developing device 160 little by little until it fills up the developing device 160. Excess part of the controlled gas 102 flows out to the outside via the end portions of the sleeve 165. This part of the controlled gas 102 does not aggravate toner scattering because the amount of the controlled gas 102 flowing into the developing device 160 via the nip for a unit time is extremely small. It follows that the modification makes even the depressurizing means 175 unnecessary for thereby reducing the size of the developing device 160.

Alternatively, to maintain the desirable environment in the developing device 160, the controlled gas may be sent into the developing device 160 via a space facing the drum 140 at a position upstream of the space of the nip in the direction of rotation of the drum 140. However, the method of the above modification successfully limits the feeding region more than the alternative method and therefore achieves the following advantages. First, the amount of the controlled gas to be fed can be reduced, so that the feeding means for feeding the controlled gas is reduced in size. In addition, a broad range of controlled gases, including inactive gases can be used. Second, the sectional area of the passage can be reduced, so that a single member can easily form the passage and makes the passage highly hermetic. Third, a controlled gas under high pressure can be fed. This kind of controlled gas can rapidly replace air present in the developing device 160.

A controlled gas is sometimes fed to a charging section in order to prevent ozone, NOx and other discharge products from effecting a drum and degrading the durability of a developing device. In such a case, the developing section may share the same controlled gas as the charging section. For example, when an inactive controlled gas is fed to the discharging section, it may be fed into the developing device as well.

In the modification, the rib 183 and groove 189 may be used as in the illustrative embodiment so as to achieve the advantages stated earlier.

Figure 38:
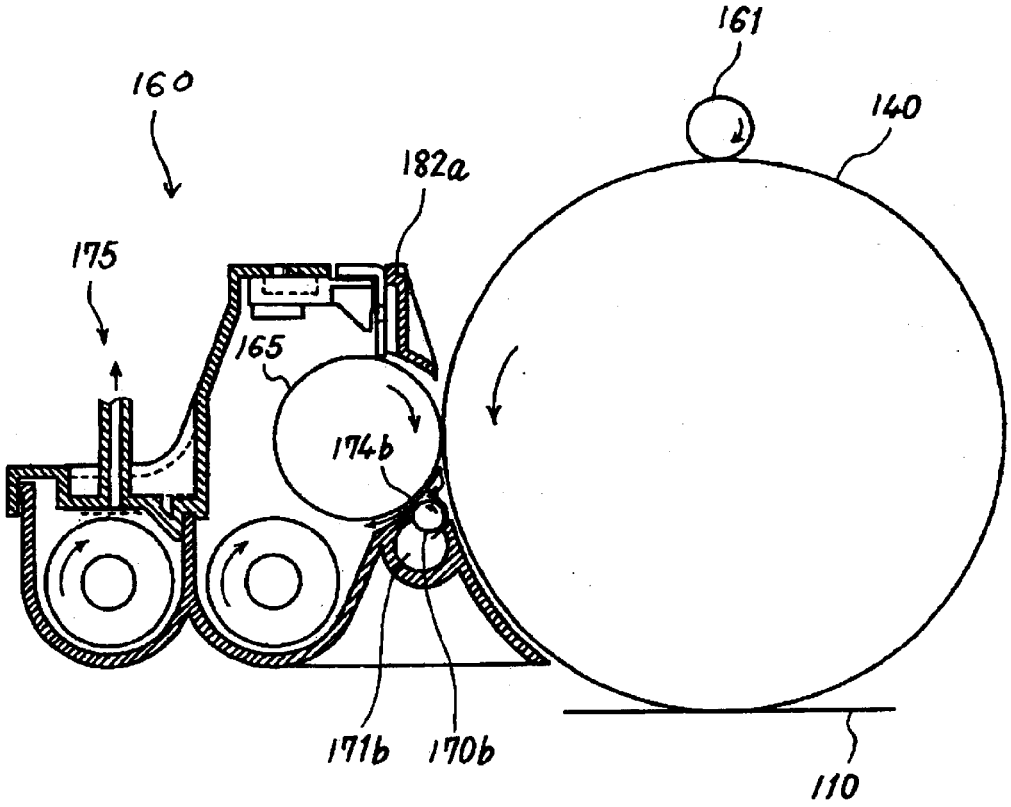
FIG. 38 shows a second modification of the fourteenth embodiment.

FIG. 38 shows a second modification of the illustrative embodiment. As shown, the controlled gas 103 is fed into the developing device 160 only via the lower space of the nip for the purpose of filling up the developing device 160 with the controlled gas 103. This modification needs the depressurizing means 175 because the controlled gas 103 enters the developing device 160 via the roller 170*b* more than the controlled gas 102 used in the first modification.

When the controlled gas 103 is fed only via the lower space of the nip, as stated above, the surface air flow produced by the roller 170*b* prevents the gas around the lower space of the nip from flowing out to the outside. This not only stabilizes the environment in the developing device 106, but also causes a minimum of toner to fly about. Further, the controlled gas 103 can be fed under high pressure because it is obstructed by, e.g., the nip little, compared to the controlled gas 102 fed via the upper space of the nip. This enhances rapid replacement of air present in the developing device 160. Moreover, the depressurizing means 175, disposed in the developing device 160, promotes the suction of the gas in the lower space of the nip, further enhancing rapid replacement of air.

Again, the rib 183 and groove 189 may be used as in the illustrative embodiment so as to achieve the advantages stated earlier.

Figure 39:
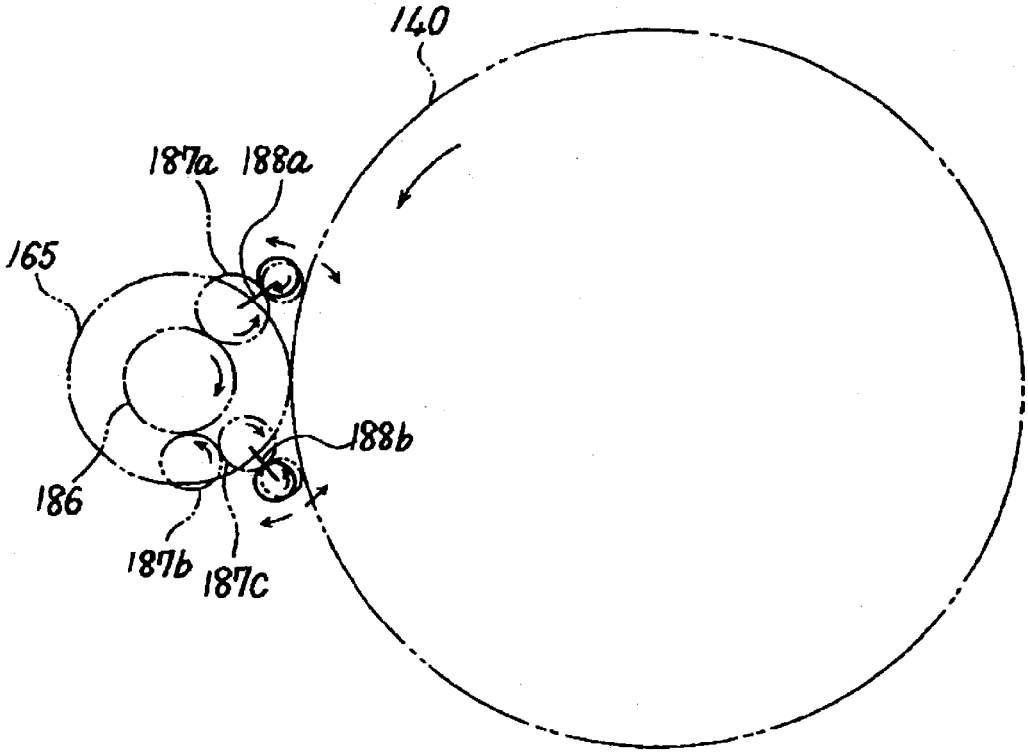
FIG. 39 shows a third modification of the fourteenth embodiment.
Figure 40:
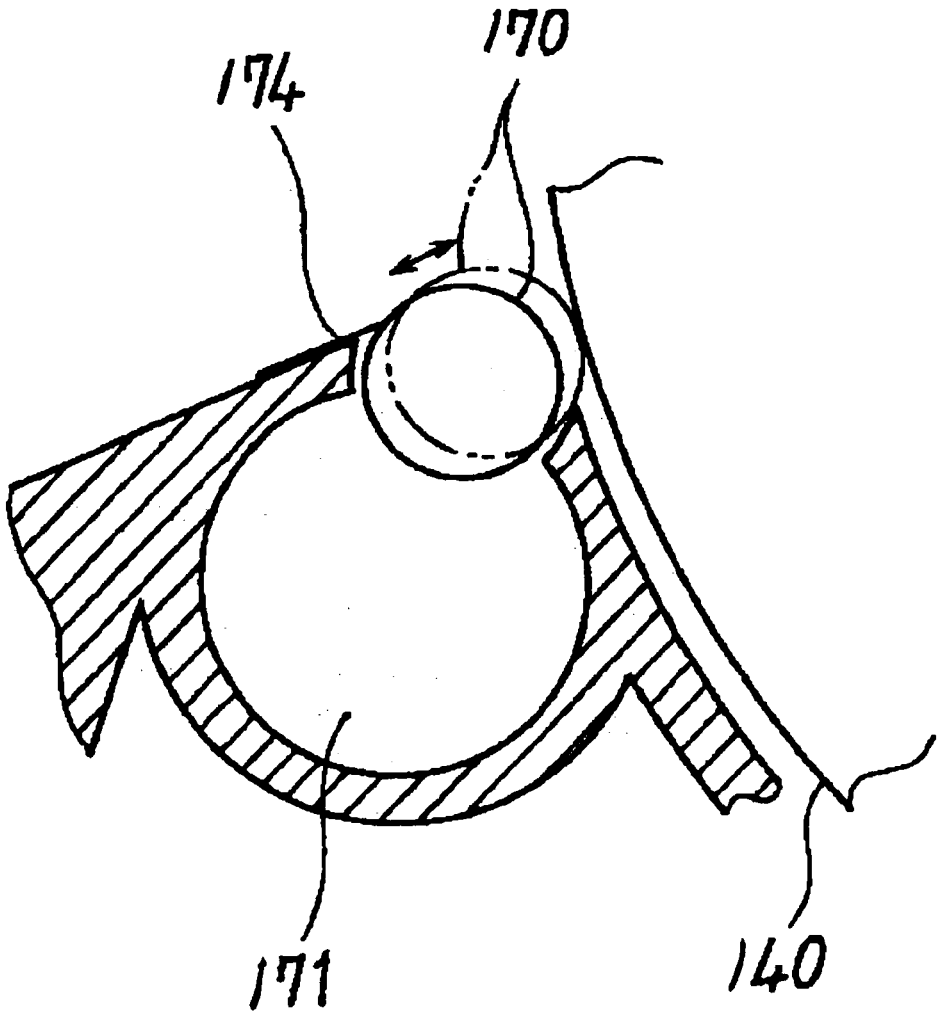
FIG. 40 shows a specific mechanism for driving the roller.

FIGS. 39 and 40 show a third modification of the illustrative embodiment. As shown, drive means for driving the two rollers 170*a* and 170*b* is implemented by a gear 186, which has a fixed axis and drives the sleeve 165. Alternatively, the drive means assigned to the rollers 170*a* and 170*b* may be driven independently of the gear 186 or may be implemented by a gear that drives the drum 140.

More specifically, as shown in FIGS. 39 and 40, the rollers 170*a* and 170*b* are supported by pivotal arms or support means 188*a* and 188*b*, respectively. The pivotal arms 188*a* and 188*b* each are pivotable about the same axis as a particular idler gear 187. In this configuration, the rollers 170*a* and 170*b* are angularly movable about the axes of the associated idler gears 187 via the pivotal arms 188*a* and 188*b*, respectively. Moving means, not shown, is assigned to each of the rollers 170*a* and 170*b* and may be implemented as a spring or biasing means. Positioning means, not shown, maintains each of the rollers 170*a* and 170*b* spaced from the drum 140 by the preselected gap during operation or holds it substantially in contact with the drum 140 in the stand-by condition.

More specifically, as shown in FIG. 40, during operation, each roller 170*a* or 170*b* rotates while being spaced from the associated passage forming member 171*a* or 171*b* by the preselected gap, so that the surface air flow produced by the roller 170*a* or 170*b* enters the developing device 160. On the completion of the operation, the roller 170*a* or 170*b* contacts the drum 140 under the action of the biasing means with the result that the gap between the roller 170*a* or 170*b* and the drum 140, which would bring about leak, to disappear. Consequently, in the stand-by condition, it is possible to prevent the controlled gas from flowing out via the above gap and prevent external air from entering the developing device 160, thereby maintaining the environment in the developing device 160 over a long period of time. A circulation system can be easily established because the content of the controlled gases in the developing device 160 is high. If desired, an arrangement may be made to reduce the gap between the passage forming member 171*a* or 171*b* and the roller 170*a* or 170*b*.

Various modifications will become possible for those skilled in the art after receiving the teachings of the present disclosure without departing from the scope thereof.

What is claimed is:

1. An image forming apparatus for uniformly charging a photoconductive element in rotation with a charger, exposing imagewise said photoconductive drum charged by said charger to thereby form a latent image, developing said latent image with a developing device using a forward developing system and including a casing, which is formed with an opening facing said photoconductive element, and a developer carrier facing said photoconductive element via said opening, and transferring a developed image to an image transfer member being conveyed, said image forming apparatus comprising:

feeding means for feeding a controlled gas to a position upstream, in a direction of rotation of the photoconductive element, of a developing position where the developing device operates;

developing zone switching means for selectively causing a developer layer deposited on the developer carrier to contact a developing zone of the photoconductive element in an image formation condition or to part from said developing zone in a stand-by condition; and sealing means for maintaining, in the image forming condition, a gap between the photoconductive element and the casing at a position downstream of the developing zone in the direction of rotation of said photoconductive element or sealing said gap in the stand-by condition.

2. The apparatus as claimed in claim 1, further comprising collecting zone switching means for causing, in the image forming condition, the developer layer on the developer carrier to contact an inner surface of the casing, which lies in a developer collecting zone, or causing, in the stand-by condition, said developer carrier to part said inner surface of said casing.

3. The apparatus as claimed in claim 2, wherein said developer carrier comprises a rotatable sleeve and a magnet roller disposed in said sleeve and formed with a plurality of magnetic poles equally spaced along an inner circumference of said sleeve, and said developing zone switching means and said collecting zone switching means displace said magnet roller by a preselected angle in a direction of rotation.

4. The apparatus as claimed in claim 2, wherein said collecting zone switching means and said sealing means share a movable member mounted on the casing in such a manner as to be freely movable in a direction in which a gap between the developer carrier and the photoconductive element varies, and freely lockable at a desired position.

5. The apparatus as claimed in claim 2, wherein said developing zone switching means varies a position of the casing relative to the photoconductive element to thereby cause the developer layer to selectively contact the developing zone of said photoconductive element, and said collecting zone switching means and said sealing means share a movable member mounted on the casing in such a manner as to be freely movable in a direction in which a gap between the developer carrier and the photoconductive element varies, and freely lockable at a desired position, and an interlocking mechanism configured to displace said movable member in interlocked relation to a movement of said casing relative to said photoconductive element.

6. The apparatus as claimed in claim 2, further comprising:

depressurizing means controlled by said feeding means for lowering, in the stand-by condition, a pressure in the casing below a pressure of the controlled gas present at an upstream side in a direction of rotation of the developer carrier; and interrupting means for interrupting an operation of said depressurizing means in the stand-by condition.

7. The apparatus as claimed in claim 6, wherein said depressurizing means comprises an exhaust passage fluidly communicated to the casing via a discharge opening, which is formed in said casing and open toward a downstream side in a direction in which the controlled gas fed from said feeding means flows.

8. The apparatus as claimed in claim 7, wherein said discharge opening is positioned upstream of a path along which the controlled gas fed from said feeding means flows.

9. The apparatus as claimed in claim 8, further comprising a bladed wheel located at said discharge opening and having an axis of rotation parallel to said path along which the controlled gas fed from said feeding means flows.

10. The apparatus as claimed in claim 9, wherein said bladed wheel comprises an eccentric fan having an axis of rotation perpendicular to a direction in which the controlled gas fed from said feeding means flows.

11. The apparatus as claimed in claim 7, further comprising a fan rotatable at a variable speed and positioned on a path along which the controlled gas fed from said feeding means flows.

12. The apparatus as claimed in claim 6, wherein said developing region switching means, said collecting region switching means, said sealing means and said interrupting means share a single drive source.

13. The apparatus as claimed in claim 12, wherein said drive source drives the developing device as well.

14. The apparatus as claimed in claim 1, further comprising:

depressurizing means controlled by said feeding means for lowering, in the stand-by condition, a pressure in the casing below a pressure of the controlled gas present at an upstream side in a direction of rotation of the developer carrier; and interrupting means for interrupting an operation of said depressurizing means in the stand-by condition.

15. The apparatus as claimed in claim 14, wherein said depressurizing means comprises an exhaust passage fluidly communicated to the casing via a discharge opening, which is formed in said casing and open toward a downstream side in a direction in which the controlled gas fed from said feeding means flows.

16. The apparatus as claimed in claim 15, wherein said discharge opening is positioned upstream of a path along which the controlled gas fed from said feeding means flows.

17. The apparatus as claimed in claim 16, further comprising a bladed wheel located at said discharge opening and having an axis of rotation parallel to said path along which the controlled gas fed from said feeding means flows.

18. The apparatus as claimed in claim 17, wherein said bladed wheel comprises an eccentric fan having an axis of rotation perpendicular to a direction in which the controlled gas fed from said feeding means flows.

19. The apparatus as claimed in claim 15, further comprising a fan rotatable at a variable speed and positioned on a path along which the controlled gas fed from said feeding means flows.

20. The apparatus as claimed in claim 14, wherein said developing region switching means, said collecting region switching means, said sealing means and said interrupting means share a single drive source.

21. The apparatus as claimed in claim 20, wherein said drive source drives the developing device as well.

22. The apparatus as claimed in claim 1, wherein the developer carrier comprises a rotatable sleeve and a magnet roller disposed in said sleeve and formed with a plurality of magnetic poles equally spaced along an inner circumference of said sleeve, and said developing zone switching means comprises magnetic force generating means buried in the photoconductive element at a position facing the opening of the casing for selectively generating magnetic lines of force of a same polarity as the magnetic poles of said developer carrier.

23. An image forming apparatus for uniformly charging a photoconductive element in rotation with a charger, exposing imagewise said photoconductive drum charged by said charger to thereby form a latent image, developing said latent image with a developing device using a reverse developing system and including a casing, which is formed with an opening facing said photoconductive element, and a developer carrier facing said photoconductive element via said opening, and transferring a developed image to an image transfer member being conveyed, said image forming apparatus comprising:

feeding means for feeding a controlled gas to a position upstream, in a direction of rotation of the photoconductive element, of a developing position where the developing device operates;

collecting zone switching means for causing, in an image forming condition, the developer layer on the developer carrier to contact an inner surface of the casing, which lies in a developer collecting zone, or causing, in a stand-by condition, said developer carrier to part said inner surface of said casing; and sealing means for maintaining, in the image forming condition, a gap between the photoconductive element and the casing at a position downstream of the developing zone in the direction of rotation of said photoconductive element or sealing said gap in the stand-by condition.

24. An image forming apparatus for uniformly charging a photoconductive element in rotation with a charger, exposing imagewise said photoconductive drum charged by said charger to thereby form a latent image, developing said latent image with a developing device comprising a developer carrier, which is rotated in a direction opposite to said photoconductive element for depositing a developer on said latent image, and transferring a developed image to a recording medium being conveyed, said image forming apparatus comprising:

a casing included in said developing device and configured to cover the photoconductive element and storing the developer therein, the developer carrier being partly exposed via an opening, which is formed in said casing, and facing said photoconductive element;

an air conditioning box fluidly communicated to said opening of said casing from an upstream side in a direction of rotation of the developer carrier and configured to cover the charging device and part of a surface of the photoconductive element facing said charging device, a humidity-controlled gas being caused to flow via said air conditioning box;

an air conditioner configured to send the humidity-controlled gas into said air conditioning box;

a feed path providing fluid communication between said casing and said air conditioning box for causing the humidity-controlled gas to flow;

a feeding section configured to feed the humidity-controlled gas from said air conditioning box to said casing via said feed path;

feeding means for causing said feeding section to feed the humidity-controlled gas to when the developer carrier is not driven; and interrupting means for causing said feeding section to stop feeding the humidity-controlled gas when the developer carrier is driven.

25. The apparatus as claimed in claim 24, wherein the developing device comprises a guide member adjoining the photoconductive element and extending from said opening of said casing to a position close to an image transfer position where the developed image is transferred to the recording medium.

26. The apparatus as claimed in claim 25, wherein said guide member comprises a first guide portion configured to guide a viscous air flow produced on a surface of said image transfer member in a direction other than a direction in which said image transfer member moves.

27. The apparatus as claimed in claim 25, wherein said guide member comprises a second guide portion configured to guide a viscous air flow produced on a surface of the photoconductive element in a direction other than a direction in which said surface moves.

28. The apparatus as claimed in claim 25, wherein said guide member comprises a suction path configured to suck a gas and an opening communicated to said suction path and adjoining the image transfer position.

29. An image forming apparatus for uniformly charging a photoconductive element in rotation with a charger, exposing imagewise said photoconductive drum charged by said charger to thereby form a latent image, developing said latent image with a developing device comprising a developer carrier, which is rotated in a direction same as said photoconductive element for depositing a developer on said latent image, and transferring a developed image to a recording medium being conveyed, said image forming apparatus comprising:

a casing included in said developing device and configured to cover the photoconductive element and storing the developer therein, the developer carrier being partly exposed via an opening, which is formed in said casing, and facing said photoconductive element;

an air conditioning box fluidly communicated to said opening of said casing from a downstream side in a direction of rotation of the developer carrier and configured to cover the charging device and part of a surface of the photoconductive element facing said charging device, a humidity-controlled gas being caused to flow via said air conditioning box;

an air conditioner configured to send the humidity-controlled gas into said air conditioning box;

a discharge path via which the humidity-controlled gas flows out of said casing; and a discharging section configured to discharge the humidity-controlled gas from said casing via said discharge gas by sucking said humidity-controlled gas.

30. The apparatus as claimed in claim 29, wherein the developer carrier and said discharging section are driven by a single drive source.

31. The apparatus as claimed in claim 30, further comprising:

a feed path providing fluid communication between said casing and said air conditioning box for causing the humidity-controlled gas to flow;

a feeding section configured to feed the humidity-controlled gas from said air conditioning box to said casing via said feed path;

feeding means for causing said feeding section to feed the humidity-controlled gas to when the developer carrier is not driven; and discharging means for causing said discharging section to discharge the humidity-controlled gas when the developer carrier is driven.

32. The apparatus as claimed in claim 31, wherein said feed path and said discharge path are fluidity communicated to each other, and said feeding section and said discharging section comprise a single section.

33. The apparatus as claimed in claim 32, further comprising:

a blocking/unblocking section configured to selectively block or unblock said feed path and said discharge path for thereby selecting either one of said feed path and said discharge path; and switching means for causing said blocking/unblocking means to select said discharge path when the developer carrier is driven or select said feed path when said developer carrier is not driven.

34. The apparatus as claimed in claim 29, further comprising:

a feed path providing fluid communication between said casing and said air conditioning box for causing the humidity-controlled gas to flow;

a feeding section configured to feed the humidity-controlled gas from said air conditioning box to said casing via said feed path;

feeding means for causing said feeding section to feed the humidity-controlled gas to when the developer carrier is not driven; and discharging means for causing said discharging section to discharge the humidity-controlled gas when the developer carrier is driven.

35. The apparatus as claimed in claim 34, wherein said feed path and said discharge path are fluidity communicated to each other, and said feeding section and said discharging section comprise a single section.

36. The apparatus as claimed in claim 35, further comprising:

a blocking/unblocking section configured to selectively block or unblock said feed path and said discharge path for thereby selecting either one of said feed path and said discharge path; and switching means for causing said blocking/unblocking means to select said discharge path when the developer carrier is driven or select said feed path when said developer carrier is not driven.

37. The apparatus as claimed in claim 29, wherein the developing device comprises a guide member adjoining the photoconductive element and extending from said opening of said casing to a position close to an image transfer position where the developed image is transferred to the recording medium.

38. The apparatus as claimed in claim 37, wherein said guide member comprises a first guide portion configured to guide a viscous air flow produced on a surface of said image transfer member in a direction other than a direction in which said image transfer member moves.

39. The apparatus as claimed in claim 37, wherein said guide member comprises a second guide portion configured to guide a viscous air flow produced on a surface of the photoconductive element in a direction other than a direction in which said surface moves.

40. The apparatus as claimed in claim 37, wherein said guide member comprises a suction path configured to suck a gas and an opening communicated to said suction path and adjoining the image transfer position.

41. An image forming apparatus comprising developing means for developing, in a developing zone where an image carrier carrying a latent image thereon and a developer carrier carrying a developer thereon face each other, said latent image by feeding said developer to said latent image to thereby produce a corresponding toner image, said image forming apparatus comprising:

a rotatable member adjoining the developer carrier and the image carrier at a position upstream of the developing zone in a direction in which a surface of said developer carrier moves, said rotatable member rotating such that a surface of said rotatable member moves in a same direction as said surface of said developer carrier at a position where said surfaces face each other; and a passage forming member formed with a slit extending in an axial direction of said rotatable member and configured to form a passage therein, said rotatable member facing said slid;

wherein a controlled gas is caused to flow via said passage.

42. The apparatus as claimed in claim 41, further comprising:

a developing device comprising the developing means, which includes an end wall member; and a facing member facing the developer carrier via a small gap at a side upstream of said rotatable member in a direction in which the surface of the image carrier moves, wherein said end wall member and an end portion of said facing member are held in close contact with or formed integrally with each other;

wherein at least one projection protrudes form said end wall member toward the image carrier, and said image carrier is formed with a groove receiving said projection.

43. The apparatus as claimed in claim 42, further comprising means for moving said rotatable member in a direction in which a distance between said rotatable member and said image carrier varies.

44. The apparatus as claimed in claim 41, wherein fibers are implanted on a surface of said rotatable body and contact said passage forming member.

45. The apparatus as claimed in claim 41, further comprising:

a pressure sensor for sensing a pressure in the developing device; and depressurizing means disposed in the developing device and having a variable depressurizing ability;

wherein a rotation speed of the developer carrier, and the depressurizing ability of said depressurizing means is controlled to maintain the pressure in the developing device constant.

46. The apparatus as claimed in claim 41, further comprising a pressure sensor for sensing a pressure in the developing device, wherein a rotation speed of the developing device is variable and is controlled, during operation, to maintain said pressure constant.

47. An image forming apparatus comprising developing means for developing, in a developing zone where an image carrier carrying a latent image thereon and a developer carrier carrying a developer thereon face each other, said latent image by feeding said developer to said latent image to thereby produce a corresponding toner image, said image forming apparatus comprising:

a rotatable member adjoining the developer carrier and the image carrier at a position downstream of the developing zone in a direction in which a surface of said developer carrier moves, said rotatable member rotating such that a surface of said rotatable member moves in an opposite direction to said surface of said developer carrier at a position where said surfaces face each other; and a passage forming member formed with a slit extending in an axial direction of said rotatable member and configured to form a passage therein, said rotatable member facing said slid;

wherein a controlled gas is caused to flow via said passage.

48. The apparatus as claimed in claim 47, further comprising:

a developing device comprising the developing means, which includes an end wall member; and a facing member facing the developer carrier via a small gap at a side upstream of said rotatable member in a direction in which the surface of the image carrier moves, wherein said end wall member and an end portion of said facing member are held in close contact with or formed integrally with each other;

wherein at least one projection protrudes form said end wall member toward the image carrier, and said image carrier is formed with a groove receiving said projection.

49. The apparatus as claimed in claim 48, further comprising means for moving said rotatable member in a direction in which a distance between said rotatable member and said image carrier varies.

50. The apparatus as claimed in claim 47, wherein fibers are implanted on a surface of said rotatable body and contact said passage forming member.

51. The apparatus as claimed in claim 47, further comprising:

a pressure sensor for sensing a pressure in the developing device; and depressurizing means disposed in the developing device and having a variable depressurizing ability;

wherein a rotation speed of the developer carrier, and the depressurizing ability of said depressurizing means is controlled to maintain the pressure in the developing device constant.

52. The apparatus as claimed in claim 47, further comprising a pressure sensor for sensing a pressure in the developing device, wherein a rotation speed of the developing device is variable and is controlled, during operation, to maintain said pressure constant.

* * * * *